US007855040B2

(12) United States Patent
Yanagawa et al.

(10) Patent No.: US 7,855,040 B2
(45) Date of Patent: Dec. 21, 2010

(54) METHOD FOR PREPARING PHOTORECEPTOR, PHOTORECEPTOR PREPARED BY THE METHOD, AND IMAGE FORMING METHOD AND APPARATUS AND PROCESS CARTRIDGE USING THE PHOTORECEPTOR

(75) Inventors: Yoshiki Yanagawa, Numazu (JP); Michio Kimura, Numazu (JP); Nozomu Tamoto, Numazu (JP); Hiromi Tada, Numazu (JP); Tetsuya Toshine, Numazu (JP); Tomoyuki Shimada, Shizuoka-ken (JP); Chiaki Tanaka, Izunokuni (JP)

(73) Assignee: Ricoh Company Limited, Tokyo (JP)

( * ) Notice: Subject to any disclaimer, the term of this patent is extended or adjusted under 35 U.S.C. 154(b) by 480 days.

(21) Appl. No.: 11/926,748

(22) Filed: Oct. 29, 2007

(65) Prior Publication Data

US 2008/0102391 A1 May 1, 2008

(30) Foreign Application Priority Data

Oct. 31, 2006 (JP) ..... 2006-296146

(51) Int. Cl.
*G03G 5/14* (2006.01)

(52) U.S. Cl. ..... 430/69; 430/133; 399/159

(58) Field of Classification Search ..... 430/69, 430/133; 399/159
See application file for complete search history.

(56) References Cited

U.S. PATENT DOCUMENTS

| | | | |
|---|---|---|---|
| 4,886,846 | A | 12/1989 | Shimada et al. |
| 4,898,800 | A | 2/1990 | Shimada et al. |
| 4,931,350 | A | 6/1990 | Shimada et al. |
| 4,956,440 | A | 9/1990 | Limburg et al. |
| 5,047,590 | A | 9/1991 | Shimada et al. |
| 5,159,087 | A | 10/1992 | Shimada et al. |
| 5,219,692 | A | 6/1993 | Shimada et al. |
| 5,233,090 | A | 8/1993 | Shimada et al. |
| 5,250,377 | A | 10/1993 | Shimada et al. |
| 5,334,470 | A | 8/1994 | Shimada et al. |
| 5,344,985 | A | 9/1994 | Tanaka et al. |
| 5,356,742 | A | 10/1994 | Shimada et al. |
| 5,382,692 | A | 1/1995 | Shimada et al. |
| 5,403,950 | A | 4/1995 | Shimada et al. |
| 5,411,827 | A | 5/1995 | Tamura et al. |
| 5,436,100 | A | 7/1995 | Shimada et al. |
| 5,457,232 | A | 10/1995 | Tanaka et al. |
| 5,459,275 | A | 10/1995 | Tanaka et al. |
| 5,475,137 | A | 12/1995 | Shimada et al. |
| 5,488,164 | A | 1/1996 | Shimada et al. |
| 5,496,671 | A | 3/1996 | Tamura et al. |
| 5,550,293 | A | 8/1996 | Shimada et al. |
| 5,576,132 | A | 11/1996 | Tanaka et al. |
| 5,587,516 | A | 12/1996 | Tanaka et al. |
| 5,599,995 | A | 2/1997 | Tanaka et al. |
| 5,616,805 | A | 4/1997 | Tanaka et al. |
| 5,672,728 | A | 9/1997 | Tanaka et al. |
| 5,976,746 | A | 11/1999 | Tanaka et al. |
| 6,027,846 | A | 2/2000 | Shimada et al. |
| 6,132,914 | A | 10/2000 | Shimada |
| 6,172,176 | B1 | 1/2001 | Tanaka et al. |
| 6,180,303 | B1 | 1/2001 | Uematsu et al. |
| 6,316,577 | B1 | 11/2001 | Shimada et al. |
| 6,333,439 | B1 | 12/2001 | Shimada |
| 6,448,384 | B1 | 9/2002 | Shimada |
| 6,899,983 | B2 | 5/2005 | Tamoto et al. |
| 7,112,392 | B2 | 9/2006 | Shimada et al. |
| 7,175,957 | B2 | 2/2007 | Suzuki et al. |
| 7,179,573 | B2 | 2/2007 | Suzuki et al. |
| 7,251,437 | B2 | 7/2007 | Tamoto et al. |
| 2005/0069797 | A1 * | 3/2005 | Niimi et al. ..... 430/78 |
| 2005/0158641 | A1 | 7/2005 | Yanagawa et al. |
| 2005/0175911 | A1 | 8/2005 | Tamoto et al. |
| 2005/0266325 | A1 | 12/2005 | Yanagawa et al. |
| 2005/0266328 | A1 | 12/2005 | Yanagawa et al. |
| 2006/0093955 | A1 | 5/2006 | Ohshima et al. |
| 2006/0177749 | A1 | 8/2006 | Tamoto et al. |
| 2007/0009818 | A1 | 1/2007 | Yanagawa et al. |
| 2007/0031746 | A1 | 2/2007 | Toshine et al. |
| 2007/0054207 | A1 | 3/2007 | Kimura |
| 2007/0154825 | A1 | 7/2007 | Tamoto et al. |

FOREIGN PATENT DOCUMENTS

| | | |
|---|---|---|
| JP | 56-48637 | 5/1981 |
| JP | 4-281461 | 10/1992 |
| JP | 8-262779 | 10/1996 |
| JP | 2005-99688 | 4/2005 |
| JP | 2005-107401 | 4/2005 |
| JP | 2005-107490 | 4/2005 |
| JP | 2005-115322 | 4/2005 |

(Continued)

*Primary Examiner*—John L Goodrow
(74) *Attorney, Agent, or Firm*—Oblon, Spivak, McClelland, Maier & Neustadt, L.L.P.

(57) ABSTRACT

A method for preparing a photoreceptor including forming a photosensitive layer overlying an electroconductive substrate; coating a liquid including a radically polymerizable compound to form a protective layer; irradiating the protective layer with light to crosslink the protective layer; and then contacting the protective layer with a fluid, which is selected from the group consisting of supercritical fluids and subcritical fluids and which includes a charge transport material. A photoreceptor prepared by the method. An image forming method, an image forming apparatus and a process cartridge using the photoreceptor.

16 Claims, 5 Drawing Sheets

FOREIGN PATENT DOCUMENTS

| | | |
|---|---|---|
| JP | 2005-140825 | 6/2005 |
| JP | 2005-156784 | 6/2005 |
| JP | 2005-157026 | 6/2005 |
| JP | 2006-71856 | 3/2006 |
| JP | 2006-154796 | 6/2006 |
| JP | 2006-221152 | 8/2006 |
| JP | 2006-221157 | 8/2006 |

* cited by examiner

METHOD FOR PREPARING PHOTORECEPTOR, PHOTORECEPTOR PREPARED BY THE METHOD, AND IMAGE FORMING METHOD AND APPARATUS AND PROCESS CARTRIDGE USING THE PHOTORECEPTOR

BACKGROUND OF THE INVENTION

1. Field of the Invention

The present invention relates to a method for preparing an electrophotographic photoreceptor. In addition, the present invention also relates to a photoreceptor prepared by the method, and an image forming method, an image forming apparatus and a process cartridge using the photoreceptor.

2. Discussion of the Background

Recently, organic photoreceptors (OPCs) have been used for various image forming apparatuses such as copiers, printers, facsimiles and multi-functional apparatuses instead of inorganic photoreceptors because of having following advantages over inorganic photoreceptors.

(1) having good optical properties such that the photoreceptors have high photosensitivities over a broad wavelength range and can absorb a large amount of light;

(2) having good electric properties such as charging properties;

(3) having a wide material selectivity (i.e., various kinds of materials can be used for the photosensitive layer);

(4) having good productivity;

(5) having low costs; and (6) having little toxicity.

Recently, image forming apparatuses are required to have a small size and to produce images at a high speed without frequently performing a maintenance operation, and therefore a need exists for a small-size photoreceptor having a good durability. In general, organic photoreceptors are soft because of having an outermost layer including a low molecular weight charge transport material and an inactive polymer. Therefore, when image forming operations such as charging, developing, transferring and cleaning operations are repeatedly performed on such organic photoreceptors, the surface of the photoreceptors can be easily abraded due to the mechanical stresses applied thereto.

In addition, in order to produce high quality images, the particle size of the toners used for forming visual images in such image forming apparatus becomes smaller and smaller. In order to well clean the surface of the photoreceptors of the image forming apparatuses, which bear residual toner particles, a cleaning blade having a high hardness is contacted with the surface of the photoreceptors at a high pressure. Thereby, abrasion of the surface of the photoreceptors is accelerated.

Abrasion of the surface of the photoreceptors deteriorates the photosensitivity and charging properties of the photoreceptors, resulting in decrease of image density and formation of abnormal images such as background development. If local abrasion is caused (such as formation of scratches) to the photoreceptors, the photoreceptors produce streak images due to defective cleaning. When the photoreceptors are thus locally or entirely abraded, the photoreceptors have to be replaced with new photoreceptors, resulting in shortening of the photoreceptors.

Therefore, in order that a photoreceptor has good durability (i.e., stable electric properties), the outermost layer of the photoreceptor has to have a good abrasion resistance. In addition, in order that a photoreceptor has good cleanability and transferability, the photoreceptor has to have good surface properties. These are problems to be solved for photoreceptors.

In attempting to solve the abrasion problem, the following techniques have been disclosed.

(1) A crosslinked binder is used for the outermost layer of the photoreceptor (published unexamined Japanese patent application No. (hereinafter referred to as JP-A) 56-48637);

(2) A charge transport polymer is used for the photosensitive layer (JP-A 64-1728); and (3) An inorganic filler is dispersed in the outermost layer (JP-A 04-281461).

The photoreceptor (1) using a crosslinked binder for the outermost layer thereof has a drawback in that the residual potential (i.e., the potential of an irradiated portion of the photosensitive layer) is high due to poor compatibility of the crosslinked binder resin with the charge transport material, and impurities (such as polymerization initiators, and unreacted materials and groups) included therein, and thereby low density images are produced.

The photoreceptors (2) and (3) have a relatively improved abrasion resistance. However, the abrasion resistance is not so satisfactory as to satisfy the recently required durability. In addition, the photoreceptor (3) tends to have a relatively high residual potential due to carrier traps (in general, positive hole traps are formed in OPCs) present on the surface of the inorganic filler, and thereby there is a possibility that low density images are produced.

Thus, the photoreceptors (1), (2) and (3) do not have the recently required durability (i.e., good combination of electric durability and mechanical durability).

In attempting to improve the abrasion resistance and scratch resistance of the photoreceptor (1), Japanese patent No. 3262488 (i.e., JP-A 08-262779) discloses a photoreceptor having a protective layer prepared by using a multifunctional crosslinking acrylate monomer. Although it is described therein that a charge transport material can be included in the protective layer, there is no detailed description of the charge transport material. As a result of the present inventors' study, it is found that when a low molecular weight charge transport material is included in the protective layer, the photoreceptor causes a problem in that such a low molecular weight charge transport material has poor compatibility with a crosslinked acrylate, thereby causing separation of the charge transport material from the crosslinked acrylate and formation of cracks in the protective layer. Therefore, the resultant protective layer has poor mechanical strength. It is described therein that a polycarbonate resin is included in the protective layer to improve the compatibility of a charge transport material. In this case, the content of the crosslinked acrylate is decreased, and therefore the resultant photoreceptor cannot have the desired abrasion resistance. In addition, it is described therein when no charge transport material is included in the outermost layer, the outermost layer has to be thin to decrease the residual potential (i.e., the potential of a lighted portion of the photosensitive layer). In this case, the resultant photoreceptor has unsatisfactory durability (i.e., the photoreceptor has a short life). Further, the potential of the charged photoreceptor and the potential of an irradiated portion thereof largely change depending on the environmental conditions such as temperature and humidity. Therefore, it is impossible to stably produce high quality images.

Japanese patent No. 3194392 (i.e., JP-A 05-216249) proposes another technique for improving abrasion resistance of a photosensitive layer such that a charge transport layer is formed using a coating liquid including a combination of a monomer having a carbon-carbon double bond (C=C), a binder resin, and a charge transport material having a carbon-carbon double bond, which is to be reacted with the monomer upon application of heat or light energy or a combination of a binder resin having a carbon-carbon double bond and a charge transport material having a carbon-carbon double bond, which is to be reacted with the binder resin. The photoreceptor has a good combination of abrasion resistance and electric properties. However, the monomers described therein are difunctional, and therefore the crosslinking density is relatively low. Therefore, the abrasion resistance of the photoreceptor is not so satisfactory as to satisfy the recently required durability. The same is true for the latter case where a reactive binder resin having a carbon-carbon double bond is used.

JP-A 2000-66425 proposes a photoreceptor having a photosensitive layer including a compound prepared by crosslinking a positive hole charge transport material having two or more chain-polymerizable functional groups in a molecule. However, the crosslinked positive hole charge transport material is bulky because of having two or more chain-polymerizable functional groups and therefore the photosensitive layer tends to be strained, resulting in increase of internal stress. Therefore, the photoreceptor tends to cause problems in that the surface of the photosensitive layer is roughened and/or cracks are formed in the photosensitive layer. Namely, the photoreceptor has unsatisfactory durability. In addition, since the photosensitive layer is greatly strained, the photosensitive layer has a low film density. Therefore, the photoreceptor has unsatisfactory abrasion resistance, and unsatisfactory resistance to oxidizing gases and moisture in the air, resulting in formation of abnormal images (such as ghost images). Namely, the photoreceptor cannot produce high quality images over a long period of time.

Other crosslinked charge transport layers prepared by crosslinking a radically polymerizable monomer, which has three or more functional groups and no charge transport structure, and a monofunctional radically polymerizable monomer, which has a charge transport structure, have been proposed in JP-As 2004-302450, 2004-302451, 2004-302452, 2005-099688, 2005-107401, 2005-107490, 2005-115322, 2005-140825, 2005-156784, 2005-157026, 2005-157297, 2005-189821, 2005-189828 and 20056-71856. It is attempted to impart a good combination of mechanical durability and electric durability to the photosensitive layer while preventing formation of cracks therein by using a monofunctional radically polymerizable monomer. However, depending on the preparation conditions, there is a case where the resultant charge transport layer has a low film density and does not have a satisfactory resistance to oxidizing gases and moisture. In this case, abnormal images (such as ghost images) tend to be formed. In addition, depending on the preparation conditions, there is a case where the charge transport structure of the monofunctional radically polymerizable monomer is damaged by light applied thereto to crosslink the monomers, resulting in deterioration of the charge transport function (i.e., deterioration of image qualities).

Because of these reasons, a need exists for a photoreceptor which can maintain a good combination of electric properties and mechanical durability and which can produce high quality images over a long period of time.

SUMMARY OF THE INVENTION

As an aspect of the present invention, a method for preparing a photoreceptor is provided which includes:

forming a photosensitive layer overlying an electroconductive substrate;

coating a liquid including a radically polymerizable compound to form a protective layer (i.e., an outermost layer);

irradiating the protective layer with light to crosslink the protective layer; and contacting the protective layer with at least one of a supercritical fluid and a subcritical fluid, which includes a charge transport material to inject the charge transport material into at least the protective layer.

In this regard, "overlying" can include direct contact and allow for intermediate layers.

As another aspect of the present invention, a photoreceptor is provided, which includes an electroconductive substrate, a photosensitive layer located overlying the electroconductive substrate, and a crosslinked protective layer located overlying the photosensitive layer, wherein the photoreceptor is prepared by the method mentioned above.

As yet another aspect of the present invention, an image forming method is provided which includes:

charging the photoreceptor mentioned above;

irradiating the photoreceptor with light to form an electrostatic latent image thereon;

developing the electrostatic latent image with a developer including a toner to form a toner image thereon;

transferring the toner image onto a receiving material; and cleaning a surface of the photoreceptor after the toner image is transferred.

As a further aspect of the present invention, an image forming apparatus is provided which includes:

the photoreceptor mentioned above;

a charging device configured to charge the photoreceptor;

a latent image forming device (such as light irradiating devices) configured to form an electrostatic latent image on the photoreceptor;

a developing device configured to develop the electrostatic latent image with a developer including a toner to form a toner image thereon;

a transferring device configured to transfer the toner image onto a receiving material; and a cleaning device configured to clean a surface of the photoreceptor after the toner image is transferred.

As a still further aspect of the present invention, a process cartridge is provided which includes:

the photoreceptor mentioned above; and at least one of a charging device configured to charge the photoreceptor; a latent image forming device configured to form an electrostatic latent image on the photoreceptor; a developing device configured to develop the electrostatic latent image with a developer including a toner to form a toner image thereon; a transferring device configured to transfer the toner image onto a receiving material; and a cleaning device configured to clean a surface of the photoreceptor after the toner image is transferred, wherein the process cartridge is detachably attachable to an image forming apparatus as a unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
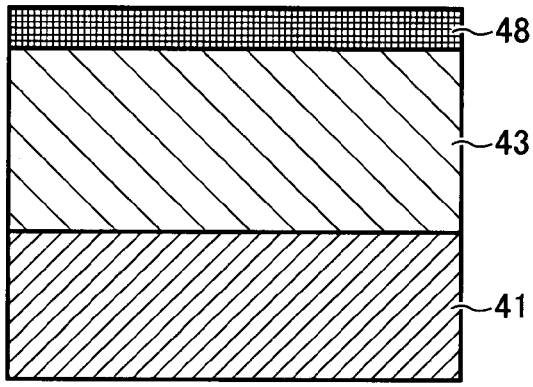
FIGS. 1 to 3 are schematic views illustrating cross-sections of examples of the photoreceptor of the present invention.

The present inventors have investigated to prepare a photoreceptor which can maintain a good combination of electric properties and mechanical durability and which can produce high quality images over a long period of time. As a result, it is found that such a photoreceptor can be prepared by a method including:

forming a photosensitive layer overlying an electroconductive substrate;

coating a liquid including a radically polymerizable compound to form a protective layer;

irradiating the protective layer with light to crosslink the protective layer; and contacting the protective layer with a supercritical fluid and/or a subcritical fluid, which includes a charge transport material.

Specifically, by contacting the protective layer with a supercritical fluid and/or a subcritical fluid, the charge transport material can be injected into the well-developed crosslinked protective layer. Therefore, a dense layer having a high crosslinking density can be formed as the protective layer, and thereby the photoreceptor has a good mechanical durability.

In general, charge transport materials have a large light absorption constant in a wavelength range of light used for crosslinking the charge transport materials. Therefore, the light deteriorates crosslinking of the radically polymerizable compound when they are mixed. By using the method of the present invention, occurrence of this problem can be prevented. In addition, since the photoreceptor does not receive high-energy light in the manufacturing process thereof, the charge transport structure is hardly damaged, and therefore the photoreceptor can maintain a good combination of electric properties and mechanical durability over a long period of time.

Next, supercritical fluids and subcritical fluids will be explained.

Supercritical fluids are defined as materials which are present as a noncondensable high density fluid under temperature/pressure conditions higher than a critical point below which the materials can have both a gas state and a liquid state at the same time, i.e., materials which are present as a fluid under a condition in which the temperature is not lower than the critical temperature thereof and the pressure is not lower than the critical pressure, wherein the fluid cannot be condensed even when further compressed. Supercritical fluids have an advantage so as to have a dissolving power much greater than that of the fluids (materials) under normal conditions (room temperature and normal pressure). The reason therefor is considered to be that since the fluids are present under high pressure conditions, the fluids have a large kinetic energy and a low viscosity. In addition, supercritical fluids have another advantage such that by adjusting the density of a supercritical fluid by changing the temperature and pressure, the dissolving power of the supercritical fluid can be adjusted. Therefore, supercritical fluids can be used for various applications.

In general, supercritical fluids having a density of not less than 0.2 g/cm$^2$ are typically used for dissolving chemical materials. Since supercritical fluids have a large kinetic energy and a low viscosity, the supercritical fluids can rapidly diffuse into materials. Therefore, supercritical fluids can easily diffuse into porous materials, into which general solvents hardly diffuse. In addition, supercritical fluids have greater heat conductivity than general liquids, and therefore the heat caused by a chemical reaction occurring in the supercritical fluids can be rapidly radiated therefrom.

Any known supercritical fluids can be used in the present invention as long as the fluids are a material which is present as a noncondensable high density fluid under temperature/pressure conditions higher than a critical point below which the materials can have both a gas state and a liquid state at the same time, i.e., materials which are present as a fluid under a condition in which the temperature is not lower than the critical temperature thereof and the pressure is not lower than the critical pressure, wherein the fluid is not condensed even when further compressed. In addition, the critical temperature and the critical pressure are not also particularly limited. Specific examples of the materials for use as the supercritical fluid in the present invention include carbon monoxide, carbon dioxide, ammonia, nitrogen, water, methanol, ethanol, ethane, propane, 2,3-dimethylbutane, benzene, chlorotrifluoromethane, dimethyl ether, etc. These materials can be used alone or in combination.

The critical temperature of the materials used for the supercritical fluid is preferably from −267.9 to 300° C., and more preferably from 0 to 140° C. When the material to be contacted with a supercritical fluid has a property of easily changing its quality at a high temperature, materials having a low critical temperature such as carbon dioxide (critical temperature of 31.0° C.), ethane (critical temperature of 32.2° C.), propane (critical temperature of 96.6° C.) and ammonia (critical temperature of 132.3° C.) are preferably used for the supercritical fluid.

Subcritical fluids are defined as materials which have a property different from those of gases and liquids thereof under temperature/pressure conditions such that one or both of the temperature and pressure are lower than the critical temperature and critical pressure thereof, respectively. Specifically, subcritical fluids are fluids which are in a state such that the temperature thereof is 0 to about 30° C. (which changes depending on the materials) lower than the critical temperature thereof and/or the pressure is 0 to about 5 MPa (which changes depending on the materials) lower than the critical pressure thereof. Any materials having such a property can be used as the subcritical fluid in the present invention. The materials mentioned above for use as the supercritical fluid can also be used alone or in combination as the subcritical fluid.

Since organic materials are mainly used for electrophotographic photoreceptor of the present invention, carbon dioxide is preferably used as a main component of the supercritical or subcritical fluid. This is because carbon dioxide has a relatively low supercritical pressure of 7.3 MPa and a supercritical temperature of 31.0° C., which is close to room temperature, and therefore a supercritical state can be easily created. In addition, carbon dioxide has other advantages of being inflammable and nontoxic. Therefore, supercritical or subcritical fluids of carbon dioxide can be used for the food industry.

In order to control the solubility of the organic materials to a supercritical or subcritical fluid, one or more organic solvents can be added thereto as an entrainer. In general, solvents having good affinity for the organic materials used for the photoreceptor are preferably used. Specific examples of the materials used as the entrainer include methanol, ethanol, acetone, ethyl acetate, propanol, ammonia, melamine, urea, thioethylene glycol, carbon monoxide, nitrogen, water, ethane and propane, but are not limited thereto.

The electrophotographic photoreceptor of the present invention includes an electroconductive substrate, a photosensitive layer located overlying the electroconductive substrate, and a protective layer serving as an outermost layer located overlying the photosensitive layer. The protective layer is preferably prepared by photo-crosslinking a radically polymerizable compound. The thus crosslinked protective layer is then contacted with a supercritical fluid and/or a subcritical fluid (hereinafter referred to as a treatment fluid) including a charge transport material (hereinafter referred to as a CTM) to inject the CTM into the protective layer.

Specifically, a treatment fluid including a CTM is fed into a high pressure cell, in which a photoreceptor to be treated is fixed, to contact the treatment fluid with the photoreceptor. In this treatment, the treatment fluid enters into the protective layer, thereby plasticizing the protective layer (i.e., decreasing the viscosity of the protective layer). Therefore, the CTM included in the treatment fluid is injected into the protective layer. The thus injected CTM can rapidly diffuse into the entire protective layer (i.e., from the surface to the bottom of the protective layer) because the viscosity of the protective layer is decreased.

In this regard, the manner of contact of the treatment fluid with the photoreceptor is not particularly limited, and any contact methods are available as long as both are physically contacted with each other. For example, a contact method such that after a predetermined amount of treatment fluid is fed into the cell containing a photoreceptor, the cell is sealed to contact the fluid with the photoreceptor for a predetermined period of time and then the fluid is removed from the cell can be used. Alternatively, another contact method such that a treatment fluid is continuously fed into a cell containing a photoreceptor while discharging the treatment fluid therefrom, and then the photoreceptor is removed from the cell after treated for a predetermined period of time can also be used.

In the first-mentioned contact method, only the CTM included in the treatment fluid contained in the cell is used, and therefore the concentration gradient of the CTM between the treatment fluid and the protective layer decreases as the CTM is injected into the protective layer. In addition, the injection speed of the CTM decreases as the concentration gradient decreases. Namely, the method has a drawback in that the injection speed of the CTM is relatively slow, but has an advantage in that the manufacturing facilities are simple and low-cost, and therefore the photoreceptor can be manufactured at low costs.

In contrast, the second-mentioned contact method has an advantage in that the treatment fluid including the CTM at a predetermined concentration is continuously supplied to the photoreceptor, i.e., the concentration gradient is larger than that of the first contact method, and therefore a desired amount of CTM can be rapidly injected into the protective layer. However, the second contact method has a drawback in that it is necessary to provide a circulation system including a step-up pressuring device which is provided at the entrance of the cell to pressurize the fluid at two to four steps, a heat radiator provided at the enter of the cell, and a step-down depressing device which is provided at the exit of the cell to depressurize the fluid at plural steps. In addition, it is necessary to provide a CTM concentration controlling device which controls the concentration of the CTM in the treatment fluid. Therefore, the method needs a large scale manufacturing device.

Therefore, it is preferable to select a proper contact method while considering the advantages and drawbacks of the methods.

The content of a CTM in the treatment liquid is preferably not less than 0.5 g/l, and more preferably not less than 1 g/l. When the content is too low, the injection speed of the CTM is too low, and therefore it takes a long time to prepare a desired photoreceptor.

The contact time during which the photoreceptor is contacted with the treatment fluid is preferably determined on the basis of the injection speed of the CTM used and the thickness of the protective layer.

In addition, additives such as leveling agents and antioxidants can be added to the treatment fluid as well as organic solvents serving as entrainers. In this case, not only the CTM but also the additives can be injected into the protective layer. Further, if it is clear that a material included in the protective layer is removed from the layer by the treatment, the material can be previously added to the treatment fluid in order to prevent decrease of content of the material in the protective layer (i.e., to compensate loss of the material).

As mentioned below, the protective layer of the photoreceptor of the present invention tends to change its quality and/or decompose when heated. Therefore, the treatment temperature at which the treatment fluid is contacted with the photoreceptor is preferably from 30 to 140° C., and more preferably from 30 to 100° C. When the treatment temperature is too low, the solubility of the CTM in the treatment fluid and the diffusing speed of the treatment fluid are low, and therefore it is difficult to inject the CTM into the protective layer. In contrast, when the treatment temperature is too high, problems in that the protective layer changes its quality or is decomposed; and one or more compounds included in a layer of the photoreceptor (functionally-separated photoreceptor) migrates into the adjacent layer occur.

In order to effectively inject a CTM into the protective layer of the photoreceptor, the treatment temperature is preferably not lower than 5° C. higher than the softening point of the CTM included in the treatment fluid. In this case, the CTM is melted in the treatment fluid, and therefore the concentration of the CTM in the treatment fluid is uniformed. Therefore, the CTM can be easily injected into the crosslinked protective layer, which has a decreased viscosity due to contact with the treatment fluid.

Even when the concentration of the CTM in the treatment fluid is greater than the saturation concentration of the CTM, the undissolved portion of the CTM (which is not dissolved in the fluid) is uniformly dispersed in the treatment fluid. When the CTM is injected into the protective layer and thereby the concentration of the CTM in the treatment fluid is decreased so as to be lower than the saturation concentration, the dispersed CTM is rapidly dissolved in the treatment fluid. Therefore, the concentration of the CTM can be controlled at the saturation concentration.

Next, the electrophotographic photoreceptor of the present invention will be explained by reference to drawings.

Figure 2:
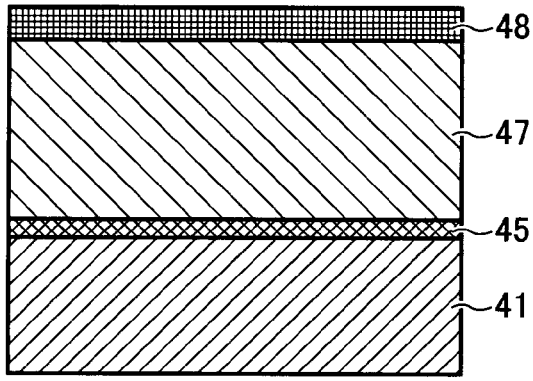
Figure 3:
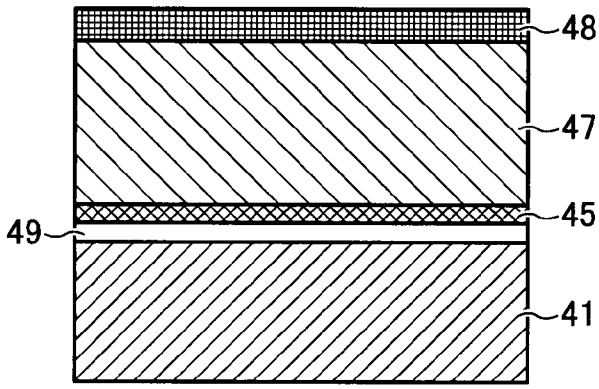

FIGS. 1-3 are schematic views illustrating the cross sections of examples of the photoreceptor of the present invention.

Referring to FIG. 1, the example photoreceptor includes an electroconductive substrate 41, and a photosensitive layer 43 and a protective layer 48, which are overlaid on the electroconductive substrate 41 in this order.

Referring to FIG. 2, the example photoreceptor includes a charge generation layer (hereinafter referred to as a CGL) 45 and a charge transport layer (hereinafter referred to as a CTL) 47, which serve as a photosensitive layer and which are sandwiched by the electroconductive substrate 41 and the protective layer 48.

The example photoreceptor illustrated in FIG. 3 is the same as the photoreceptor illustrated in FIG. 2 except that an intermediate layer 49 is located between the electroconductive substrate 41 and the CGL 45.

Next, the electroconductive substrate 41 will be explained. Suitable materials for use as the substrate 41 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 41, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like, which are disclosed in JP-A 52-36016, can also be used as the substrate 41.

Furthermore, substrates, which are prepared by coating a coating liquid including a binder resin and an electroconductive powder on the supports mentioned above, can also be used as the substrate. Specific examples of the electroconductive powder include carbon black, acetylene black, powders of metals such as aluminum, nickel, iron, nichrome, copper, zinc, silver and the like, and metal oxides such as electroconductive tin oxides, ITO (indium tin oxide) and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON™), with an electroconductive material (such as the above-mentioned electroconductive powders), can also be used as the substrate 41.

Among these materials, cylinders made of aluminum or an aluminum alloy are preferable because aluminum can be easily anodized. Suitable aluminum materials for use as the substrate include aluminum and aluminum alloys such as JIS 1000 series, 3000 series and 6000 series of aluminum and aluminum alloys.

Anodic oxide films can be formed by anodizing metals or metal alloys in an electrolyte solution. Among the anodic oxide films, alumite films which can be prepared by anodizing aluminum or an aluminum alloy are preferably used for the photoreceptor of the present invention. This is because the resultant photoreceptor hardly produces undesired images such as black spots and background fouling when used for reverse development methods (i.e., nega-posi development methods).

The anodizing treatment is performed in an acidic solution including an acid such as chromic acid, sulfuric acid, oxalic acid, phosphoric acid, boric acid, and sulfamic acid. Among these acids, sulfuric acid is preferably used for the anodizing treatment in the present invention. It is preferable to perform the anodizing treatment on a substrate under the following conditions:

(1) concentration of sulfuric acid: 10 to 20%

(2) temperature of treatment liquid: 5 to 25° C.

(3) current density: 1 to 4 A/dm$^2$ (4) electrolyzation voltage: 5 to 30 V (5) treatment time: 5 to 60 minutes.

However, the treatment conditions are not limited thereto.

The thus prepared anodic oxide film is porous and highly insulative. Therefore, the surface of the substrate is very unstable, and the physical properties of the anodic oxide film change with time. In order to avoid such a problem, the anodic oxide film is preferably subjected to a sealing treatment. The sealing treatment can be performed by, for example, the following methods:

(1) the anodic oxide film is dipped in an aqueous solution of nickel fluoride or nickel acetate;

(2) the anodic oxide film is dipped in a boiling water; and (3) the anodic oxide film is subjected to steam sealing.

After the sealing treatment, the anodic oxide film is subjected to a washing treatment to remove foreign materials such as metal salts adhered to the surface of the anodic oxide film during the sealing treatment. Such foreign materials present on the surface of the substrate not only affect the coating quality of a layer formed thereon but also produce images having background fouling because of typically having a low electric resistance. The washing treatment is performed by washing the substrate having an anodic oxide film thereon with pure water one or more times. It is preferable that the washing treatment is performed until the waste water is as clean (i.e., deinonized) as possible. In addition, it is also preferable to rub the substrate with a washing member such as brushes in the washing treatment.

The thickness of the thus prepared anodic oxide film is preferably from 5 to 15 μm. When the anodic oxide film is too thin, the barrier effect thereof is not satisfactory. In contrast, when the anodic oxide film is too thick, the time constant of the electrode (i.e., the substrate) excessively increase, resulting in increase of residual potential of the resultant photoreceptor and deterioration of response thereof.

The photoreceptor of the present invention can include an intermediate layer between the electroconductive substrate 41 and the CGL 45 (or the photosensitive layer 43). The intermediate layer 49 includes a resin as a main component. Since a CGL is formed on the intermediate layer typically by coating a liquid including an organic solvent, the resin in the intermediate layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkydmelamine resins, epoxy resins and the like.

The intermediate layer may include a fine powder of a metal oxide such as titanium oxide, silica, alumina, zirconium oxide, tin oxide and indium oxide to prevent occurrence of moiré in the resultant images and to decrease residual potential of the resultant photoreceptor.

The intermediate layer can be formed by coating a coating liquid using a proper solvent and a proper coating method.

The intermediate layer may be formed using a silane coupling agent, titanium coupling agent or a chromium coupling agent. In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the intermediate layer. In addition, the intermediate layer can also be formed by any known methods. The thickness of the intermediate layer is preferably 0 to 5 μm.

The intermediate layer 49 has both a function of preventing the charges, which are induced at the electroconductive substrate side of the layer in the charging process, from being injected into the photosensitive layer, and a function of preventing occurrence of moiré fringe caused by using coherent light (such as laser light) as image writing light. In the present invention it is preferable to use a functionally separated intermediate layer (i.e., a combination of a charge blocking layer and a moiré preventing layer).

Next, the functionally separated intermediate layer will be explained.

The function of the charge blocking layer is to prevent the charges, which are induced in the electrode (i.e., the electroconductive substrate 41) and have a polarity opposite to that of the voltage applied to the photoreceptor by a charger, from being injected to the photosensitive layer. Specifically, when negative charging is performed, the charge blocking layer prevents injection of positive holes to the photosensitive layer. In contrast, when positive charging is performed, the charge blocking layer prevents injection of electrons to the photosensitive layer. Specific examples of the charge blocking layer include the following:

(1) a layer prepared by anodic oxidation such as aluminum oxide layer;

(2) an insulating layer of an inorganic material such as SiO;

(3) a layer made of a network of a glassy metal oxide;

(4) a layer made of polyphosphazene;

(5) a layer made of a reaction product of aminosilane;

(6) a layer made of an insulating resin; and (7) a crosslinked resin layer.

Among these layers, an insulating resin layer and a crosslinked resin layer, which can be formed by a wet coating method, are preferably used. Since the moiré preventing layer and the photosensitive layer are typically formed on the charge blocking layer by a wet coating method, the charge blocking layer preferably has good resistance to the solvents included in the coating liquids of the moiré preventing layer and the photosensitive layer.

Suitable resins for use in the charge blocking layer include thermoplastic resins such as polyamide resins, polyester resins, and vinyl chloride/vinyl acetate copolymers; and thermosetting resins which can be prepared by thermally polymerizing a compound having a plurality of active hydrogen atoms (such as hydrogen atoms of —OH, —$NH_2$, and —NH) with a compound having a plurality of isocyanate groups and/or a compound having a plurality of epoxy groups.

Specific examples of the compounds having a plurality of active hydrogen atoms include polyvinyl butyral, phenoxy resins, phenolic resins, polyamide resins, phenolic resins, polyamide resins, polyester resins, polyethylene glycol resins, polypropylene glycol resins, polybutylene glycol resins, and acrylic resins (such as hydroxyethyl methacrylate resins). Specific examples of the compounds having a plurality of isocyanate groups include tolylene diisocyanate, hexamethylene diisocyanate, diphenylmethane diisocyanate, and prepolymers of these compounds. Specific examples of the compounds having a plurality of epoxy groups include bisphenol-A-based epoxy resins, etc.

Among these resins, polyamide resins are preferably used in view of film formability, environmental stability and resistance to solvents. Among the polyamide resins, N-methoxymethylated nylons are preferably used. Polyamide resins have the following advantages:

(1) having a good charge injection preventing ability;

(2) hardly increasing residual potential;

(3) being soluble in alcohol solvents and insoluble in ketone solvents; and (4) having a good coating property such that a thin uniform layer is formed by a dip coating method.

In order to minimize increase of residual potential (which results in formation of high quality images), the charge blocking layer is preferably a thin uniform layer. Therefore, polyamide resins can be preferably used for the charge blocking layer.

In general, alcohol-soluble resins have high humidity dependence. Specifically, alcohol-soluble resins have a high electric resistance under low humidity conditions. In this case, photoreceptors having an intermediate layer including a polyamide resin tend to have a high residual potential. In contrast, under high humidity conditions, alcohol-soluble resins have a low electric resistance, and thereby the potential of the resultant photoreceptors is decreased. However, methoxymethylated nylons have a high insulating property, and thereby charges injected from an electroconductive substrate can be well blocked. In addition, methoxymethylated nylons hardly increase residual potential, and have an improved environmental stability. Therefore, photoreceptors having an intermediate layer including a methoxymethylated nylon can stably produce high quality images even when environmental conditions change. Further, even when the thickness of an intermediate layer including a methoxymethylated nylon is changed, residual potential of the resultant photoreceptor is hardly increased. Therefore, occurrence of a background development problem in that background of images is soiled with toner particles due to increase of residual potential can be prevented.

Methoxymethylated nylons having a methoxymethyl group in an amount of from 15 to 45% by mole (i.e., the methoxymethyl substitution ratio is from 15 to 45% by mole) are preferably used for the intermediate layer. The above-mentioned effects of methoxymethylate nylons depend on the methoxymethyl substitution ratio. When methoxymethylate nylons have too high a methoxymethyl substitution ratio, the methoxymethylate nylons have a large humidity dependence. In contrast, when methoxymethylate nylons have too low a methoxymethyl substitution ratio, the methoxymethylate nylons have a low solubility to alcohol solvents and therefore the resultant alcohol solution of a methoxymethylate nylon become opaque because part of the methoxymethylate nylon is solidified. In this case, the stability of the coating liquid including the alcohol solution of the methoxymethylate nylon deteriorates.

In addition, oil-free alkyd resins; amino resins such as thermosetting amino resins prepared by thermally polymerizing a butylated melamine resin; and photo-crosslinking resins prepared by reacting an unsaturated resin, such as unsaturated polyurethane resins unsaturated polyester resins, with a photo-polymerization initiator such as thioxanthone compounds and methylbenzyl formate, can also be used for the charge blocking layer.

In addition, electroconductive polymers having a rectification property, and layers including a resin or a compound having an electron accepting or donating property which is determined depending on the polarity of the charges formed on the surface of the photoreceptor can also be used for the charge blocking layer to prevent injection of charges from a substrate and to impart a PN junction function to the resultant layer.

The charge blocking layer preferably has a thickness not less than 0.1 μm and less than 2.0 μm, and more preferably from 0.3 μm to 2.0 μm. When the charge blocking layer is too thick, residual potential of the resultant photoreceptor increases after imagewise light irradiation is repeatedly performed particularly under low temperature and low humidity conditions. In contrast, the charge blocking layer is too thin, the charge blocking effect is hardly produced. The charge blocking layer can include one or more materials such as crosslinking agents, solvents, additives and crosslinking promoters. The charge blocking layer can be prepared by coating a coating liquid by a coating method such as blade coating, dip coating, spray coating, bead coating and nozzle coating, followed by drying and crosslinking using heat or light.

Next, the moiré preventing layer will be explained.

The function of the moiré preventing layer is to prevent occurrence of moiré fringe in the resultant images due to interference of light, which is caused when coherent light (such as laser light) is used for optical writing. Namely, the moiré preventing layer scatters the light used for optical writing. In order to carry out this function, the layer preferably includes a material having a high refractive index. The moiré preventing layer typically includes a binder resin and an inorganic pigment. Suitable inorganic pigments include white inorganic pigments. Specific examples of the white inorganic pigments include titanium oxide, calcium fluoride, calcium oxide, silica, magnesium oxide and aluminum oxide. Among these pigments, titanium oxide is preferably used because of having high hiding power.

Since the injection of charges from the substrate 41 is blocked by the charge blocking layer, the moiré preventing layer preferably has an ability to transport charges having the same polarity as that of the charges formed on the surface of the photoreceptor, to prevent increase of residual potential. For example, in a negative charge type photoreceptor, the moiré preventing layer 45 preferably has an electron conducting ability. Therefore it is preferable to use an electroconductive inorganic pigment or a conductive inorganic pigment for the moiré preventing layer. Alternatively, an electroconductive material (such as acceptors) may be added to the moiré preventing layer.

Specific examples of the binder resin for use in the moiré preventing layer include the resins mentioned above for use in the charge blocking layer. Since the photosensitive layer 43 (CGL 45 and CTL 47) is formed on the moiré preventing layer by coating a coating liquid, the binder resin preferably has a good resistance to the solvent included in the photosensitive layer coating liquid. Among the resins, thermosetting resins, and more preferably mixtures of alkyd and melamine resins, are preferably used as the binder resin of the moiré preventing layer. The mixing ratio of an alkyd resin to a melamine resin is an important factor influencing the structure and properties of the moiré preventing layer, and the weight ratio thereof is preferably from 5/5 to 8/2. When the content of the melamine resin is too high, the coated film is shrunk in the thermosetting process, and thereby coating defects are formed in the resultant film. In addition, the residual potential increasing problem occurs. In contrast, when the content of the alkyd resin is too high, the electric resistance of the layer seriously decreases, and thereby the resultant images have background fouling, although residual potential of the photoreceptor is reduced.

The mixing ratio of the inorganic pigment to the binder resin in the moiré preventing layer is also an important factor, and the volume ratio thereof is preferably from 1/1 to 3/1. When the ratio is too low (i.e., the content of the inorganic pigment is too low), not only the moiré preventing effect deteriorates but also residual potential increases after repeated use. In contrast, when the ratio is too high, the film formability of the layer deteriorates, resulting in deterioration of surface conditions of the resultant layer. In addition, a problem in that the upper layer (e.g., the photosensitive layer) cannot form a good film thereon because the coating liquid penetrates into the moiré preventing layer occurs. This problem is fatal to the photoreceptor having a layered photosensitive layer including a thin charge generation layer as a lower layer because such a thin CGL cannot be formed on such a moiré preventing layer. In addition, when the ratio is too large, a problem in that the surface of the inorganic pigment cannot be covered with the binder resin. In this case, the charge generation material (hereinafter referred to as a CGM) is directly contacted with the inorganic pigment and thereby the possibility of occurrence of a problem in that carriers are thermally produced increases, resulting in occurrence of the background development problem.

By using two kinds of titanium oxides having different average particle diameters for the moiré preventing layer, the substrate 41 is effectively hidden by the moiré preventing layer and thereby occurrence of moiré fringes can be well prevented and formation of pinholes in the layer can also be prevented. In this regard, the average particle diameters (D1 and D2) of the two kinds of titanium oxides preferably satisfy the following relationship:

$$0.2<D2/D1\leqq 0.5.$$

When the ratio D2/D1 is too low, the surface of the titanium oxide becomes more active, and thereby stability of the electrostatic properties of the resultant photoreceptor is seriously deteriorated. In contrast, when the ratio is too high, the electroconductive substrate 41 cannot be well hidden by the moiré preventing layer and thereby the moiré preventing effect is deteriorated and abnormal images such as moiré fringes are produced. In this regard, the average particle diameter of the pigment means the average particle diameter of the pigment in a dispersion prepared by dispersing the pigment in water while applying a strong shear force thereto.

Further, the average particle diameter (D2) of the titanium oxide (T2) having a smaller average particle diameter is also an important factor, and is preferably greater than 0.05 μm and less than 0.20 μm. When D2 is too small, hiding power of the layer deteriorates. Therefore, moiré fringes tend to be caused. In contrast, when D2 is too large, the filling factor of the titanium oxide in the layer is small, and thereby background development preventing effect cannot be well produced.

The mixing ratio of the two kinds of titanium oxides in the moiré preventing layer is also an important factor, and is preferably determined such that the following relationship is satisfied:

$$0.2\leqq T2/(T1+T2)\leqq 0.8,$$

wherein T1 represents the weight of the titanium oxide having a larger average particle diameter, and T2 represents the weight of the titanium oxide having a smaller average particle diameter.

When the mixing ratio is too low, the filling factor of the titanium oxide in the layer is small, and thereby background development preventing effect cannot be well produced. In contrast, when the mixing ratio is too high, the hiding power of the layer deteriorates, and thereby the moiré preventing effect cannot be well produced.

The moiré preventing layer preferably has a thickness of from 1 to 10 μm, and more preferably from 2 to 5 μm. When the layer is too thin, the moiré preventing effect cannot be well produced. In contrast, when the layer is too thick, the residual potential increases after repeated use.

The moiré preventing layer is typically prepared as follows. An inorganic pigment is dispersed in a solvent together with a binder resin using a dispersion machine such as ball mills, sand mills, and attritors. In this case, crosslinking agents, other solvents, additives, crosslinking promoters, etc., can be added thereto if desired. The thus prepared coating liquid is coated on the charge blocking layer by a method such as blade coating, dip coating, spray coating, bead coating and nozzle coating, followed by drying and crosslinking using light or heat.

Next, the photosensitive layer will be explained. The photosensitive layer of the photoreceptor of the present invention may be a single-layered photosensitive layer, which is illustrated in FIG. 1 and includes a charge generation material (CGM) and a charge transport material (hereinafter referred to as a CTM). However, a layered photosensitive layer which is illustrated in FIGS. 2 and 3 and includes a charge generation layer (CGL) and a charge transport layer (CTL) is preferable because of having a good combination of photosensitivity and durability. For explanation purpose, the layered photosensitive layer will be explained at first.

The layered photosensitive layer includes a CGL 45 including a CGM as a main component.

Any known CGMs can be used for the CGL. Among these CGMs, titanyl phthalocyanine compounds having an X-ray diffraction spectrum such that a maximum peak is observed at a Bragg (2 θ) angle (±0.2°) of 27.2° when a Cu—Kα X-ray having a wavelength of 1.542 Å is used are preferably used. In particular, titanyl phthalocyanine crystals having an X-ray diffraction spectrum such that a maximum peak is observed at a Bragg (2 θ) angle of 27.2±0.2°, a lowest angle peak at an angle of 7.3±0.2°, and a main peak at each of Bragg (2 θ) angles (±0.2°) of 9.4°, 9.6°, and 24.0°, wherein no peak is observed between the peaks of 7.3° and 9.4° and at an angle of 26.3 (±0.2°) (described in JP-A 2001-19871) are more preferably used. Further, titanyl phthalocyanine crystals, which have been disclosed in JP-As 2004-83859 and 2004-78141 and which have the above-mentioned crystal form (i.e., the X-ray diffraction spectrum) and an average particle diameter of not greater than 0.25 μm by controlling the synthesizing operation or performing dispersing and filtering operations are even more preferably used.

The CGL is typically prepared by a method including dispersing a CGM in a proper solvent optionally together with a binder resin using a dispersing machine such as ball mills, attritors, sand mills and ultrasonic dispersing machines to prepare a CGL coating liquid; coating the coating liquid on the electroconductive substrate or the intermediate layer; then drying the coated liquid.

Specific examples of the binder resins, which are optionally included in the CGL coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in the CGL is preferably from 0 to 500 parts by weight, and preferably from 10 to 300 parts by weight, per 100 parts by weight of the CGM included in the CGL.

Specific examples of the solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc.

Specific examples of the coating methods for use in coating the CGL coating liquid include dip coating methods, spray coating methods, bead coating methods, nozzle coating methods, spinner coating methods, ring coating methods, etc.

The CGL 45 preferably has a thickness of from 0.01 to 5 μm, and more preferably from 0.1 to 2 μm.

Next, the CTL 47 will be explained.

The CTL is typically prepared by coating a coating liquid, which is prepared by dissolving or dispersing a charge transport material in a solvent optionally together with a binder resin, followed by drying. If desired, additives such as plasticizers, leveling agents and antioxidants can be added to the coating liquid.

Charge transport materials (CTMs) are classified into positive-hole transport materials and electron transport materials.

Specific examples of the positive-hole transport materials include known materials such as poly-N-vinyl carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives, etc.

These CTMs can be used alone or in combination.

Specific examples of the binder resins for use in the CTL include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc.

The content of the CTM in the CTL is preferably from 20 to 300 parts by weight, and more preferably from 40 to 150 parts by weight, per 100 parts by weight of the binder resin included in the CTL. The thickness of the CTL is preferably from 5 to 100 μm.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents. However, in view of environmental protection, non-halogenated solvents are preferably used. Specifically, cyclic ethers such as tetrahydrofuran, dioxolan and dioxane, aromatic hydrocarbons such as toluene and xylene, and their derivatives are preferably used.

Charge transport polymers, which have both a binder resin function and a charge transport function, can be preferably used for the charge transport layer because the resultant charge transport layer has good abrasion resistance.

Suitable charge transport polymers include known charge transport polymer materials. Among these materials, polycarbonate resins having a triarylamine group in their main chain and/or side chain are preferably used. In particular, charge transport polymers having the following formulae of from (1) to (10) are preferably used:

(1)

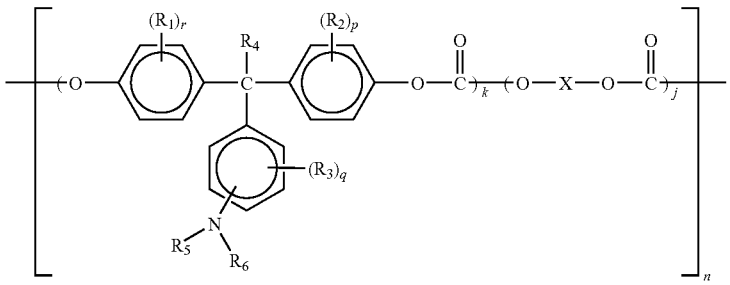

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

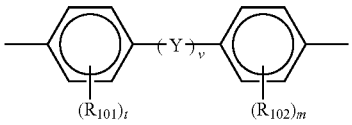

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group), or a group having the following formula:

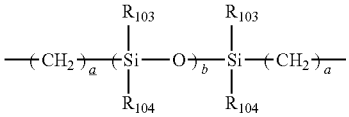

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(2)

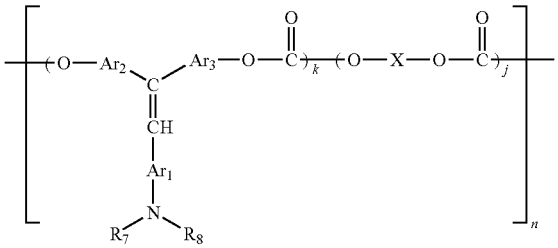

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

(3)

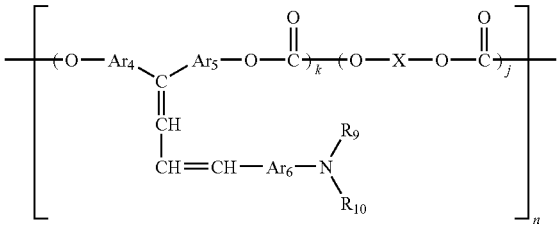

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (1).

(4)

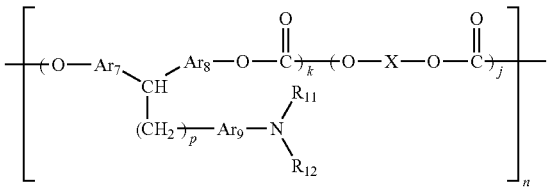

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

(5)

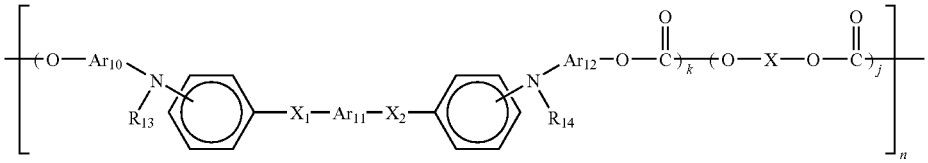

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (1).

(6)

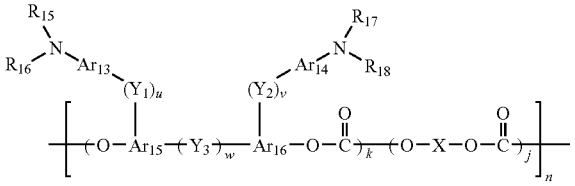

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (1).

(7)

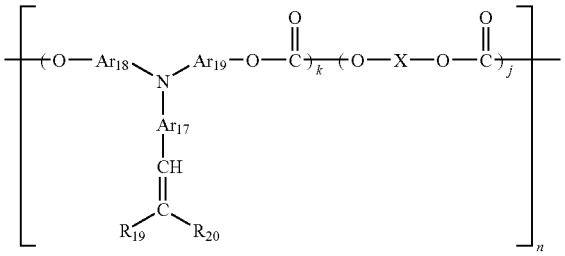

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (1).

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (1).

(9)

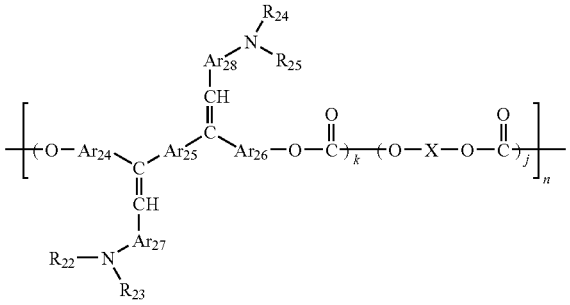

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (1).

(10)

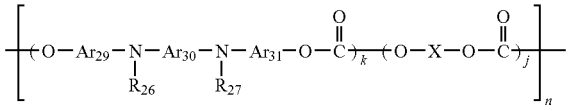

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (1).

Formulae (1) to (10) are illustrated in the form of block copolymers, but the polymers are not limited thereto. The polymers may be random copolymers.

In addition, the CTL can also be formed by coating one or more monomers or oligomers, which have an electron donating group, and then subjecting the monomers or oligomers to a crosslinking reaction after forming the layer such that the layer has a two- or three-dimensional network structure.

(8)

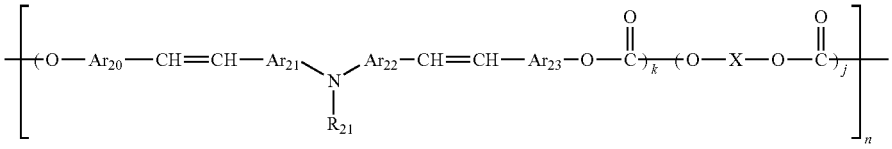

In order to prepare the above-mentioned charge transport polymers, one or more monomers having a charge transport moiety are preferably used as at least one of the constitutional monomers. By using such monomers, the resultant CTL has the charge transport moiety in the three-dimensional network. Therefore, the CTL can fully exercise a charge transport function. Among the monomers, monomers having a triarylamine structure are preferably used.

The CTL having such a three-dimensional network structure has good abrasion resistance but often forms a crack therein if the layer is too thick. In order to prevent occurrence of such a cracking problem, a multi-layered CTL in which a crosslinked CTL is formed on a CTL in which a low molecular CTM is dispersed in a polymer can be used.

The CTL constituted of a polymer or a crosslinked polymer, which has an electron donating group, has good abrasion resistance. In electrophotographic image forming apparatus, the potential of the charges formed on a photoreceptor (i.e., the potential of a non-irradiated area) is generally set to be constant. Therefore, the larger the abrasion loss of the photosensitive layer of the photoreceptor, the larger the strength of the electric field formed on the photoreceptor.

When the electric field increases, background development occurs in the resultant images. Namely a photoreceptor having good abrasion resistance hardly causes the background development problem. The above-mentioned CTL constituted of a polymer having an electron donating group has good film formability because the layer itself is a polymer. In addition, the CTL has good charge transportability because of including charge transport moieties at a relatively high concentration compared to CTLs including a polymer and a low molecular weight CTM. Namely, the photoreceptor including a CTL constituted of a charge transport polymer has high response.

Known copolymers, block polymers, graft polymers, and star polymers can also be used for the polymers having an electron donating group. In addition, crosslinking polymers including an electron donating group, such as polymers disclosed in JP-As 03-109406, 2000-206723 and 2001-34001, can also be used for the charge transport layer.

The CTL can include additives such as plasticizers and leveling agents. Specific examples of the plasticizers include known plasticizers such as dibutyl phthalate and dioctyl phthalate. The content of the plasticizer in the CTL is from 0 to 30% by weight based on the total weight of the binder resin included in the CTL. Specific examples of the leveling agents include silicone oils such as dimethyl silicone oils and methyl phenyl silicone oils, and polymers and oligomers, which include a perfluoroalkyl group in their side chain. The content of the leveling agent in the CTL is from 0 to 1% by weight based on the total weight of the binder resin included in the CTL.

Hereinbefore, the layered photosensitive layer has been explained. However, the photosensitive layer of the photoreceptor of the present invention is not limited to the layered photosensitive layer, and a single-layered photosensitive layer (such as the photosensitive layer 43) can be used. In this case, the photosensitive layer 43 includes at least a CGM and a binder resin. Suitable materials for use as the binder resin include the materials mentioned above for use as the binder resin in the CGL and CTL. In addition, a CTM is preferably included in the single-layered photosensitive layer so that the resultant photoreceptor has high photosensitivity, high carrier transportability and low residual potential. In this case, a proper CTM is chosen from hole transport materials or electron transport materials of the charge transport materials, depending on the polarity of charges to be formed on the surface of the photoreceptor. In addition, the charge transport polymers mentioned above can also be preferably used for the single-layered photosensitive layer because of having both the functions of the binder resin and the CTM.

In the photoreceptor of the present invention, a protective layer 48 is formed overlying the photosensitive layer to protect the photosensitive layer 43 or the CTL 47. Recently, computers are used in daily life, and therefore a need exists for a high-speed and small-sized printer. By forming a protective layer on the photosensitive layer, good durability can be imparted to the resultant photoreceptor. Therefore, the resultant photoreceptor can stably maintain good electric properties.

The protective layer is preferably a crosslinked protective layer, which is preferably prepared by crosslinking one or more radically polymerizable monomers. In view of mechanical durability of the protective layer, it is preferable to use monomers having three or more functional groups. Namely, by forming the crosslinked protective layer using monomers having three or more functional groups, the protective layer has high hardness and high elasticity because of having a well-developed three dimensional network and a high crosslinking density. In addition, since the surface of the protective layer is uniform and smooth, the protective layer has good abrasion resistance and scratch resistance.

Although it is important to increase the crosslinking density of the protective layer, a problem in that the protective layer has a high internal stress due to shrinkage in the crosslinking reaction tends to occur. The internal stress increases as the thickness of the protective layer increases. Therefore, when a thick protective layer is entirely crosslinked, problems in that the protective layer is cracked and peeled occur. Even though these problems are not caused when the photoreceptor is new, the problems tend to be easily caused when the photoreceptor receives various stresses after being repeatedly subjected to charging, developing, transferring and cleaning operations.

In order to prevent occurrence of the problems, the following techniques can be used.

(1) a polymeric component is added to the crosslinked protective layer;

(2) a large amount of mono- or di-functional monomers are used for forming the crosslinked protective layer; and (3) a polyfunctional monomer having a group capable of imparting softness to the resultant crosslinked protective layer is used.

However, the crosslinked protective layers prepared using these techniques have a low crosslinking density. Therefore, a good abrasion resistance cannot be imparted to the resultant protective layers.

In contrast, in the photoreceptor of the present invention, a crosslinked protective layer having a well-developed three dimensional network and a high crosslinking density and having a thickness of from 1 to 15 μm is formed on the photosensitive layer. Therefore, the resultant photoreceptor has high abrasion resistance and hardly causes the cracking and peeling problems. The thickness of the crosslinked protective layer is preferably from 2 to 10 μm. In this case, the margin for the above-mentioned problems can be improved and flexibility in choosing materials for forming the protective layer having a higher crosslinking density can be enhanced.

The reasons why the photoreceptor for use in the present invention hardly causes the cracking and peeling problems are as follows.

(1) a relatively thin crosslinked protective layer having a charge transport structure is formed and thereby increase of internal stress of the photoreceptor can be prevented; and (2) since a CTL is formed below the crosslinked protective layer having a charge transport structure, the internal stress of the crosslinked protective layer can be relaxed.

Therefore, it is not necessary to increase the amount of polymer components in the protective layer. Accordingly, occurrence of problems in that the protective layer is scratched or an undesired film (such as a toner film) is formed on the protective layer, which is caused by incomplete mixing of polymer components and the crosslinked material formed by reaction of radically polymerizable monomers, can be prevented.

In addition, when a protective layer is crosslinked by irradiating light, a problem in that the inner portion of the protective layer is incompletely reacted because the charge transport moieties absorb light occurs. However, since a CTM is injected to the protective layer of the photoreceptor of the present invention after the protective layer is crosslinked, the above-mentioned incomplete reaction problem is not caused (i.e., the entire protective layer is completely crosslinked) and thereby a good abrasion resistance can be imparted to the entire protective layer.

Further, the CTM in the protective layer is not deteriorated because the CTM is injected after crosslinking the protective layer, and therefore the protective layer can maintain good electric properties for a long period of time. One or more CTMs can be used together with radically polymerizable monomers having no charge transport structure when forming the protective layer. In this regard, CTMs having no polymerizable functional group can be used but CTMs having a polymerizable functional group are preferably used to impart good mechanical durability to the photoreceptor. The number of polymerizable functional groups included in CTMs is preferably small not to cause strain and internal stresses in the resultant protective layer, and therefore monofunctional CTMs are preferably used.

Next, the constituents of the coating liquid for forming the crosslinked protective layer will be explained.

The radically polymerizable monomers having no charge transport structure for use in preparing the protective layer are defined as monomers which have radically polymerizable groups and which do not have a charge transport structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). Any radically polymerizable groups having a carbon-carbon double bond (C═C) can be used as the radically polymerizable group. Suitable radically polymerizable groups include 1-substituted ethylene groups having the below-mentioned formula (11) and 1,1-substituted ethylene groups having the below-mentioned formula (12).

1-Substituted Ethylene Groups $$CH_2{=}CH{-}X^1{-} \quad (11)$$

wherein $X^1$ represents an arylene group (such as a phenylene group and a naphthylene group), which optionally has a substituent, a substituted or unsubstituted alkenylene group, a —CO— group, a —COO— group, a —CON($R^{10}$) group ($R^{10}$ represents a hydrogen atom, an alkyl group (e.g., a methyl group, and an ethyl group), an aralkyl group (e.g., a benzyl group, a naphthylmethyl group and a phenetyl group), or an aryl group (e.g., a phenyl group and a naphthyl group)) or a —S— group.

Specific examples of the groups having formula (11) include a vinyl group, a stylyl group, 2-methyl-1,3-butadienyl group, a vinylcarbonyl group, acryloyloxy group, acryloylamide, vinyl thio ether, etc.

1,1-Substituted Ethylene Groups $$CH_2{=}C(Y){-}(X^2)n{-} \quad (12)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR^{12}R^{13}$ group (wherein each of $R^{12}$ and $R^{13}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups)); $X^2$ represents a group selected from the groups mentioned above for use in $X^1$ and an alkylene group, wherein at least one of Y and $X^2$ is an oxycarbonyl group, a cyano group, an alkenylene group or an aromatic group; and n is 0 or 1.

Specific examples of the groups having formula (12) include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X^1$, $X^2$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radically polymerizable functional groups, acryloyloxy groups and methacryloyloxy groups are preferably used. Compounds having a (meth)acryloyloxy group can be prepared by subjecting (meth)acrylic acid (salts), (meth) acrylhalides and (meth)acrylates, which have a hydroxyl group, to an ester reaction or an ester exchange reaction. When plural radically polymerizable groups are included in a radically polymerizable functional monomer, the groups may be the same as or different from the others therein.

Specific examples of the radically polymerizable functional monomers include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, bisphenol A-ethyleneoxy-modified diacrylate, bisphenol F-ethyleneoxy-modified diacrylate, neopentylglycol diacryalte, trimethylolpropane triacrylate (TMPTA), trimethylolpropane trimethacylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerhythritol ethoxytriacrylate, ethyleneoxy-modified triacryl phosphate, 2,2,5,5-tetrahydroxymethylcyclopentanone tetraacrylate, etc. These monomers are used alone or in combination.

In order to form a dense crosslinked network in the crosslinked protective layer, the ratio (Mw/F) of the molecular weight (Mw) of the functional monomer to the number of functional groups (F) included in a molecule of the monomer is preferably not greater than 250. When the number is too large, the resultant protective layer becomes soft and thereby the abrasion resistance of the layer is deteriorated. In this case, it is not preferable to use only one monomer having a functional group having a long chain group such as ethylene oxide, propylene oxide and caprolactone.

The content of the unit obtained from the radically polymerizable monomers having no charge transport structure in the crosslinked protective layer is preferably from 20 to 80% by weight, and more preferably from 30 to 70% by weight based on the total weight of the protective layer. When the content is too low, the three dimensional crosslinking density is low, and thereby good abrasion resistance cannot be imparted to the protective layer. In contrast, when the content is too high, the content of the charge transport compound decreases, and therefore good electric properties cannot be imparted to the protective layer. Although the targets of the electric properties and abrasion resistance of a photoreceptor change depending on the process for which the photoreceptor is used and therefore the target of the thickness of the protective layer thereof changes, the preferable range of content of the unit obtained from the radically polymerizable monomers is not unambiguously determined. However, in order to balance the abrasion resistance and charge transport property of the crosslinked protective layer, the content of the unit obtained from the functional monomers in the protective layer is preferably from 30 to 70% by weight.

Both CTMs having a radically polymerizable functional group and CTMs having no radically polymerizable functional group can be used for the protective layer of the photoreceptor of the present invention. When the protective layer is crosslinked (for example, by irradiating light), it is preferable in view of electric properties of the resultant photoreceptor that no CTM is included in the protective layer. However, in order to further improve the mechanical durability of the photoreceptor, a CTM having a radically polymerizable functional group can be included in the protective layer to be crosslinked when the protective layer is crosslinked.

Suitable CTMs having no radically polymerizable functional group include the CTMs mentioned above for use in the CTL. Suitable CTMs having a radically polymerizable functional group include CTMs described in JP-As 2005-107401, 2006-011014 and 2006-154796. Specific examples thereof include compounds having both a radically polymerizable functional group and one of a charge transport structure (such as a positive hole transport structure (e.g., triarylamine, hydrazone, pyrazoline and carbazole structures) and an electron transport structure (e.g., condensed polycyclic quinone structure, diphenoquinone structure, a cyano group and a nitro group)).

Suitable groups for use as the radically polymerizable functional group of the CTMs include the groups mentioned above for use in the radically polymerizable monomers having no charge transport structure, and acryloyloxy and methacryloyloxy groups are preferably used. In addition, among the charge transport groups, triarylamine groups are preferably used because of having a good charge transport function. Among the compounds having a triarylamine group, compounds having the following formula (13) or (14) are preferably used because of having good electric properties (i.e., high photosensitivity and low residual potential)

formula (13)

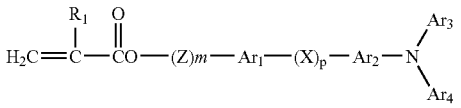

formula (14)

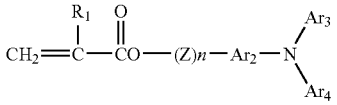

In formulae (13) and (14), $R^1$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR^7$ group (wherein $R^7$ represents a hydrogen atom, a substituted or unsubstituted alkyl group, a substituted or unsubstituted aralkyl group and a substituted or unsubstituted aryl group), a halogenated carbonyl group or a —$CONR^8R^9$ (wherein each of $R^8$ and $R^9$ represents a hydrogen atom, a substituted or unsubstituted alkyl group, a substituted or unsubstituted aralkyl group and a substituted or unsubstituted aryl group); each of $Ar^1$ and $Ar^2$ represents a substituted or unsubstituted arylene group; each of $Ar^3$ and $Ar^4$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxy carbonyl group; each of m and n is 0 or an integer of from 1 to 3; and p is 0 or 1.

In formulae (13) and (14), specific examples of the alkyl, aryl, aralkyl, and alkoxy groups for use in $R^1$ include the following.

Alkyl Group

Methyl, ethyl, propyl and butyl groups.

Aryl Group

Phenyl and naphthyl groups, etc.

Aralkyl Group

Benzyl, phenethyl and naphthylmethyl groups.

Alkoxy Group

Methoxy, ethoxy and propoxy groups.

These groups may be substituted with a halogen atom, a nitro group, a cyano group, an alkyl group (such as methyl and ethyl groups), an alkoxy group (such as methoxy and ethoxy groups), an aryloxy group (such as a phenoxy group), an aryl group (such as phenyl and naphthyl groups), an aralkyl group (such as benzyl and phenethyl groups), etc.

Among these groups, a hydrogen atom and a methyl group are preferable as $R^1$.

Suitable substituted or unsubstituted aryl groups for use as $Ar^3$ and $Ar^4$ include condensed polycyclic hydrocarbon groups, non-condensed cyclic hydrocarbon groups, and heterocyclic groups.

Specific examples of the condensed polycyclic hydrocarbon groups include compounds in which 18 or less carbon atoms constitute one or more rings, such as pentanyl, indecenyl, naphthyl, azulenyl, heptalenyl, biphenilenyl, as-indacenyl, s-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, and naphthasenyl groups.

Specific examples of the non-condensed cyclic hydrocarbon groups include monovalent groups of benzene, diphenyl ether, polyethylene diphenyl ether, diphenyl thioether, and diphenyl sulfone; monovalent groups of non-condensed polycyclic hydrocarbon groups such as biphenyl, polyphenyl, diphenyl alkans, diphenylalkenes, diphenyl alkyne, triphenyl methane, distyryl benzene, 1,1-diphenylcycloalkanes, polyphenyl alkans, polyphenyl alkenes; and ring aggregation hydrocarbons such as 9,9-diphenyl fluorenone.

Specific examples of the heterocyclic groups include monovalent groups of carbazole, dibenzofuran, dibenzothiophene, oxadiazole, and thiadiazole.

The aryl groups for use as $Ar^3$ and $Ar^4$ may be substituted with the following groups.

(1) Halogen atoms, and cyano and nitro groups.

(2) Linear or branched alkyl groups which preferably have from 1 to 12 carbon atoms, more preferably from 1 to 8 carbon atoms and even more preferably from 1 to 4 carbon atoms. These alkyl groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl and 4-phenylbenzyl groups.

(3) Alkoxy groups (i.e., —$OR_2$). $R_2$ represents one of the alkyl groups defined above in paragraph (2). Specific examples of the alkoxy groups include methoxy, ethoxy, n-propoxy, iso-propoxy, t-butoxy, n-butoxy, s-butoxy, iso-butoxy, 2-hydroxyethoxy, benzyloxy and trifluoromethoxy groups.

(4) Aryloxy groups. Specific examples of the aryl group of the acryloxy groups include phenyl and naphthyl groups. The aryloxy groups may be substituted with an alkoxy group having from 1 to 4 carbon atoms, an alkyl group having from 1 to 4 carbon atoms, or a halogen atom. Specific examples of the groups include phenoxy, 1-naphthyloxy, 2-naphthyloxy, 4-methoxyphenoxy, and 4-methylphenoxy groups.

(5) Alkylmercapto or arylmercapto group. Specific examples of the groups include methylthio, ethylthio, phenylthio, and p-methylphenylthio groups (6) Groups having the following formula (15).

formula (15)

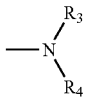

In formula (15), each of $R_3$ and $R_4$ represents a hydrogen atom, one of the alkyl groups defined in paragraph (2) or an aryl group (such as phenyl, biphenyl, and naphthyl groups). These groups may be substituted with another group such as an alkoxy group having from 1 to 4 carbon atoms, an alkyl group having from 1 to 4 carbon atoms, and a halogen atom. In addition, $R_3$ and $R_4$ optionally share bond connectivity to form a ring.

Specific examples of the groups having formula (15) include amino, diethylamino, N-methyl-N-phenylamino, N,N-diphenylamino, N,N-di(tolyl)amino, dibenzylamino, piperidino, morpholino, and pyrrolidino groups.

(7) Alkylenedioxy or alkylenedithio groups such as methylenedioxy and methylenedithio groups.

(8) Substituted or unsubstituted styryl groups, substituted or unsubstituted β-phenylstyryl groups, diphenylaminophenyl groups, and ditolylaminophenyl groups.

Suitable arylene groups for use in $Ar^1$ and $Ar^2$ include divalent groups delivered from the aryl groups mentioned above for use in $Ar^3$ and $Ar^4$.

The group X is a substituted or unsubstituted alkylene group, a substituted or unsubstituted cycloalkylene group, a substituted or unsubstituted alkylene ether, an oxygen atom, a sulfur atom, and a vinylene group.

Suitable groups for use as the substituted or unsubstituted alkylene group include linear or branched alkylene groups which preferably have from 1 to 12 carbon atoms, more preferably from 1 to 8 carbon atoms and even more preferably from 1 to 4 carbon atoms. These alkylene groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkylene groups include methylene, ethylene, n-propylene, iso-propylene, n-butylene, sec-butylene, t-butylene, trifluoromethylene, 2-hydroxyethylene, 2-ethoxyethylene, 2-cyanoethylene, 2-methoxyethylene, benzylidene, phenylethylene, 4-chlorophenylethylene, 4-methylphenylethylene and 4-biphenylethylene groups.

Suitable groups for use in the substituted or unsubstituted cycloalkylene groups include cyclic alkylene groups having from 5 to 7 carbon atoms, which may be substituted with a fluorine atom or another group such as a hydroxyl group, alkyl groups having from 1 to 4 carbon atoms, and alkoxy groups having 1 to 4 carbon atoms. Specific examples of the substituted or unsubstituted cycloalkylene groups include cyclohexylidene, cyclohexylene, and 3,3-dimethylcyclohexylidene groups.

Specific examples of the substituted or unsubstituted alkylene ether groups include ethyleneoxy, propyleneoxy, ethylene glycol, propylene glycol, diethylene glycol, tetraethylene glycol, and tripropylene glycol groups. The alkylene group of the alkylene ether groups may be substituted with another group such as hydroxyl, methyl and ethyl groups.

As the vinylene group, groups having one of the following formulae can be preferably used.

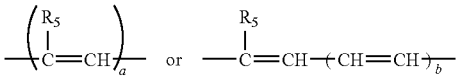

In the above-mentioned formulae, $R_5$ represents a hydrogen atom, one of the alkyl groups mentioned above for use in paragraph (2), or one of the aryl groups mentioned above for use in $Ar^3$ and $Ar^4$, wherein a is 1 or 2, and b is 1, 2 or 3.

In formulae (13) and (14), Z represents a substituted or unsubstituted alkylene group, a substituted or unsubstituted divalent alkylene ether group, a divalent alkyleneoxycarbonyl group. Specific examples of the substituted or unsubstituted alkylene group include the alkylene groups mentioned above for use as X. Specific examples of the substituted or unsubstituted alkylene ether group include the divalent alkylene ether groups mentioned above for use as X. Specific examples of the divalent alkyleneoxycarbonyl group include divalent groups modified by caprolactone.

More preferably, monomers having the following formula (16) are used as the radically polymerizable monofunctional monomer having a charge transport structure.

formula (16)

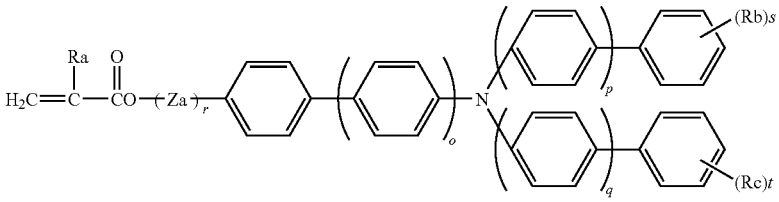

In formula (16), each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of s and t is 0, 1, 2 or 3; r is 0 or 1; Za represents a methylene group, an ethylene group or a group having one of the following formulae.

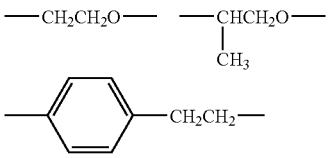

In formula (16), each of Rb and Rc is preferably a methyl group or an ethyl group.

The charge transport materials having a radically polymerizable monofunctional group having formula (13) or (14) (preferably formula (16)) have the following property. Specifically, such a monofunctional charge transport material is polymerized while the double bond of a molecule is connected with the double bonds of other molecules. Therefore, the charge transport material is incorporated in a polymer chain, i.e., in a main chain or a side chain of the crosslinked polymer chain which is formed by the charge transport material and a radically polymerizable monomer having no charge transport structure. The side chain of the unit obtained from the monofunctional charge transport material is present between two main polymer chains which are connected by crosslinked chains. In this regard, the crosslinked chains are classified into intermolecular crosslinked chains and intramolecular crosslinked chains.

In any of these case, the triarylamine group which is a pendant of the main chain of the unit obtained from the monofunctional charge transport material is bulky (because of having three aryl groups) and is connected with the main chain with a carbonyl group therebetween while not being fixed (i.e., while being fairly free three-dimensionally). Therefore, the crosslinked polymer has little strain, and in addition the crosslinked protective layer has good charge transport property.

In addition, compounds having the following formula (17) can also be used as the charge transport material having a radically polymerizable functional group.

$$B_1—Ar_5—CH=CH—Ar_6—B_2 \qquad \text{formula (17)}$$

In formula (17), $Ar_5$ represents a monovalent or divalent group having an aromatic hydrocarbon skeleton, which may be substituted. Specific examples of the aromatic hydrocarbons include benzene, naphthalene, phenanthrene, biphenyl, 1,2,3,4-tetrahydronaphthalene, etc. Specific examples of the substituents include alkyl groups having 1 to 12 carbon atoms, alkoxyl groups having 1 to 12 carbon atoms, benzyl groups, halogen atoms, etc. In this regard, the alkyl groups and alkoxyl groups may be substituted with a group such as halogen atoms and phenyl groups. In formula (17), $Ar_6$ represents a monovalent or divalent group having an aromatic hydrocarbon skeleton or a heterocyclic structure, which has at least one tertiary amino group.

Specific examples of the aromatic hydrocarbon skeleton having a tertiary amino group include compounds having the following formula (A).

Formula (A)

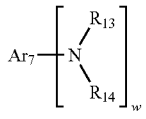

In formula (A), each of $R_{13}$ and $R_{14}$ represents an acyl group, a substituted or unsubstituted alkyl group, or a substituted or unsubstituted aryl group; and $Ar_7$ represents an aryl group; and w represents an integer of from 1 to 3.

Specific examples of the acyl group include acetyl groups, propionyl groups, benzoyl groups, etc. Specific examples of the substituted or unsubstituted alkyl group include the alkyl groups mentioned above for use as the substituents of $Ar_5$. Specific examples of the substituted or unsubstituted aryl group include phenyl, naphthyl, biphenylyl, terphenylyl, pyrenyl, fluorenyl, 9,9-dimethyl-2-fluorenyl, azulenyl, anthoryl, triphenylenyl and chrysenyl groups, and groups having the following formula (B).

Formula (B)

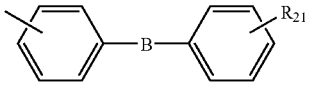

wherein B represents —O—, —S—, —SO—, —$SO_2$—, —CO— and a divalent group having the following formula.

$$-(CH_2)_k- \text{ or } -(CH{=}CR_{22})_j-.$$

In these formulae, $R_{21}$ represents a hydrogen atom, a substituted or unsubstituted alkyl group (mentioned above for use in $Ar_5$), an alkoxyl group, a halogen atom, a substituted or unsubstituted aryl group (mentioned above for use in $R_{13}$), an amino group, a nitro group, or a cyano group; $R_{22}$ represents a hydrogen atom, a substituted or unsubstituted alkyl group (mentioned above for use in $Ar_5$), or a substituted or unsubstituted aryl group (mentioned above for use in $R_{13}$); k is an integer of from 1 to 12; and j is an integer of from 1 to 3.

Specific examples of the alkoxyl groups for use in $R_{21}$ include methoxy, ethoxy, n-propoxy, iso-propoxy, n-butoxy, iso-butoxy, s-butoxy, t-butoxy, 2-hydroxyethoxy, 2-cyanoethoxy, benzyloxy, 4-methylbenzyloxy and trifluoromethoxy groups. Specific examples of the halogen atoms for use in $R_{21}$ include fluorine, chlorine, bromine and iodine atoms. Specific examples of the amino groups for use in $R_{21}$ include diphenylamino, ditolylamino, dibenzylamino and 4-methylbenzyl groups.

Specific examples of the aryl groups for use in $Ar_7$ include phenyl naphthyl, biphenylyl, terphenylyl, pyrenyl, fluorenyl, 9,9-dimethyl-2-fluorenyl, azulenyl, anthoryl, triphenylenyl and chrysenyl groups.

The groups $Ar_7$, $R_{13}$, and $R_{14}$ may be substituted with alkyl groups, alkoxyl groups, and/or halogen atoms, which are mentioned above for use in $Ar_5$.

Specific examples of the heterocyclic skeleton having a tertiary amino group include pyrrole, pyrazole, imidazole, triazole, dioxazole, indole, isoindole, benzimidazole, benzotriazole, benzisoxazine, carbazole, and phenoxazine skeletons. These groups may be substituted with the alkyl groups, alkoxyl groups, and/or halogen atoms, which are mentioned above for use in $Ar_5$.

In formula (17), specific examples of each of the groups $B_1$ and $B_2$ include acryloyloxy groups, methacryloyloxy groups, vinyl groups, alkyl groups having one or more of acryloyloxy groups, methacryloyloxy groups and vinyl groups, and alkoxyl groups having one or more of acryloyloxy groups, methacryloyloxy groups and vinyl groups. Specific examples of the alkyl groups and alkoxyl groups include the groups mentioned above for use in $Ar_5$. In formula (17), only one of the groups $B_1$ and $B_2$ exists and a case where both the groups $B_1$ and $B_2$ exist is excluded.

Among the compounds having formula (17), compounds having the following formula (18) are preferable.

Formula (18)

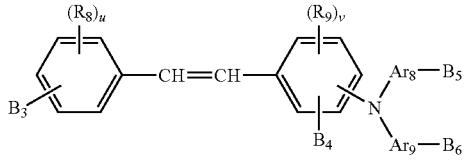

In formula (18), each of $R_8$ and $R_9$ represents a substituted or unsubstituted alkyl group, a substituted or unsubstituted alkoxyl group, or a halogen atom; each of $Ar_8$ and $Ar_9$ represents a substituted or unsubstituted aryl or arylene group, or a substituted or unsubstituted benzyl group. Specific examples of the alkyl groups, alkoxyl groups and halogen atoms include those mentioned above for use in $Ar_5$. Specific examples of the aryl groups include those mentioned above for use in $R_{13}$ and $R_{14}$. Specific examples of the arylene groups include divalent groups derived from the aryl groups. Specific examples of each of the groups $B_3$ to $B_6$ include the groups mentioned above for use in $B_1$ and $B_2$. Similar to $B_1$ and $B_2$, only one of the groups $B_3$ to $B_6$ exists, and cases where two or more of the groups exist are excluded. In formula (18), u is 0 or an integer of from 1 to 5, and v is 0 or an integer of from 1 to 4.

The above-mentioned compounds have the following characteristics. Specifically, the compounds are tertiary amine compounds having a stilbene-form conjugate structure and have a well-developed conjugated system. By using a charge transport material having such a well-developed conjugated system for the protective layer, charges can be well injected at the interface between the protective layer (i.e., crosslinked layer) and the photosensitive layer. In addition, even when the materials are fixed in the crosslinked bond, the intermolecular interaction is hardly inhibited, and therefore the protective layer has a good charge mobility. Further, since the charge transport materials have one acryloyloxy or methacryloyloxy group in one molecule thereof, which has a high radical polymerizability, the materials rapidly cause gelation in radical polymerizztion without causing excessive strain in the resultant crosslinked layer. Specifically, the double bond in the stilbene structure is partially used for polymerization. In this regard, the polymerizability of the double bond is lower than that of acryloyloxy or methacryloyloxy group, and therefore time difference is caused in the crosslinking reaction. Accordingly, the strain caused by the crosslinking reaction can be minimized and the ratio of the number of crosslinking reactions to the molecular weight thereof can be increased because the double bond in the molecule is used for the crosslinking reactions, resulting in enhancement of the crosslinking density and improvement of the abrasion resistance of the protective layer. By controlling the crosslinking conditions, the reaction of the double bond can be controlled, and thereby the polymerization degree can be controlled. Therefore, a crosslinked layer having a desired property can be easily prepared. This contribution of the radical polymerization of the compounds to the crosslinking reaction is a specific property thereof, and the compounds having the above-mentioned α-phenylstilbene structure do not have such a property.

Thus, by using a charge transport material having a radically polymerizable functional group, which has formula (17), and preferably formula (18), for the protective layer, the resultant layer has good electrical properties and high crosslinking density and does not cause problems such as formation of cracks. Therefore, the resultant photoreceptor can satisfy the requirements and hardly forms defective images such as white spot images which are caused by sticking of particles of the external additive (such as silica) of toner, which is used for developing electrostatic images on the photoreceptor, into the photoreceptor.

Specific examples of the radically polymerizable compounds having a charge transport structure are the following, but are not limited thereto. These compounds are known and have been disclosed in, for example, JP-As 2006-154796, 2006-221152 and 2006-221157.

No. 1

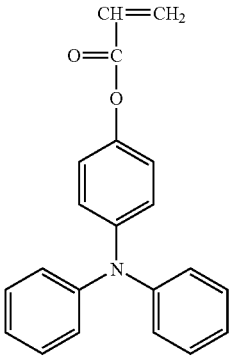

No. 2

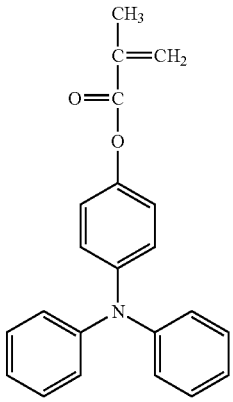

No. 3

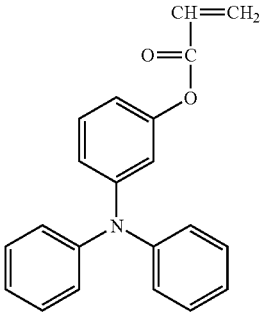

No. 4

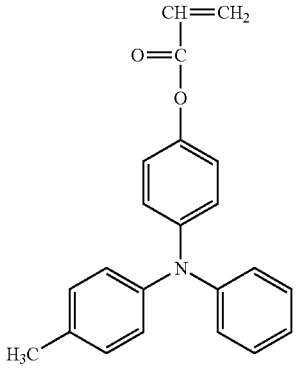

No. 5

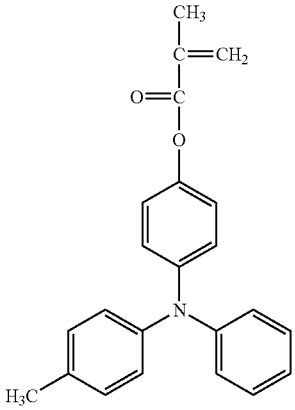

No. 6

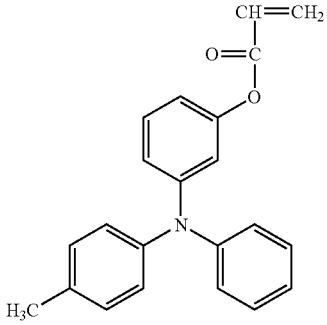

-continued
No. 7
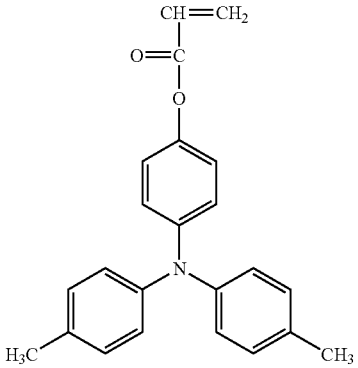
No. 8
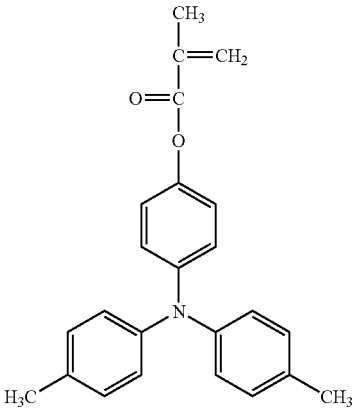
No. 9
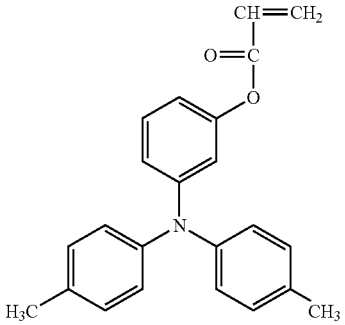
No. 10
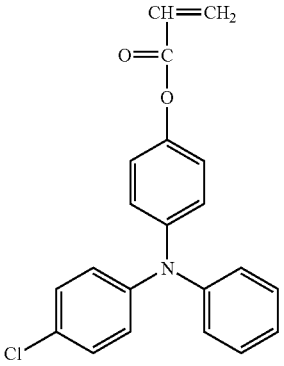
No. 11
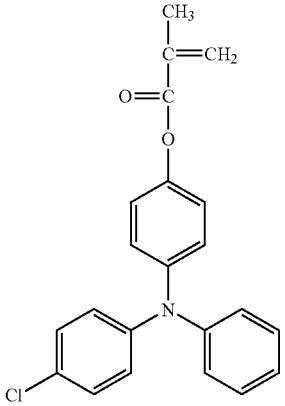
No. 12
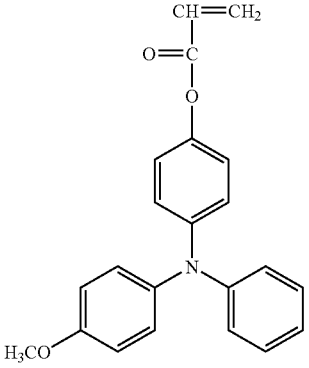
No. 13
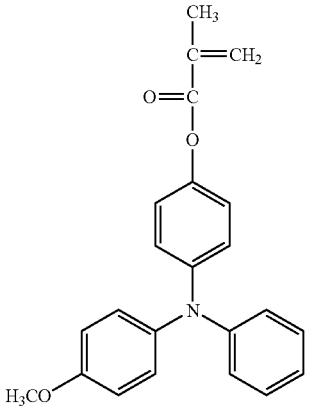
No. 14
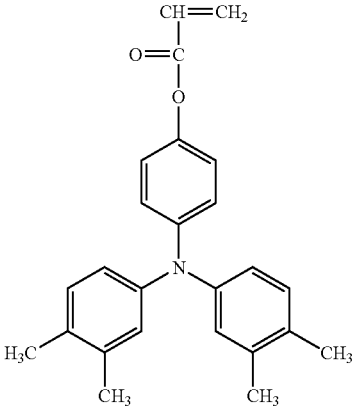

-continued
No. 15
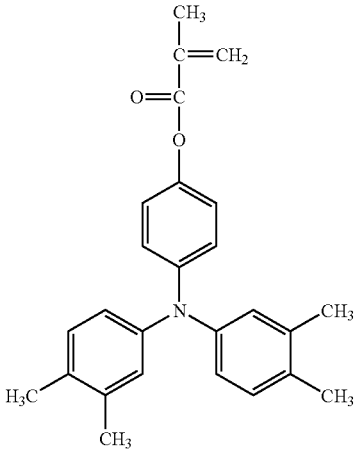
No. 16
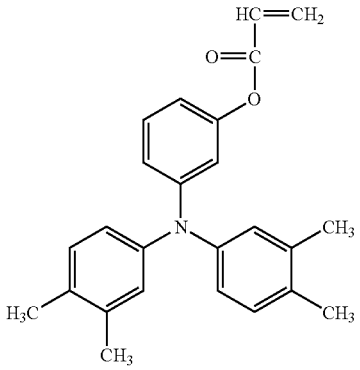
No. 17
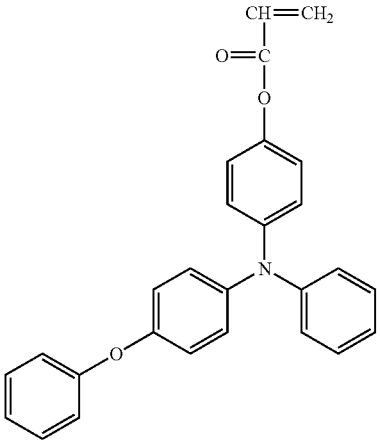
No. 18
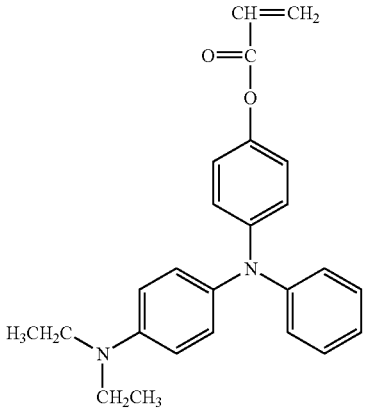
No. 19
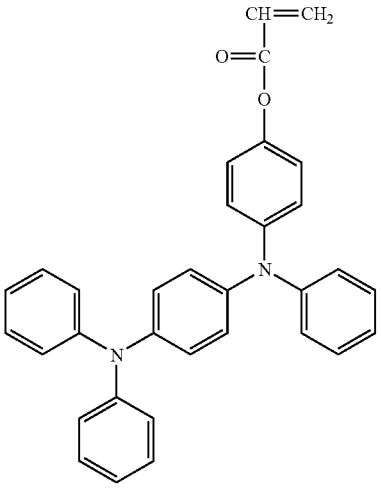
No. 20
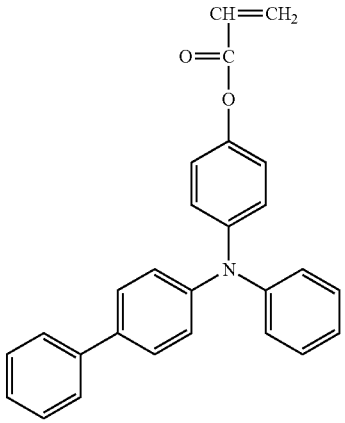

-continued
No. 21
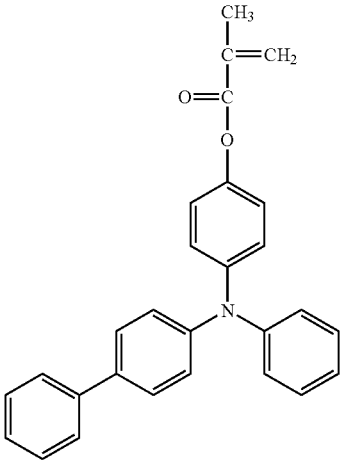
No. 22
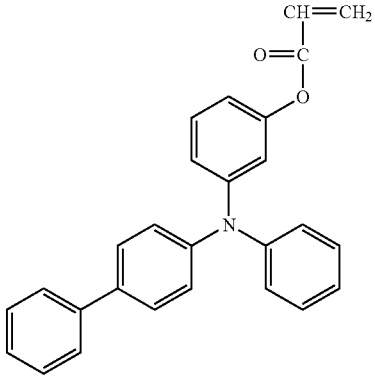
No. 23
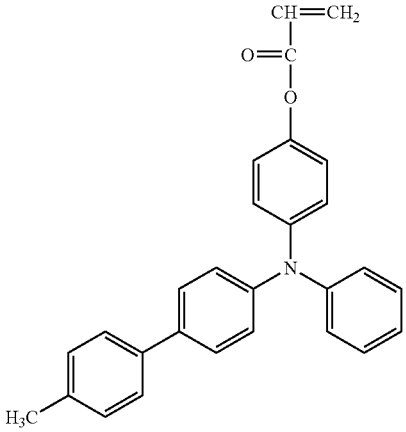
No. 24
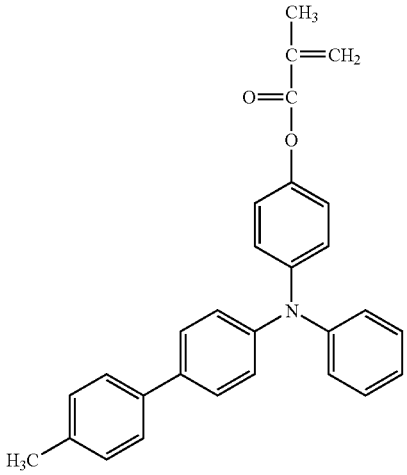
No. 25
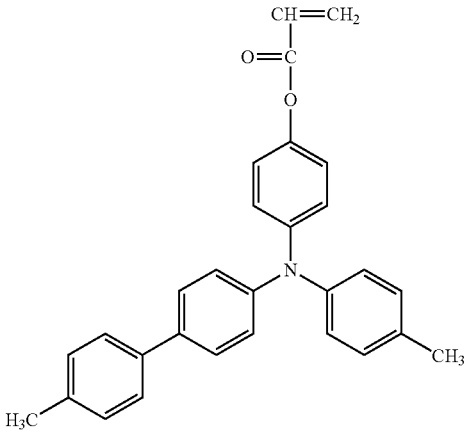
No. 26
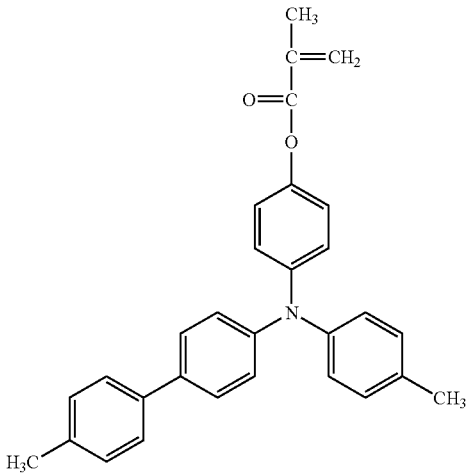

-continued
No. 27
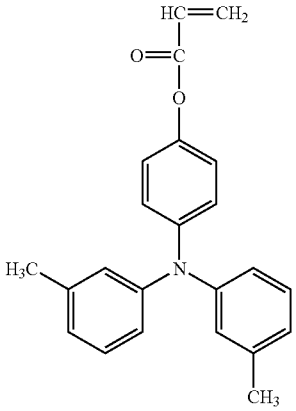
No. 28
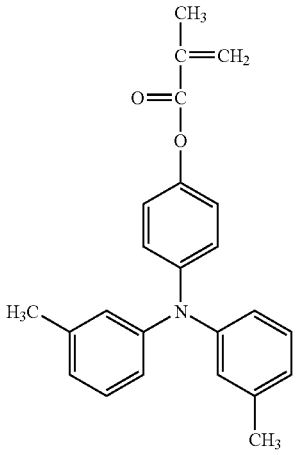
No. 29
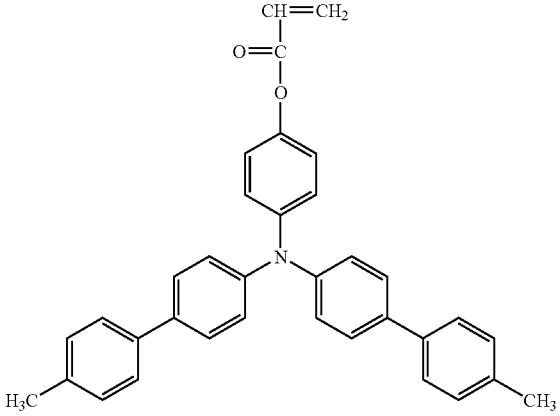
No. 30
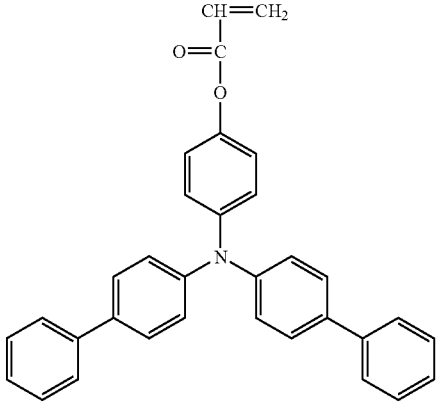
No. 31
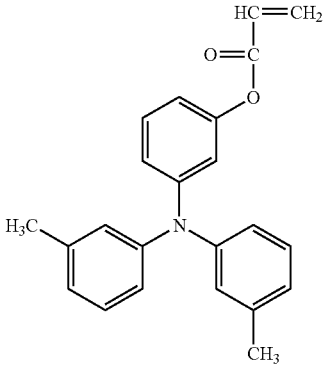
No. 32
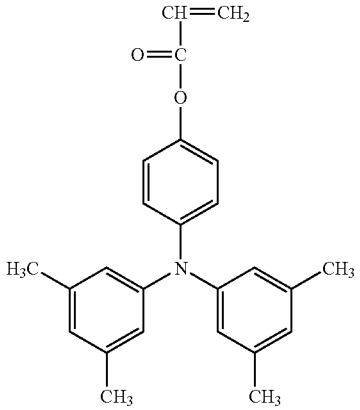

-continued
No. 33
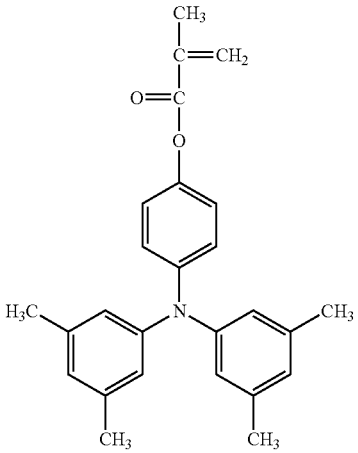
No. 34
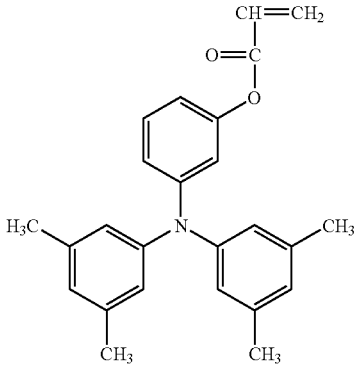
No. 35
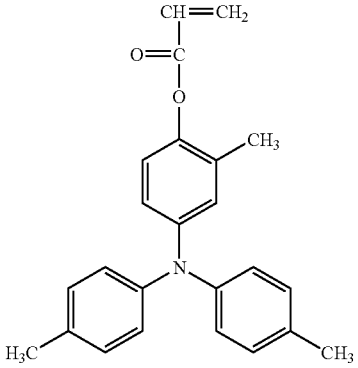
No. 36
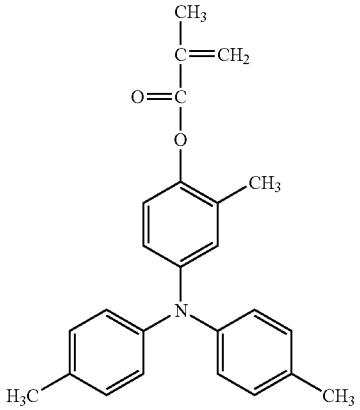
No. 37
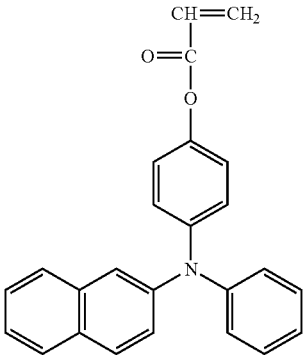
No. 38
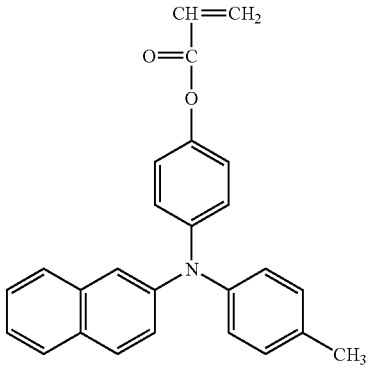

-continued
No. 39
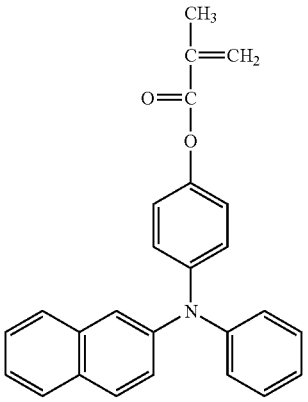
No. 40
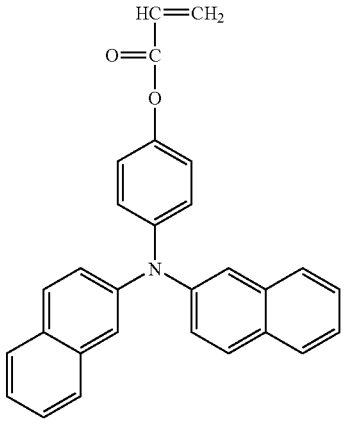
No. 41
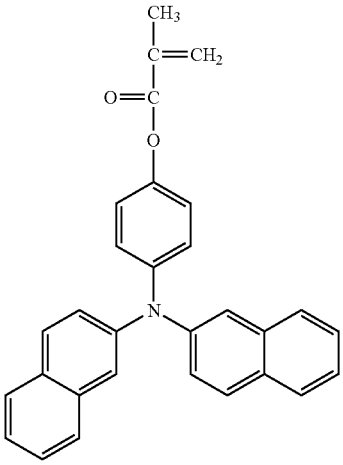
No. 42
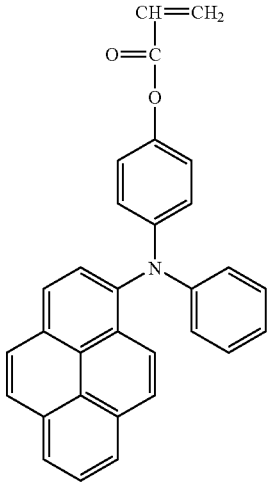
No. 43
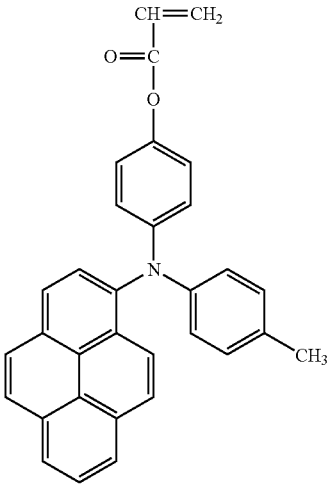
No. 44
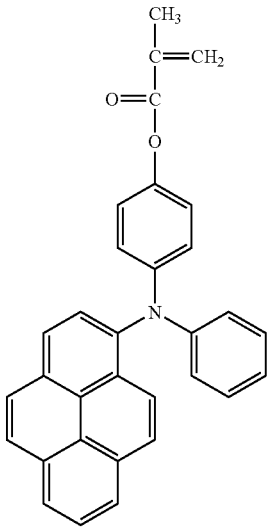

-continued
No. 45
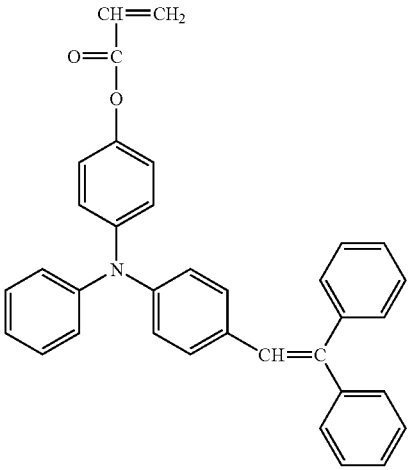
No. 46
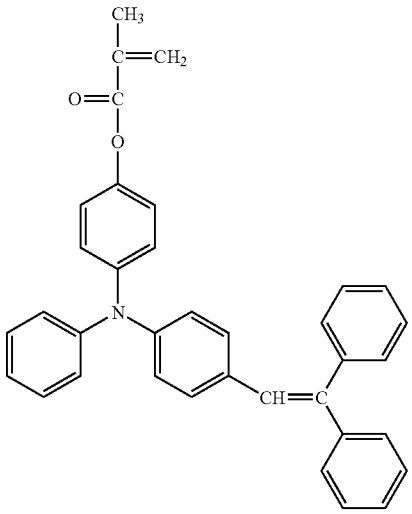
No. 47
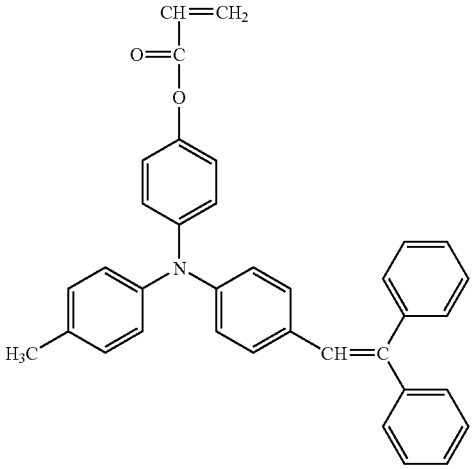
No. 48
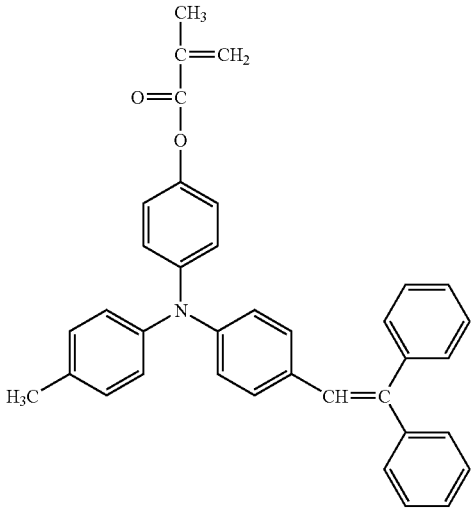
No. 49
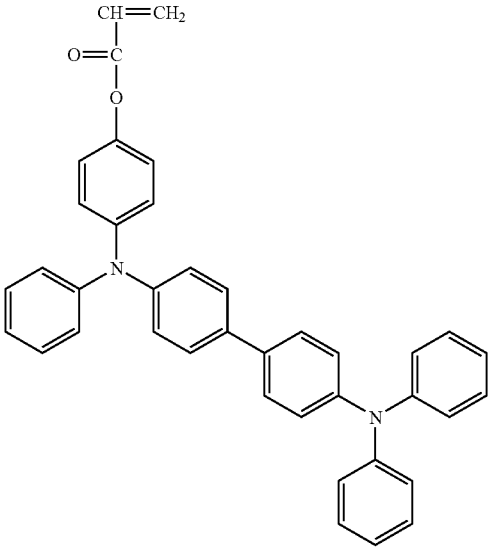
No. 50
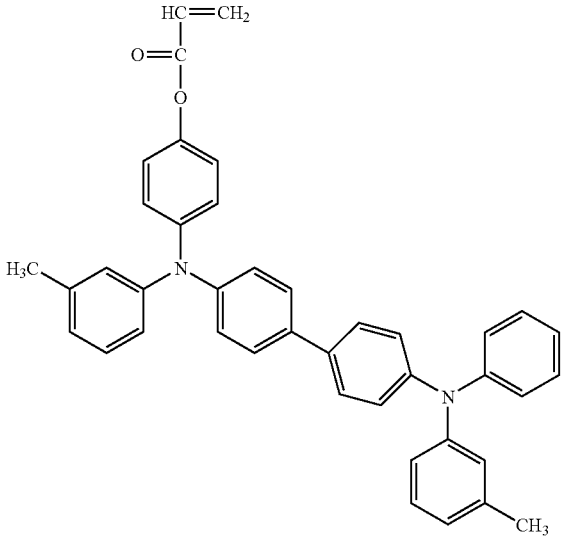

-continued
No. 51
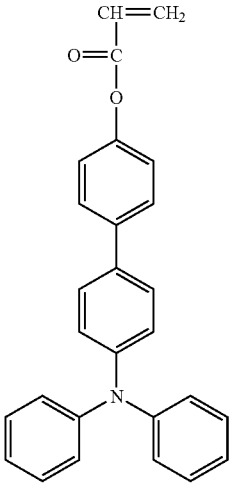
No. 52
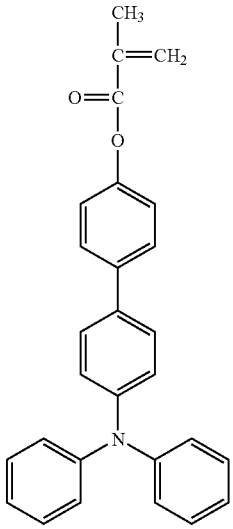
No. 53
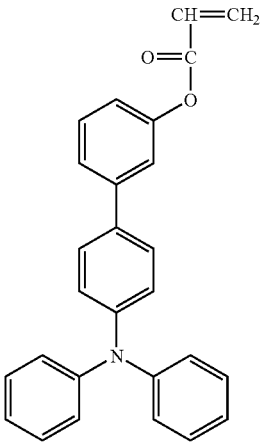
No. 54
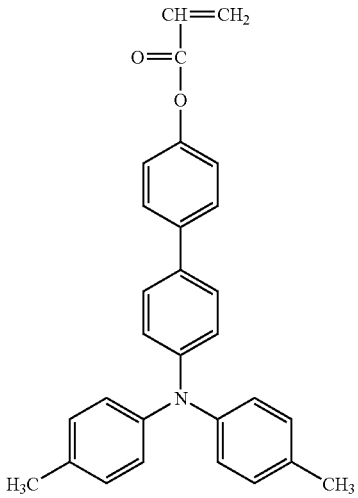
No. 55
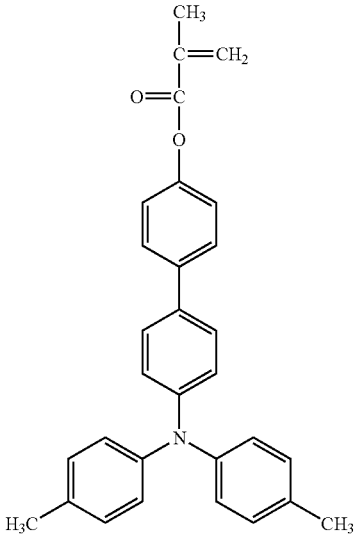
No. 56
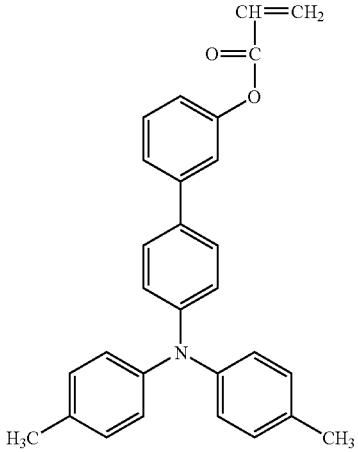

-continued
No. 57
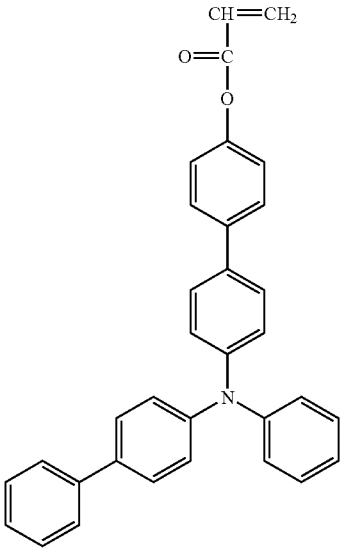
No. 58
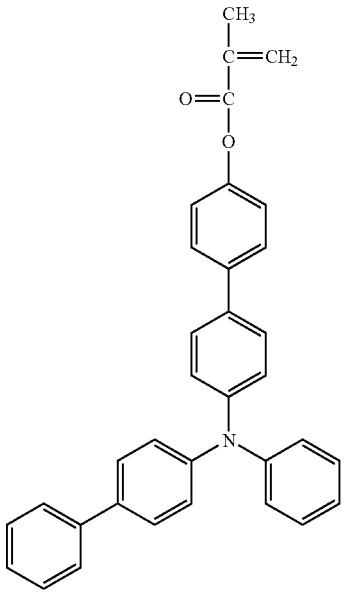
No. 59
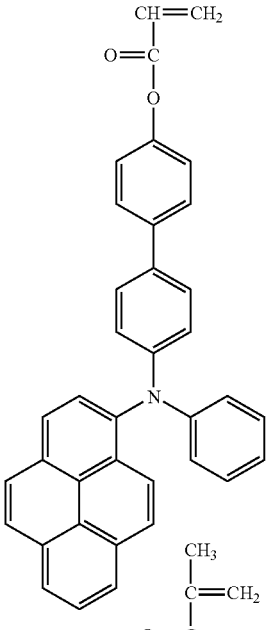
No. 60
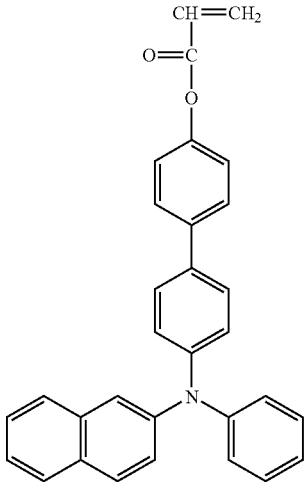
No. 61
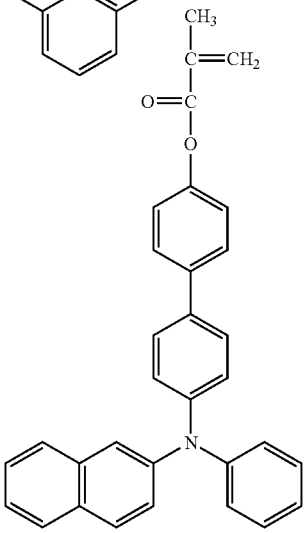
No. 62
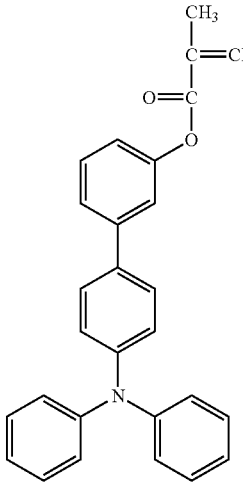

-continued
No. 63
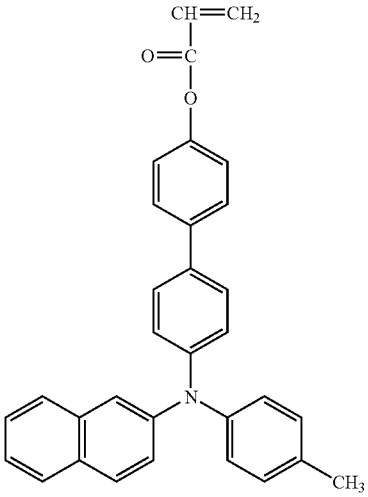
No. 64
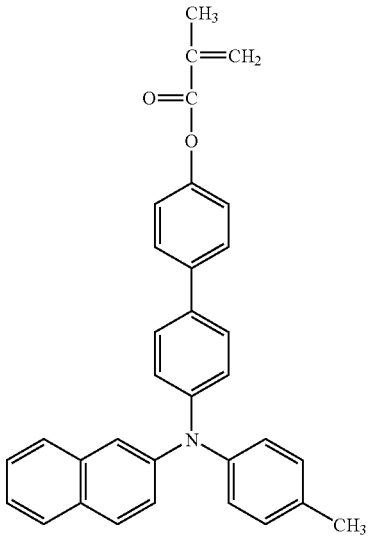
No. 65
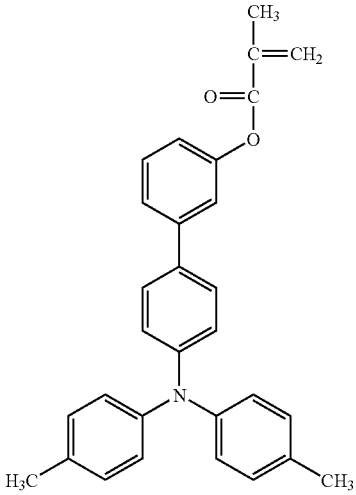
No. 66
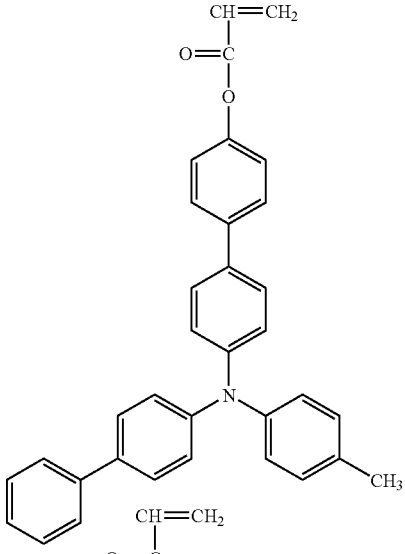
No. 67
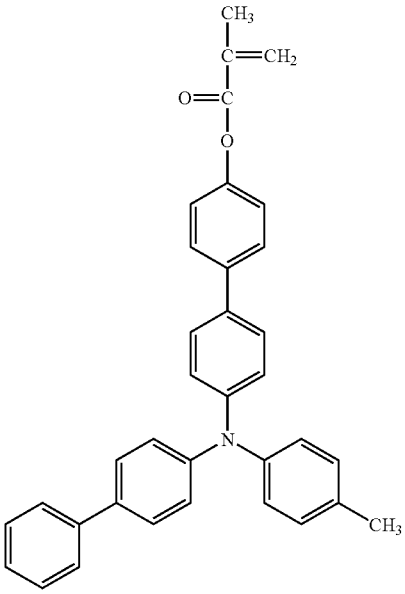
No. 68
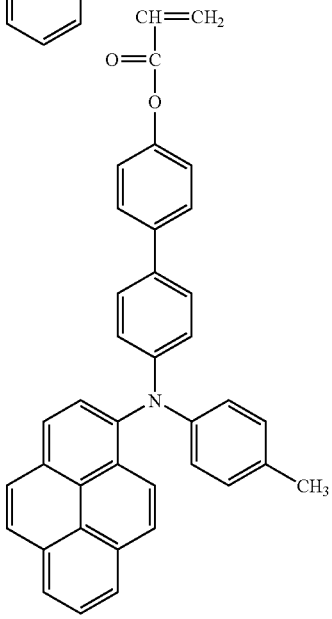

-continued
No. 69
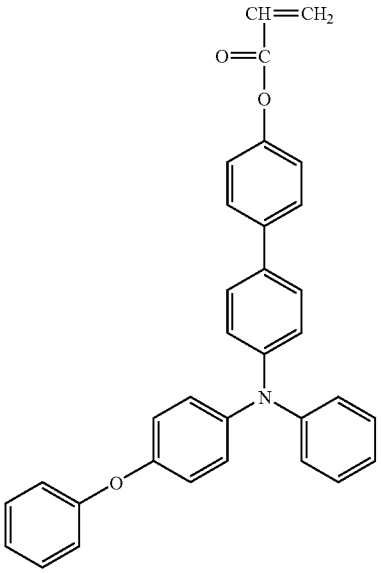
No. 70
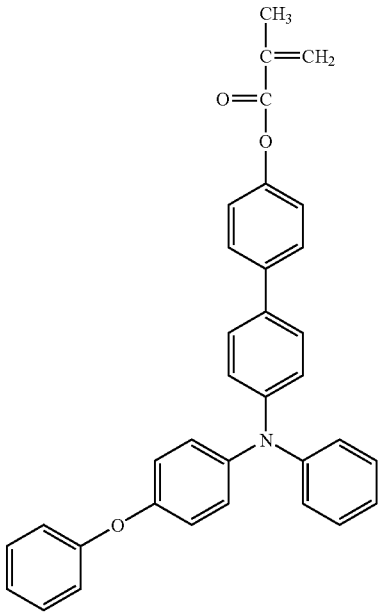
No. 71
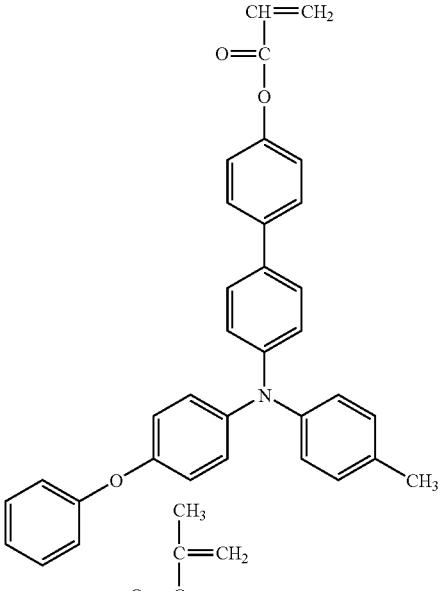
No. 72
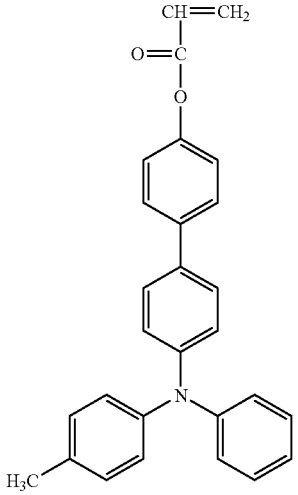
No. 73
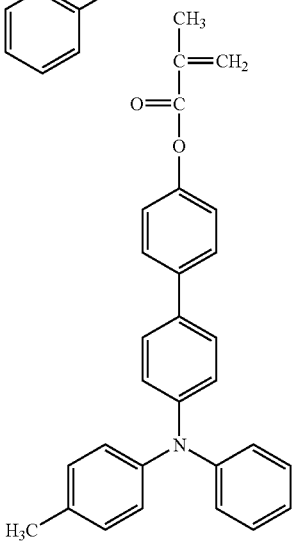
No. 74
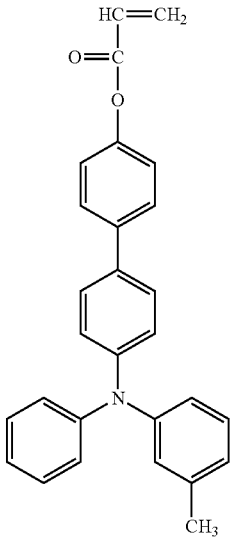

-continued
No. 75
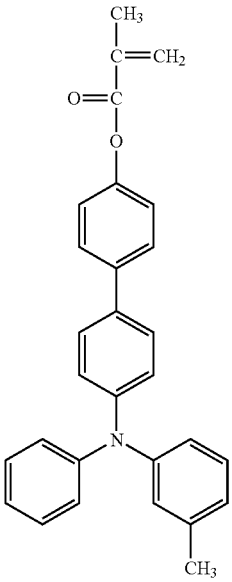
No. 76
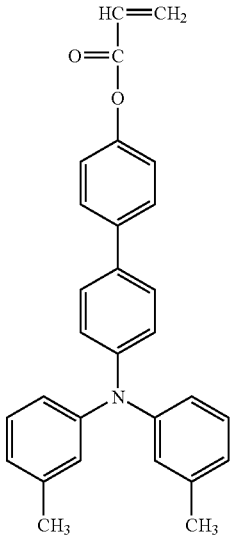
No. 77
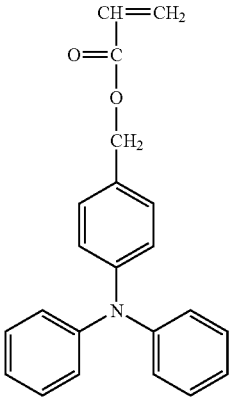
No. 78
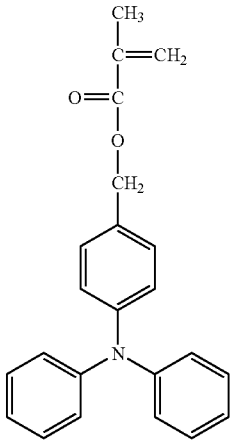
No. 79
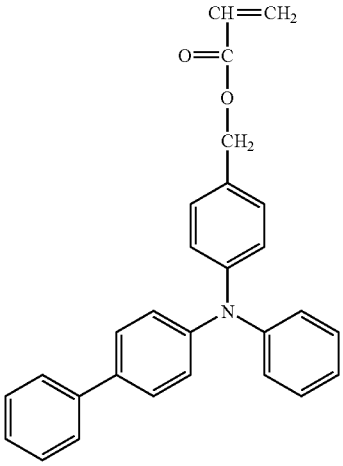
No. 80
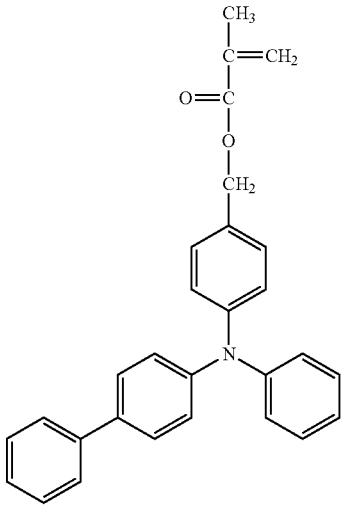

-continued
No. 81
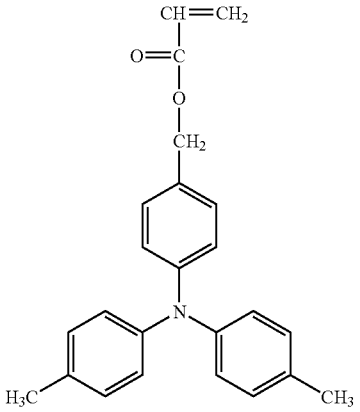
No. 82
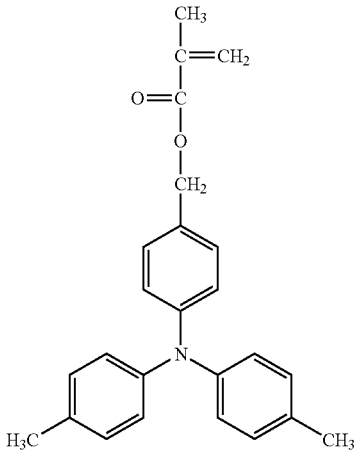
No. 83
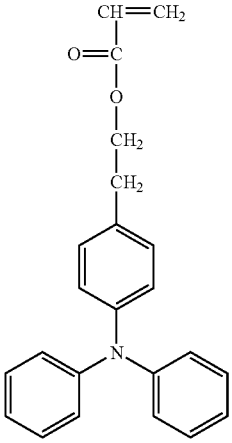
No. 84
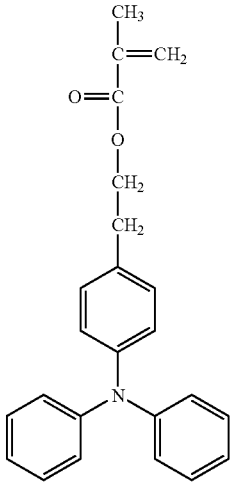
No. 85
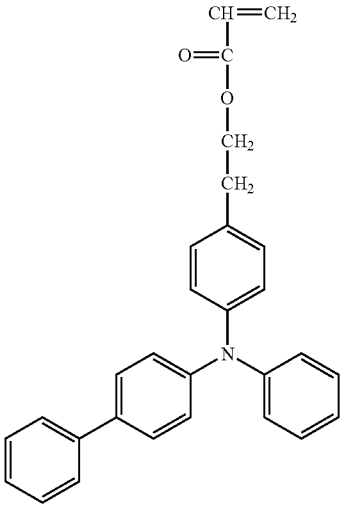
No. 86
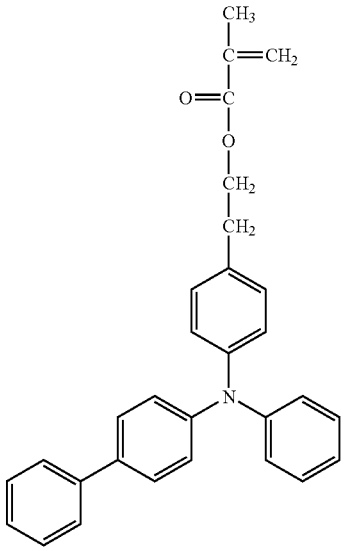

-continued
No. 87
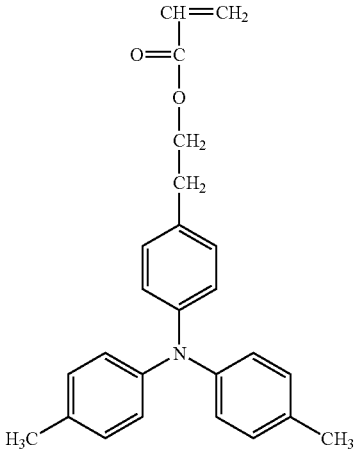
No. 88
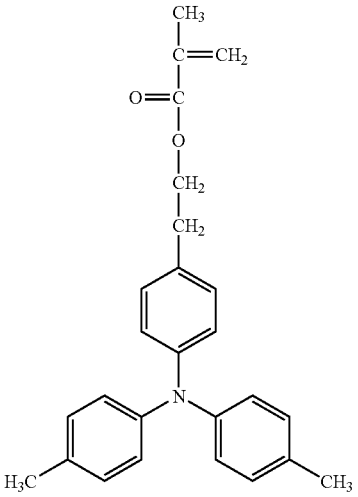
No. 89
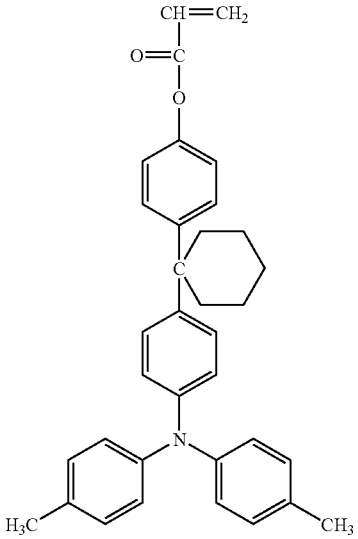
No. 90
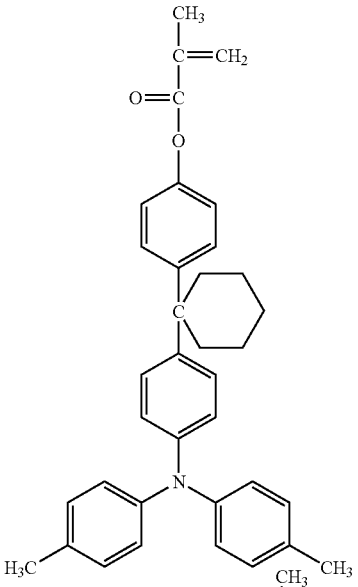
No. 91
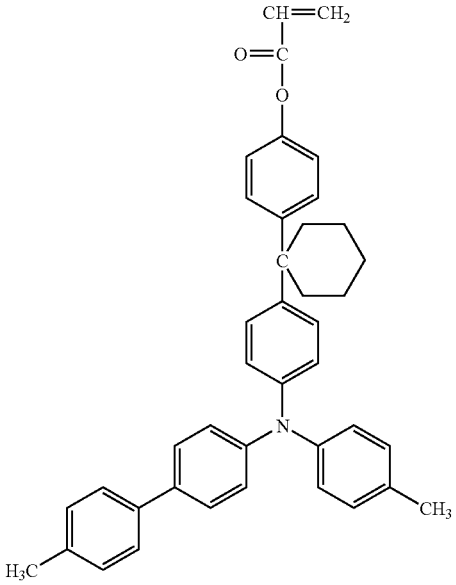
No. 92
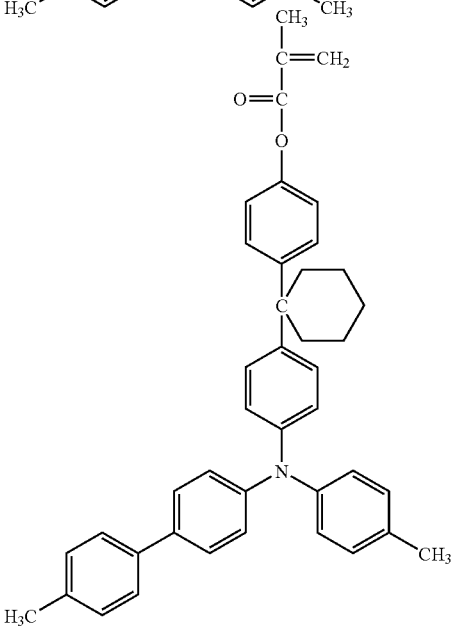

-continued
No. 93
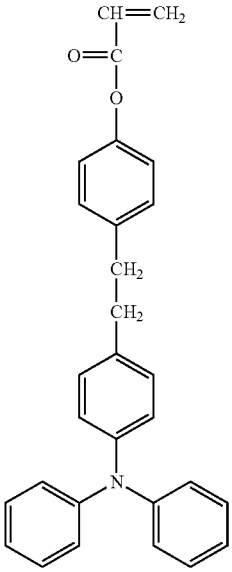
No. 94
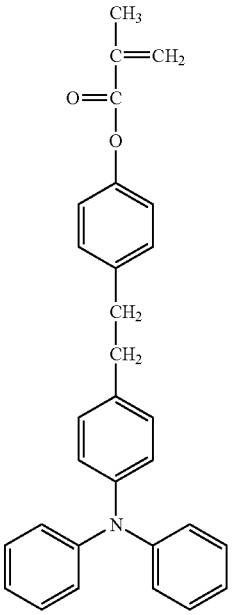
No. 95
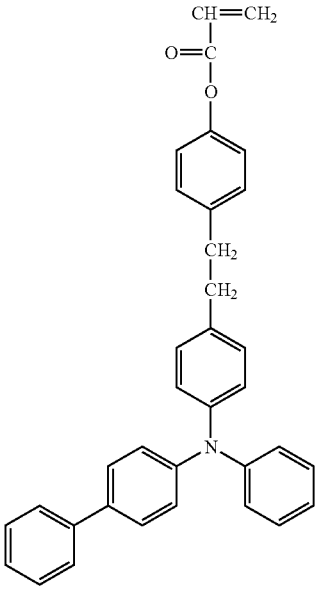
No. 96
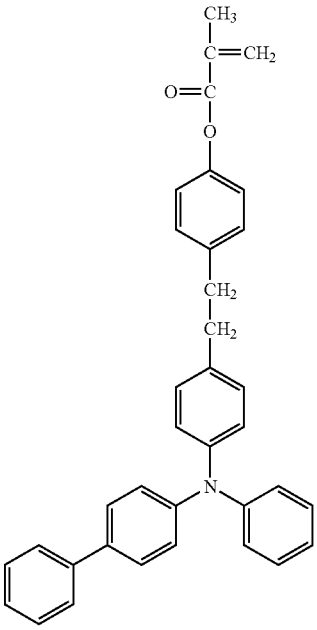

-continued
No. 97
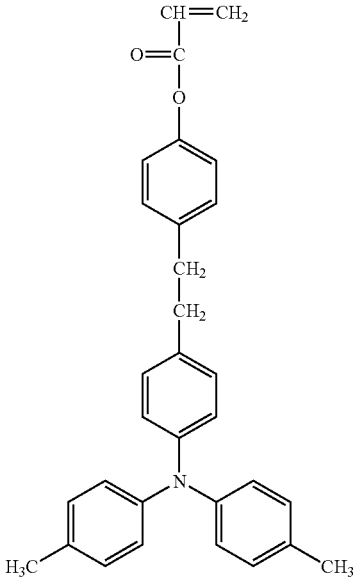
No. 98
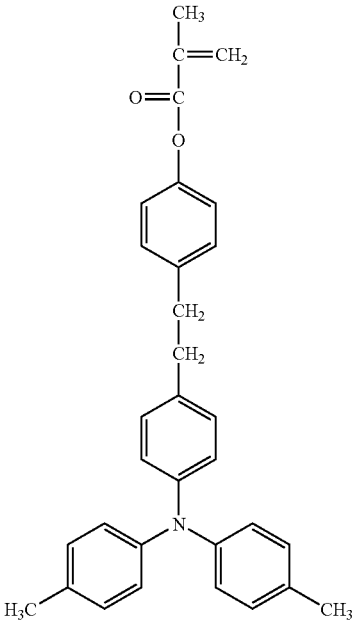
No. 99
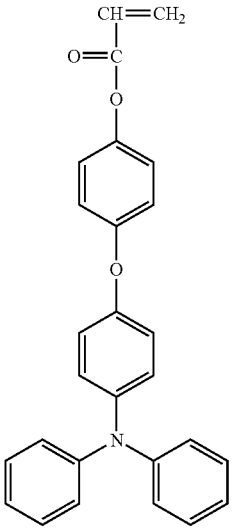
No. 100
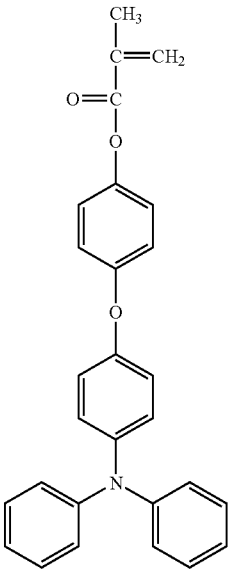

-continued
No. 101
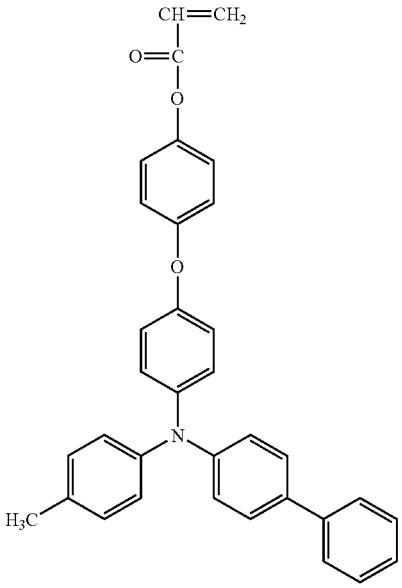
No. 102
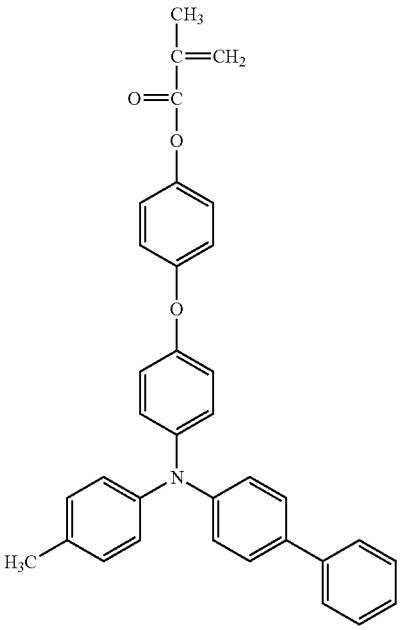
No. 103
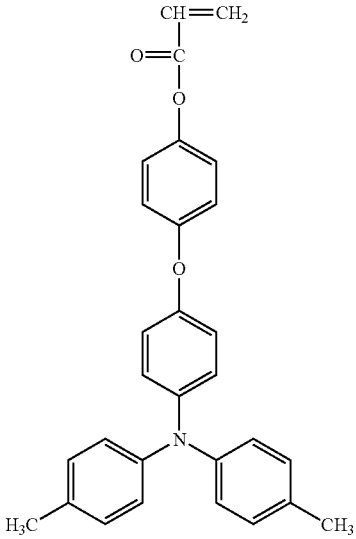
No. 104
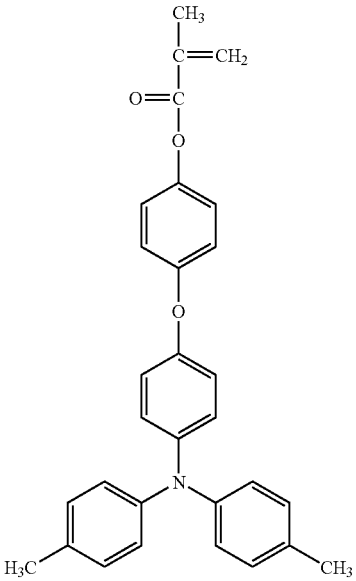

-continued
No. 105
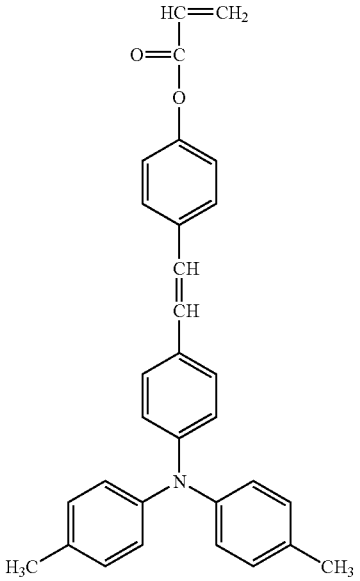
No. 106
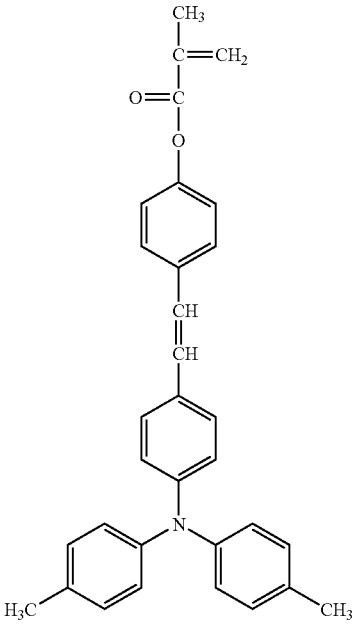
No. 107
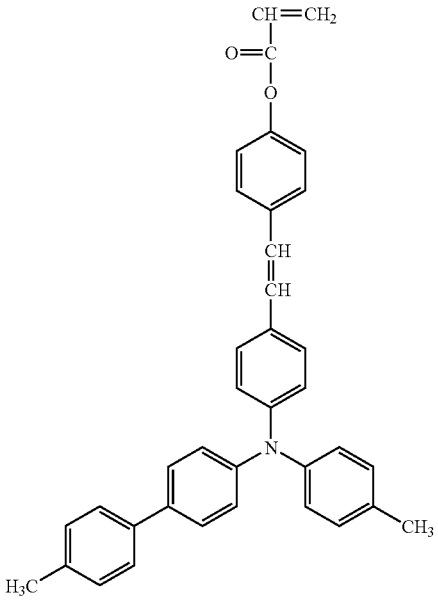
No. 108
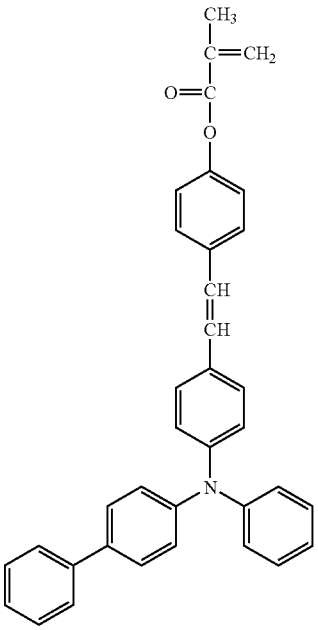

-continued
No. 109
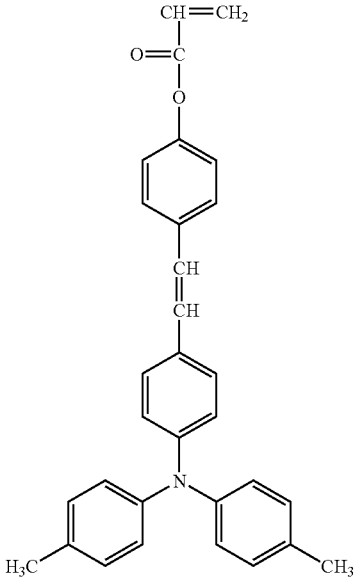
No. 110
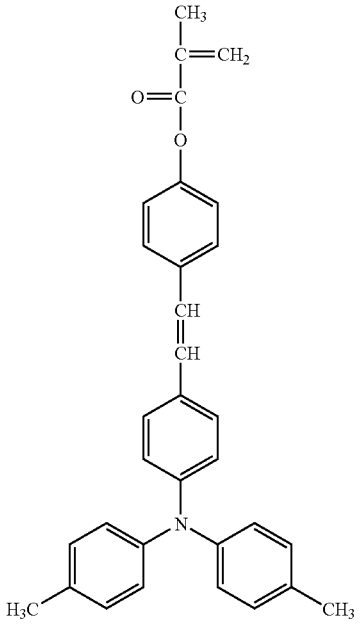
No. 111
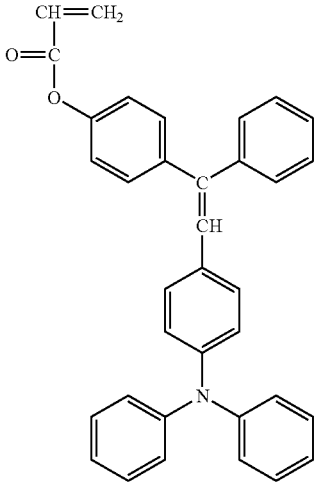
No. 112
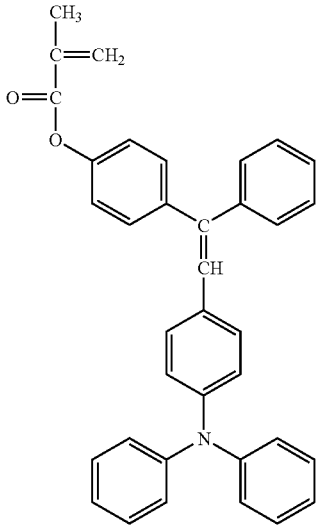

-continued
No. 113
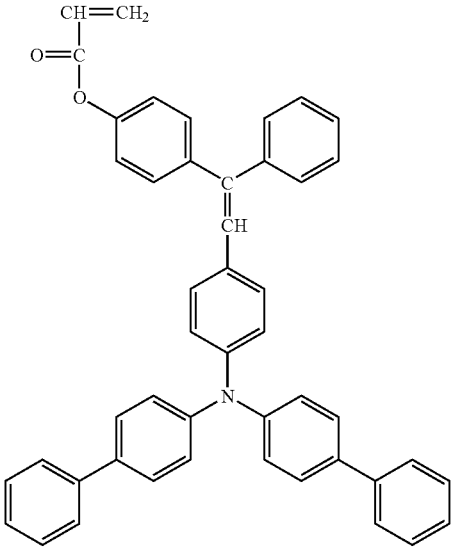
No. 114
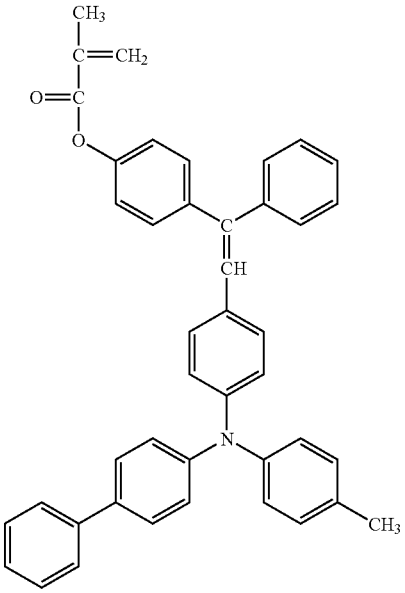
No. 115
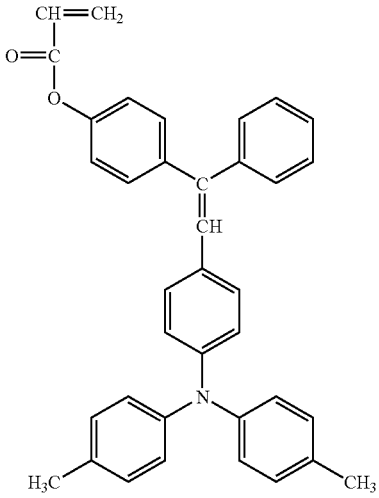
No. 116
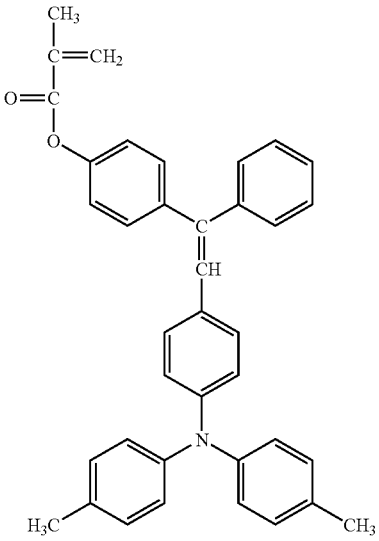

-continued
No. 117
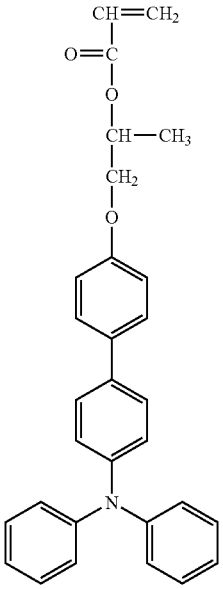
No. 118
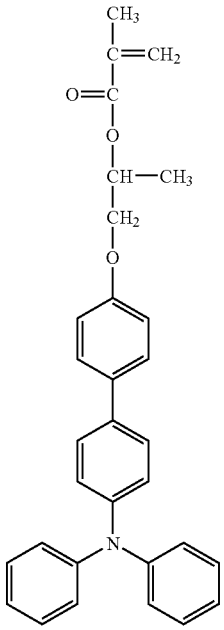
No. 119
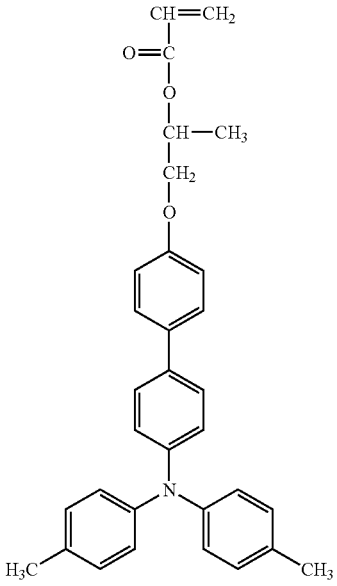
No. 120
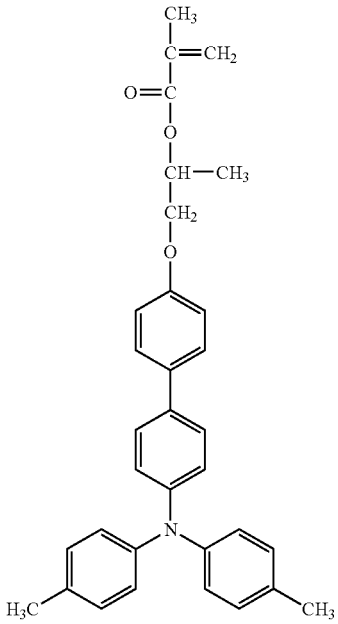

-continued
No. 121
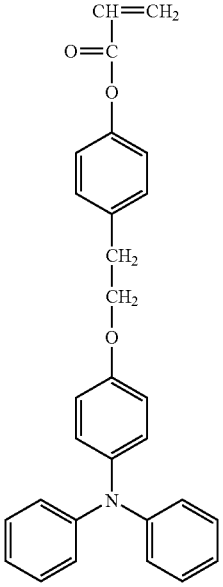
No. 122
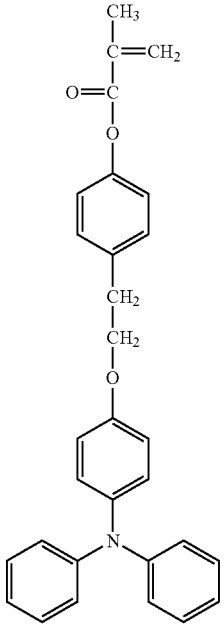
No. 123
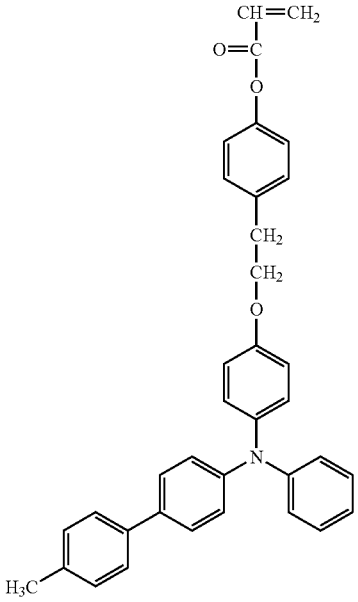
No. 124
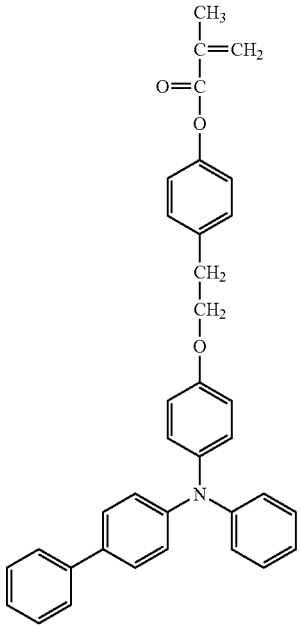

-continued
No. 125
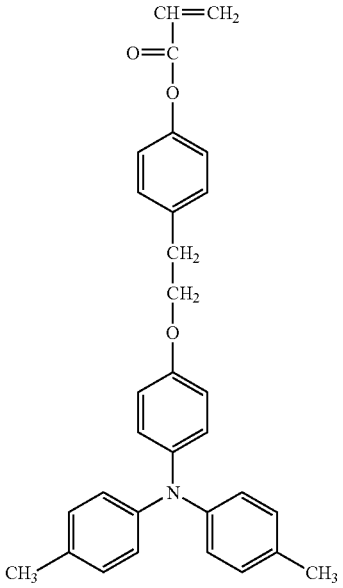
No. 126
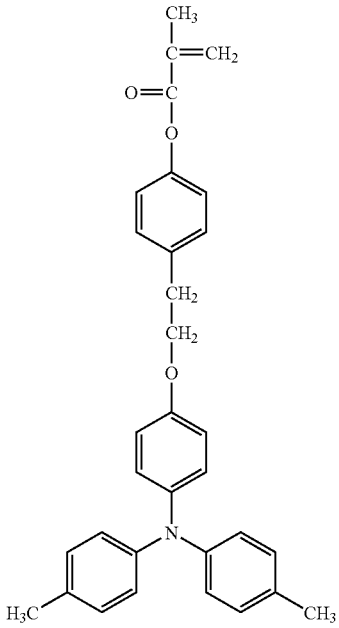
No. 127
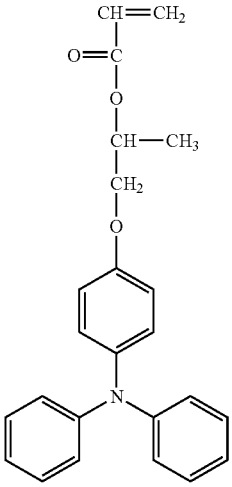
No. 128
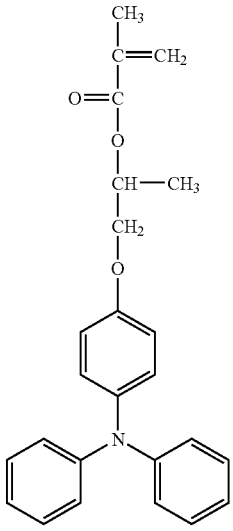

-continued
No. 129
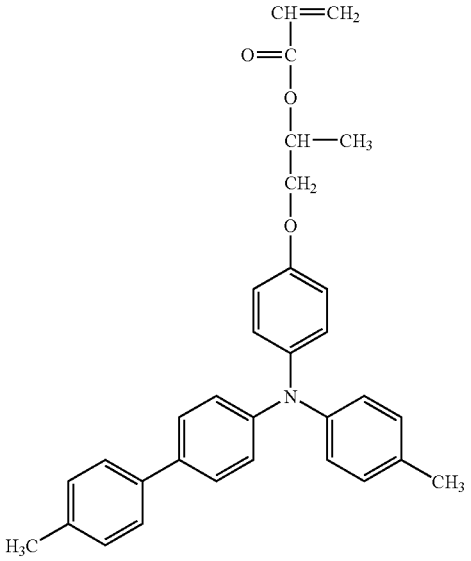
No. 130
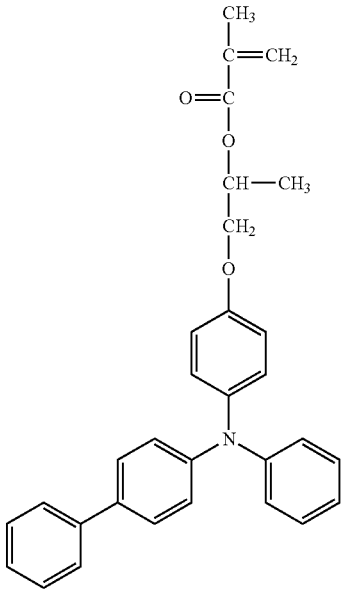
No. 131
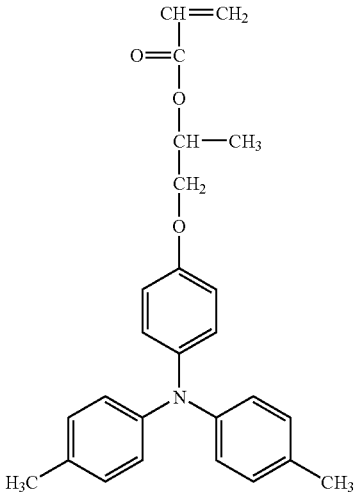
No. 132
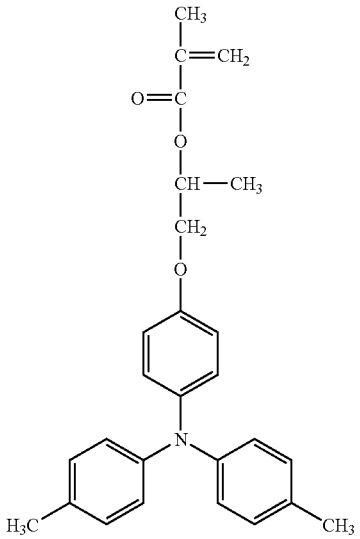
No. 133
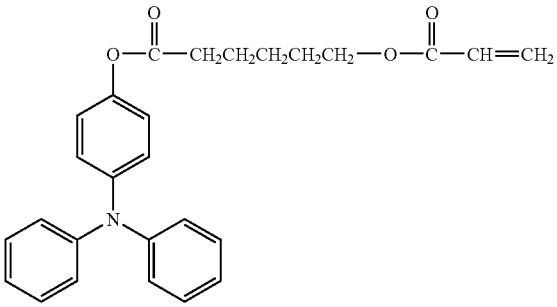
No. 134
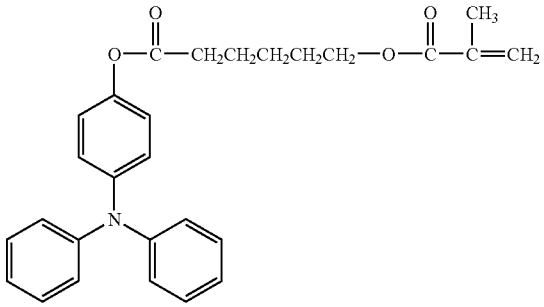

-continued
No. 135
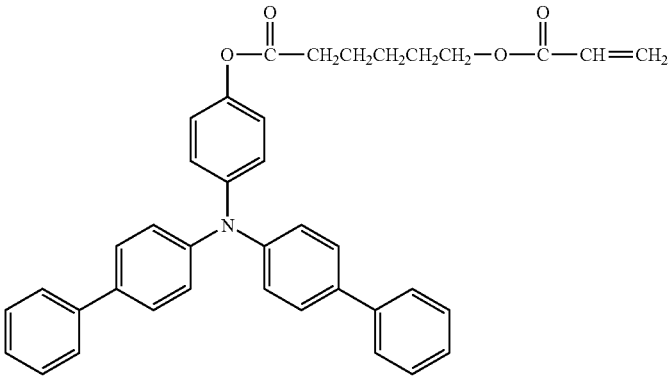
No. 136
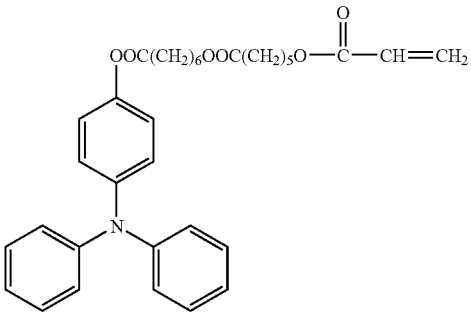
No. 137
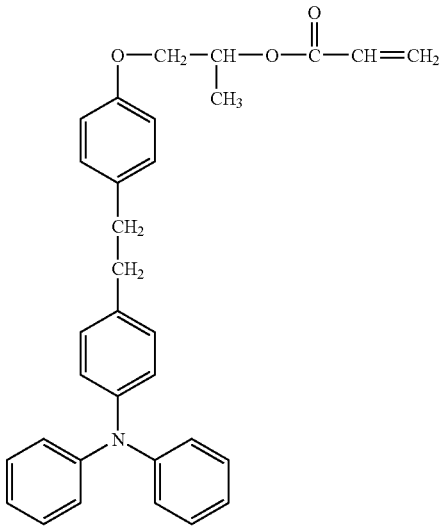
No. 138
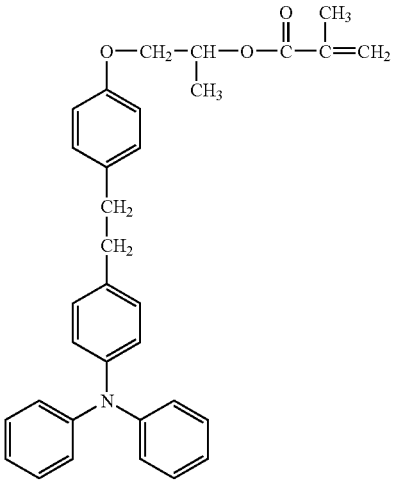
No. 139
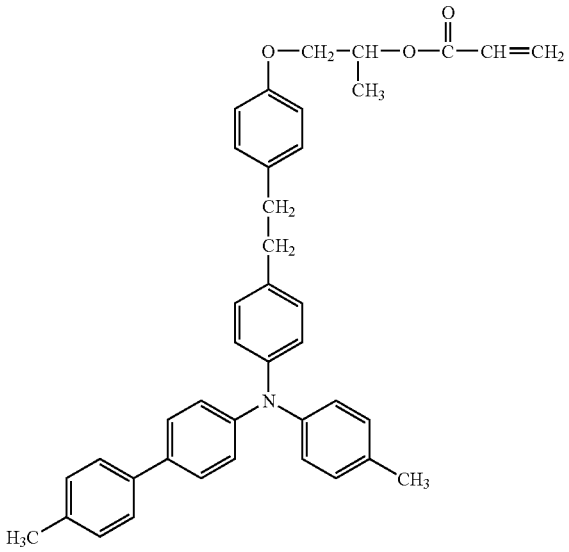

-continued
No. 140
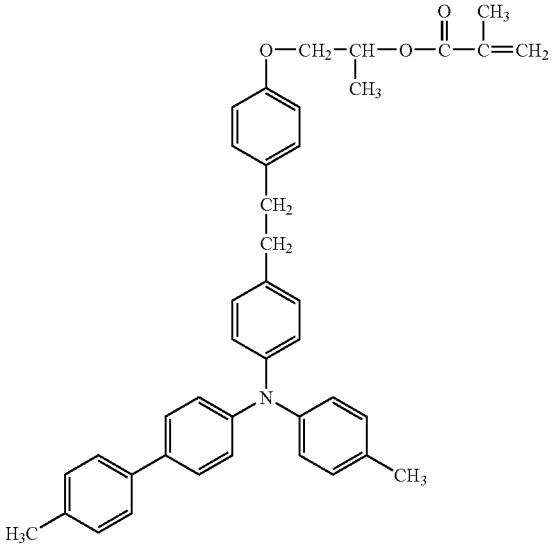
No. 141
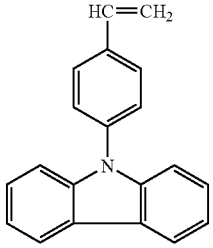
No. 142
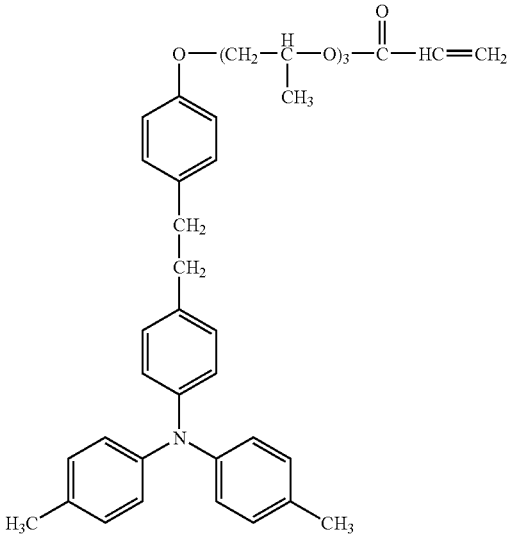
No. 143
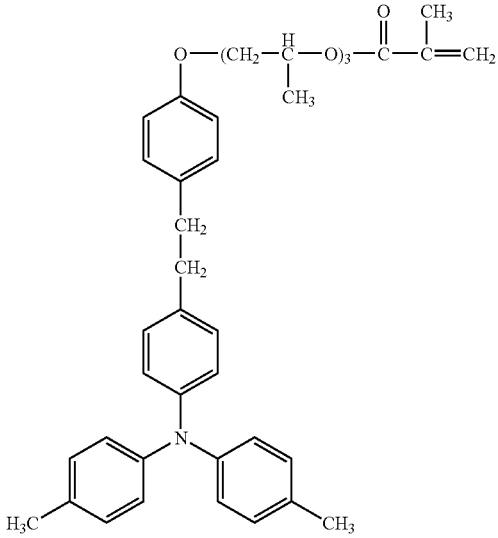
No. 144
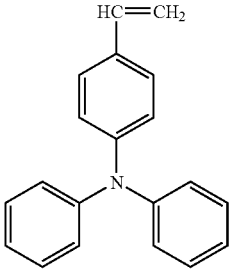
No. 145
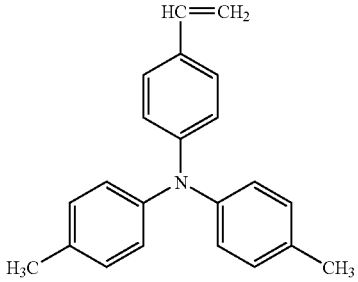

-continued
No. 146
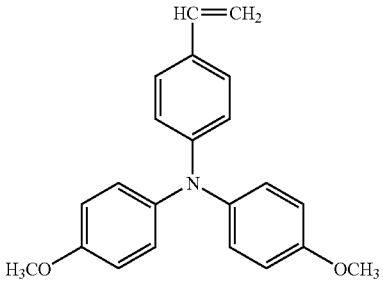
No. 147
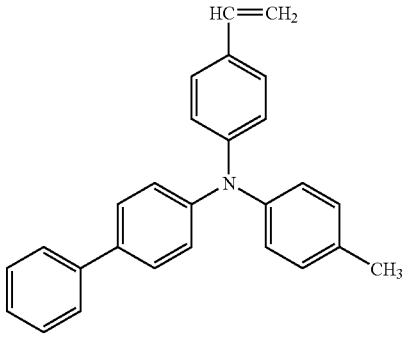
No. 148
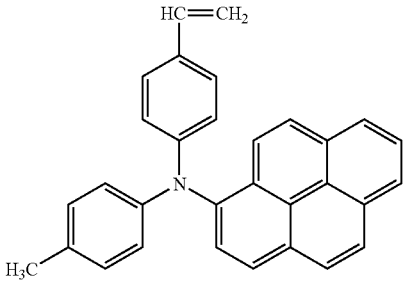
No. 149
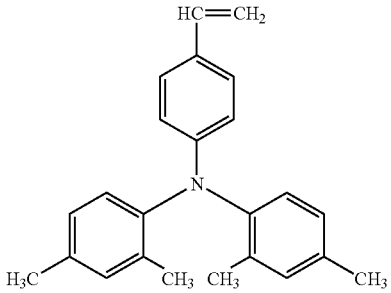
No. 150
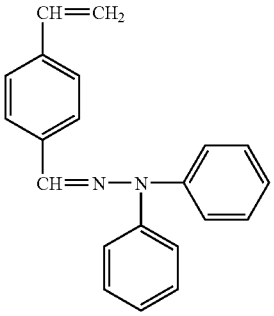
No. 151
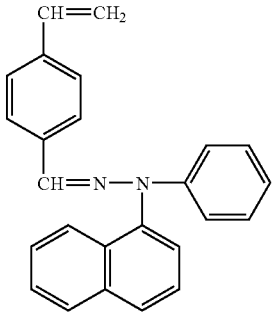
No. 152
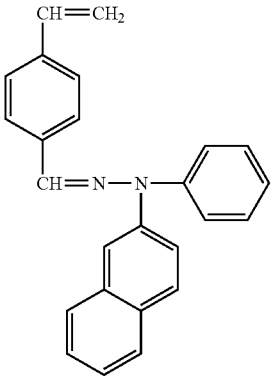
No. 153
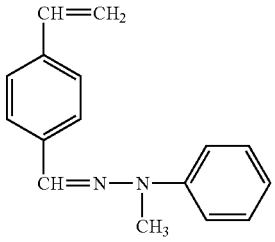
No. 154
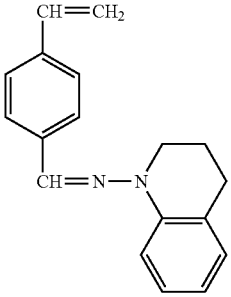
No. 155
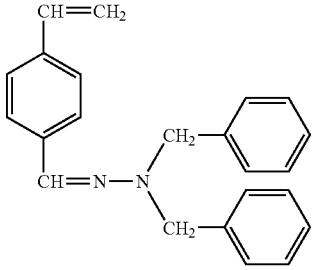

-continued
No. 156
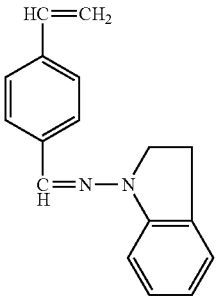
No. 157
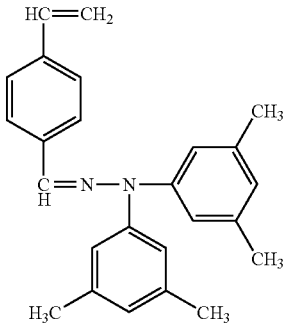
No. 158
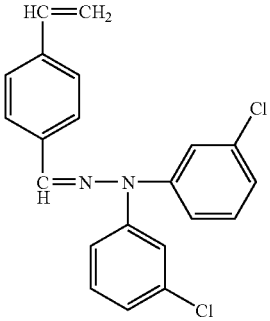
No. 159
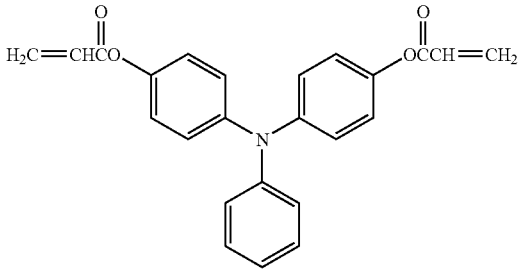
No. 160
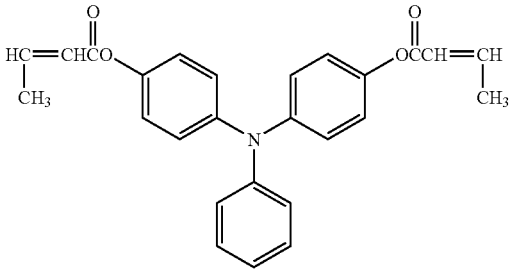
No. 161
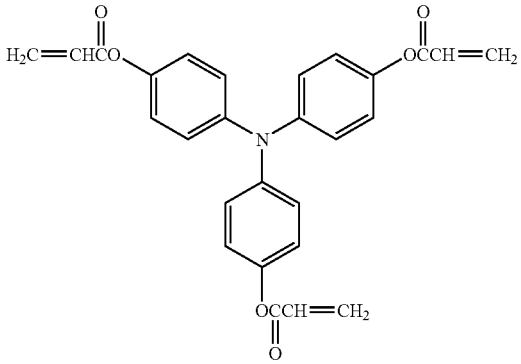
No. 162
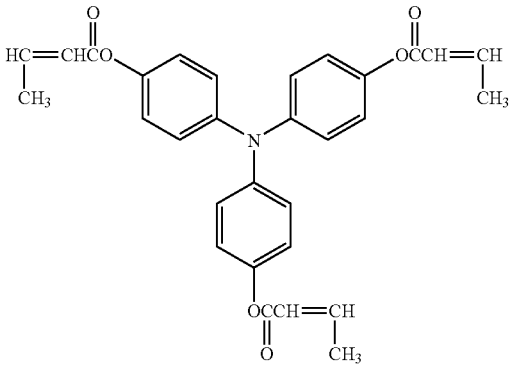
No. 163
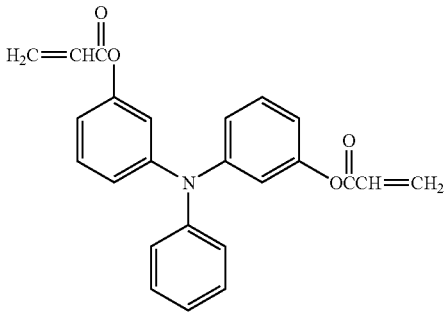

-continued
No. 164
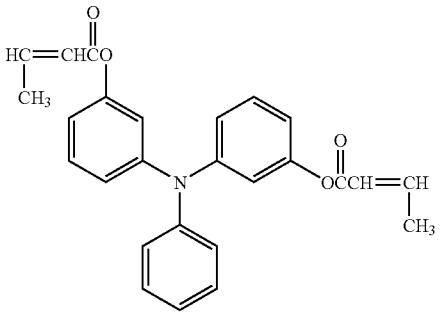
No. 165
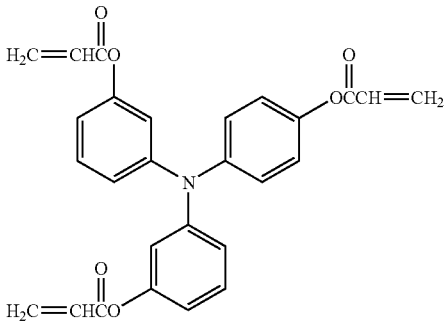
No. 166
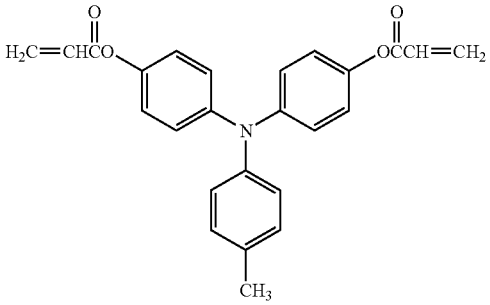
No. 167
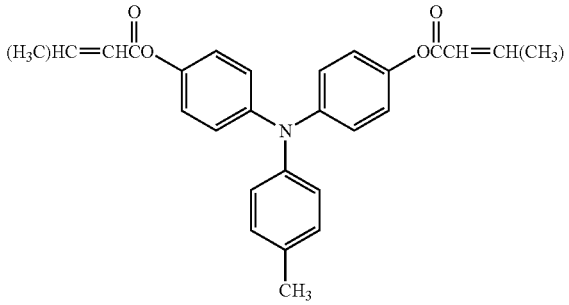
No. 168
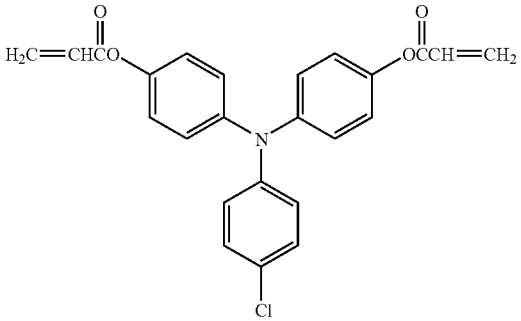
No. 169
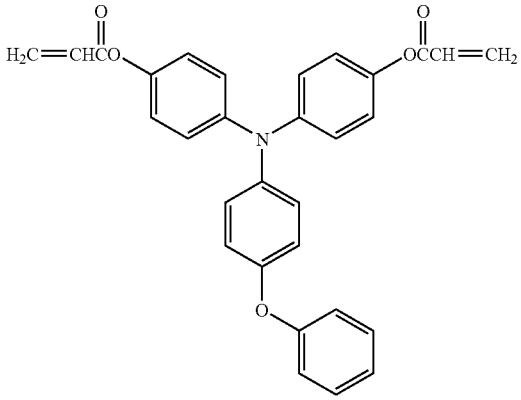
No. 170
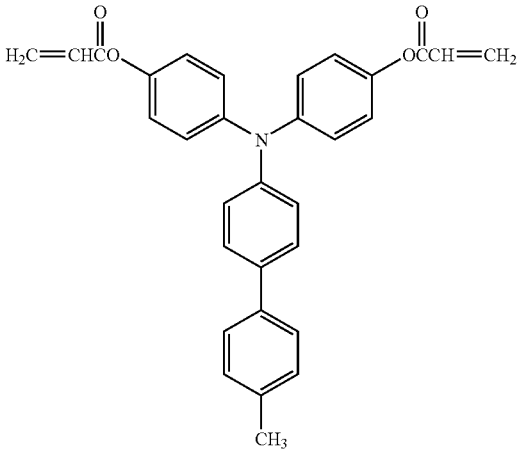
No. 171
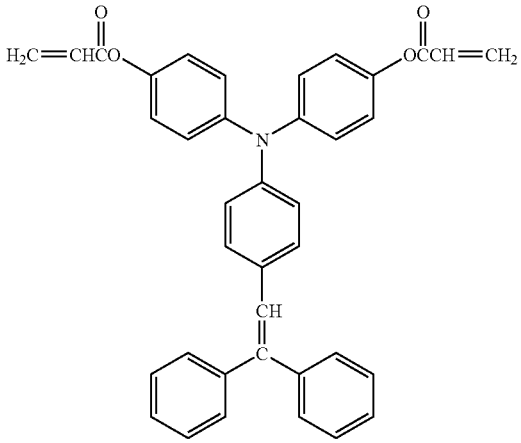

-continued
No. 172
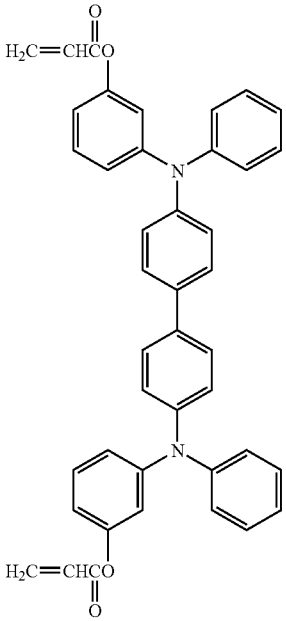
No. 173
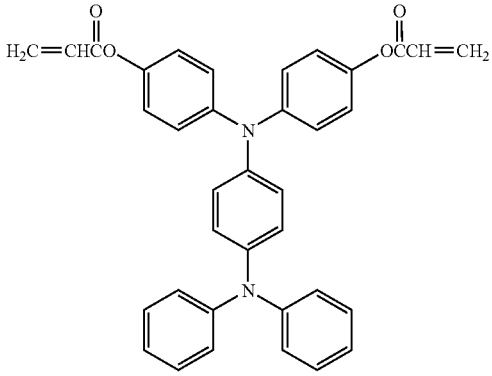
No. 174
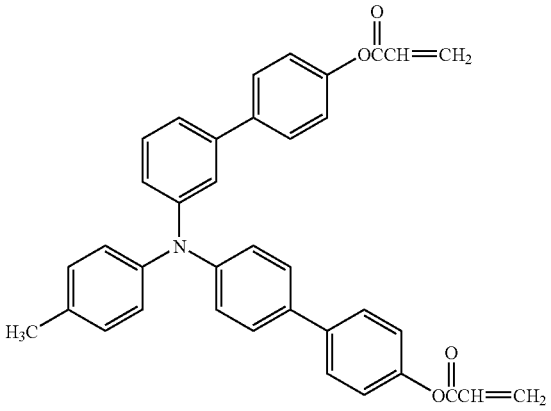
No. 175
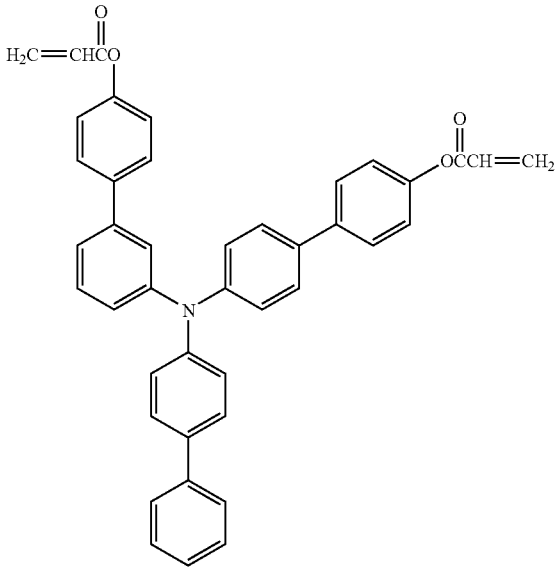
No. 176
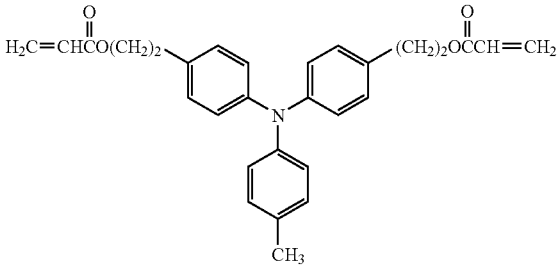
No. 177
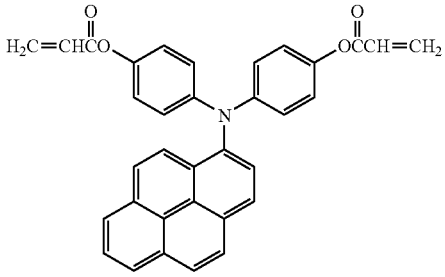

-continued
No. 178
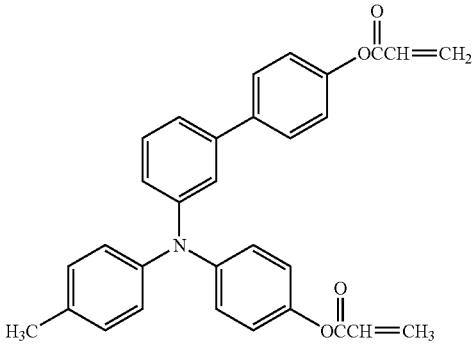
No. 179
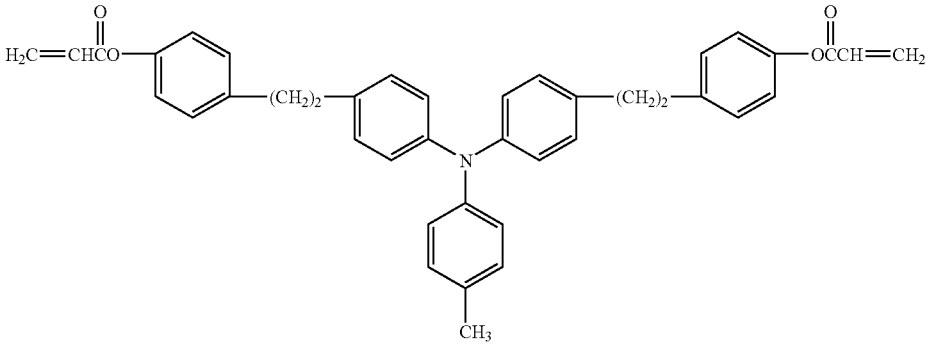
No. 180
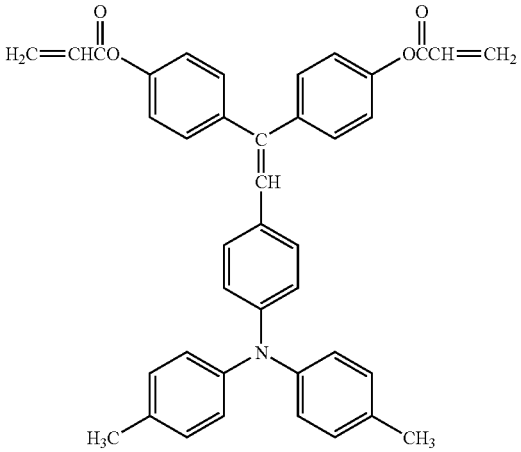
No. 181
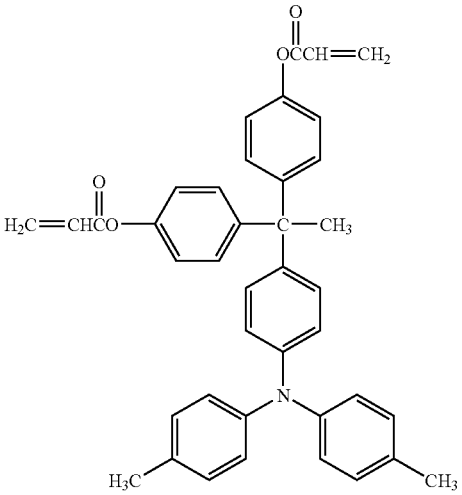

-continued

No. 182

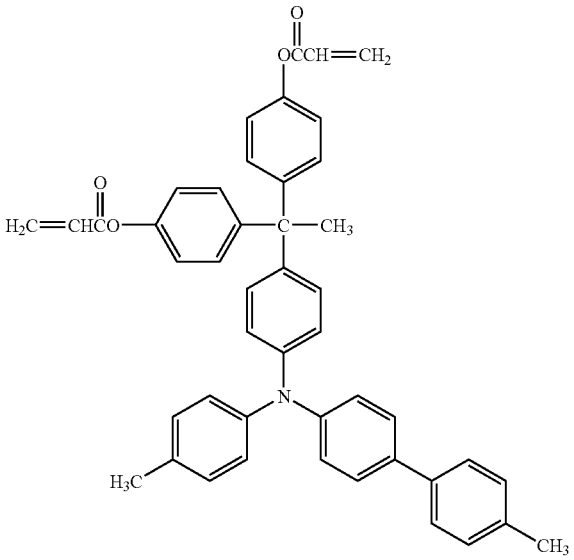

No. 183

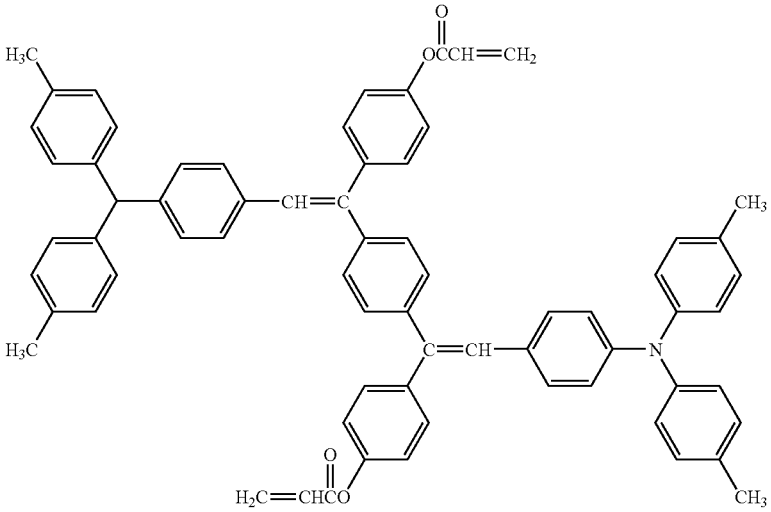

No. 184

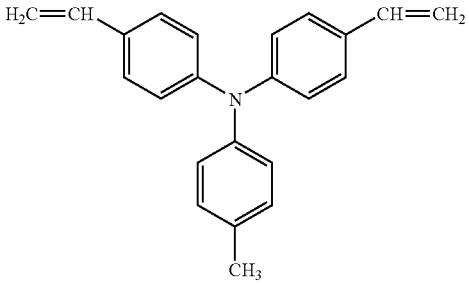

No. 185

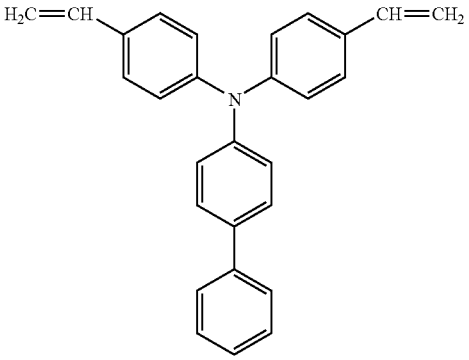

It is important to use a charge transport material having a radically polymerizable functional group for the protective layer in order to impart a charge transport property to the protective layer. The content of the unit obtained from such a charge transport material in the crosslinked protective layer is preferably from 20 to 80% by weight, and more preferably from 30 to 70% by weight based on the total weight of the protective layer. When the content is too low, the charge transport property of the layer is insufficient, thereby deteriorating the electric properties of the photoreceptor such as photosensitivity and residual potential. In contrast, when the content is too high, the content of the polyfunctional monomers having no charge transport structure decreases, resulting in decrease of crosslinking density, and therefore good abrasion resistance cannot be imparted to the protective layer. In order to balance the abrasion resistance and electric properties of the photoreceptor, the content of the unit obtained from the charge transport material having a radically polymerizable functional group in the protective layer is preferably from 30 to 70% by weight, although the preferable content changes depending on the image forming processes for which the photoreceptor is used.

In order to adjust viscosity of the coating liquid, relax the stress to the protective layer, and reduce the surface energy and friction coefficient, functional monomers and radically polymerizable oligomers can be added to the protective layer coating liquid. In this regard, known functional monomers and radically polymerizable oligomers can be used. Specific examples of the functional monomers include fluorine-containing acrylate monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70 which are described in JP-B 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl). Specific examples of the radically polymerizable oligomers include epoxyacryalte oligomers, urethane acrylate oligomers, polyester acrylate oligomers, etc.

The added amount of such monofunctional or difunctional monomers or oligomers is preferably not greater than 50 parts by weight, and more preferably not greater than 30 parts by weight, per 100 parts by weight of the protective layer. This is because when the added amount is too large, the crosslinking density decreases, and thereby the abrasion resistance of the resultant photoreceptor is deteriorated.

After the protective layer is crosslinked (preferably by being exposed to light), the protective layer is contacted with a supercritical or subcritical fluid including a charge transport material.

In order to enhance the crosslinking reaction efficiency, a polymerization initiator can be included in the protective layer coating liquid. Suitable polymerization initiators include thermal polymerization initiators and photopolymerization initiators.

Specific examples of the thermal polymerization initiators include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumenehydroperoxide, lauroyl peroxide, and 2,2-bis(4,4-di-t-butylperoxycyclohexy)propane; and azo type initiators such as azobisisobutyronitrile, azobiscyclohexanecarbonitrile, azobisbutyric acid methyl ester, hydrochloric acid salt of azobisisobutylamidine, and 4,4'-azobis-cyanovaleric acid.

Specific examples of the photopolymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc.

Photopolymerization accelerators can also be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

The added amount of the polymerization initiators is preferably from 0.5 to 40 parts by weight, and more preferably from 1 to 20 parts by weight, per 100 parts by weight of the total weight of the radically polymerizable monomers used.

In order to relax the stress of the crosslinked protective layer and to improve the adhesion of the protective layer to the photosensitive layer, the protective layer coating liquid can include additives such as plasticizers, leveling agent, and low molecular weight charge transport materials having no radical polymerizability.

Specific examples of the plasticizers include known plasticizers for use in general resins, such as dibutyl phthalate, and dioctyl phthalate. The added amount of the plasticizers in the protective layer coating liquid is preferably not greater than 20% by weight, and more preferably not greater than 10% by weight, based on the total solid components included in the coating liquid.

Specific examples of the leveling agents include silicone oils (such as dimethylsilicone oils, and methylphenylsilicone oils), and polymers and oligomers having a perfluoroalkyl group in their side chains. The added amount of the leveling agents is preferably not greater than 3% by weight based on the total solid components included in the coating liquid.

The crosslinked protective layer is typically prepared by coating a coating liquid including at least a radically polymerizable monomer having no charge transport structure on the photosensitive layer 43 or the CTL 47, and then crosslinking (preferably photocrosslinking) the coated layer. Further, the crosslinked protective layer is contacted with a supercritical or subcritical fluid including a CTM. When the radically polymerizable monomer is liquid, it is possible to dissolve other components in the monomers, to prepare the protective layer coating liquid. In this regard, the coating liquid can optionally include a solvent to well dissolve the other components and/or to reduce the viscosity of the coating liquid.

Specific examples of the solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination.

The added amount of the solvents is determined depending on the solubility of the solid components, the coating method used, and the target thickness of the protective layer. Coating methods such as dip coating methods, spray coating methods, bead coating methods, and ring coating methods can be used for forming the protective layer.

After coating a protective layer coating liquid, energy such as heat energy, photo energy and radiation energy is applied to the coated layer to crosslink the protective layer. Among the crosslinking methods, photocrosslinking methods are preferably used.

Specific examples of the light source for use in photocrosslinking the coated layer include ultraviolet light emitting devices such as high pressure mercury lamps and metal halide lamps. In addition, visible light emitting lamps can also be used if the radically polymerizable monomers and the photopolymerization initiators used have absorption in a visible region. The illuminance intensity is preferably not less than 50 mW/cm$^2$, more preferably not less than 500 mW/cm$^2$, and even more preferably not less than 1,000 mW/cm$^2$. By using light having an illuminance intensity of not less than 1,000 mW/cm$^2$, the polymerization speed can be dramatically enhanced and it is possible to prepare a protective layer, the entire of which is uniformly crosslinked. In this regard, it is important to control the variation in illuminance intensity of light irradiating the protective layer so that the minimum illuminance intensity is at least 70%, preferably 80% and more preferably 90% of the maximum illuminance intensity.

Next, the image forming method and apparatus will be explained by reference to drawings.

Figure 4:
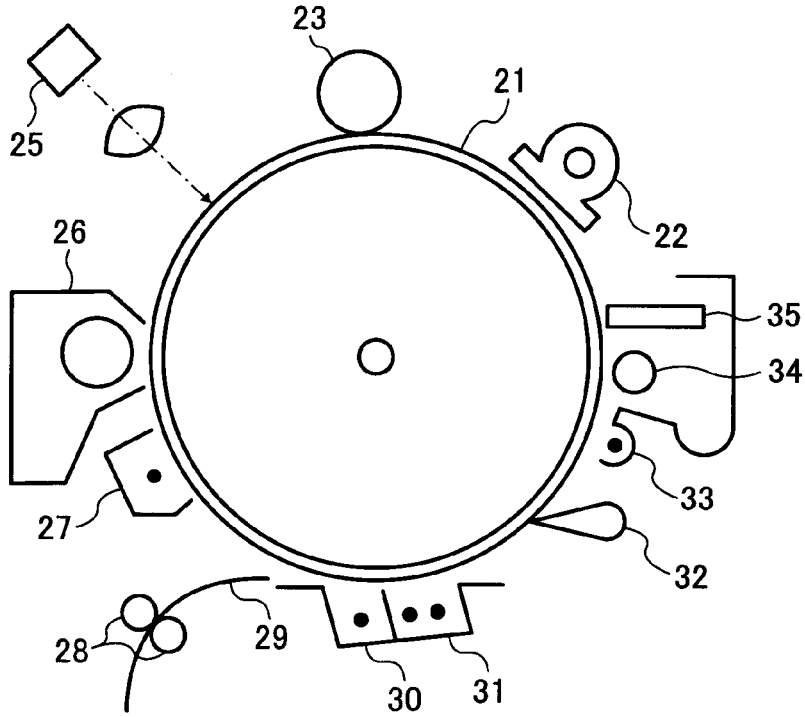
FIG. 4 is a schematic view illustrating an example of the image forming apparatus of the present invention.

FIG. 4 is a schematic view illustrating a main portion of an example of the image forming apparatus of the present invention.

The image forming apparatus includes a photoreceptor 21. The photoreceptor 21 is the photoreceptor of the present invention, which includes an electroconductive substrate, and a photosensitive layer and a protective layer, which are overlaid overlying the electroconductive substrate.

The photoreceptor has a cylindrical form, but can have a sheet-form of an endless belt-form.

Around the photoreceptor 21, a quenching lamp (a discharger) 22 configured to discharge the charges remaining on the photoreceptor 21, a charger 23 configured to charge the photoreceptor 21, an imagewise light irradiator 25 (serving as a latent image forming device) configured to irradiate the photoreceptor 21 with imagewise light to form an electrostatic latent image on the photoreceptor 21, a developing device 26 configured to develop the latent image with a developer including a toner to form a toner image on the photoreceptor 21, and a cleaning unit including a cleaning brush 34 and a cleaning blade 35 configured to clean the surface of the photoreceptor 21 are arranged while contacting or being set closely to the photoreceptor 21. The toner image formed on the photoreceptor 21 is transferred on a receiving material 29, which is fed by a pair of registration rollers 28, by a transfer device (i.e., a combination of a transfer charger 30 and a separating charger 31). The receiving material 29 bearing the toner image thereon is separated from the photoreceptor 21 by a separating pick 32.

In the image forming apparatus of the present invention, a pre-transfer charger 27 and a pre-cleaning charger 33 can be arranged if desired.

Specific examples of the charger 23, the pre-transfer charger 27, the transfer charger 30, the separating charger 31 and the pre-cleaning charger 33 include any known chargers such as corotrons, scorotrons, solid state chargers, roller chargers and brush chargers.

Among the charging devices, contact chargers such as charging rollers, charging blades and charging brushes and short-range chargers which charge a photoreceptor while a small gap is formed between the charging member and the photoreceptor can be preferably used. In particular, by using contact chargers, the amount of generated ozone can be drastically reduced, and therefore the photoreceptor can be maintained to be stable and deterioration of image qualities can be prevented even when the photoreceptor is repeatedly used. In addition, the image forming apparatus can be minimized in size.

Among the contact chargers, charging rollers and charging brushes can be preferably used in the present invention.

In the short-range chargers for use in the image forming apparatus of the present invention, the gap between the charging member and the photoreceptor is about 200 μm, and therefore the short-range chargers are different from known non-contact chargers such as corotrons and scorotrons. Any gap forming mechanisms which can maintain such a small gap between the surface of the charging member and the surface of the photoreceptor to be charged, can be used for the short-range chargers for use in the image forming apparatus of the present invention. For example, mechanisms having a constitution such that a proper gap is formed between the surface of the photoreceptor and the surface of the charging member by mechanically fixing the rotation shaft of the photoreceptor to the rotation shaft of the charging member can be used. Among these mechanisms, the following is preferable:

(1) A charger having a gap forming member on both sides thereof is provided. The gap forming members contact the non-image areas of the photoreceptor to form a proper gap therebetween; and (2) Gap forming members are provided on the non-image areas of the photoreceptor. The image forming members contact the non-image forming areas of a charger to form a proper gap therebetween.

In particular, short-range chargers disclosed in JP-As. 2002-148904 and 2002-148905, incorporated herein by reference are preferably used in the image forming apparatus of the present invention.

Figure 5:
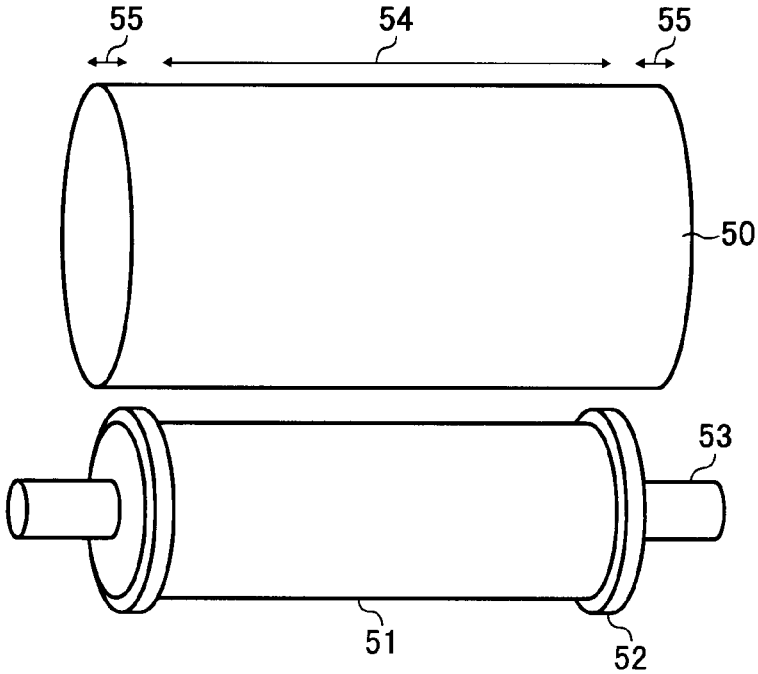
FIG. 5 is a schematic view illustrating a short range charging device for use in the image forming apparatus.

FIG. 5 is a schematic view illustrating an embodiment of the short-range charger for use in the image forming apparatus of the present invention, in which a gap forming member is formed on a charger. Referring to FIG. 5, numerals 50 and 51 designate the photoreceptor and charging roller, respectively. Numerals 52, 53, 54 and 55 designate a gap forming member, a metal shaft of the charging roller, an image forming area of the photoreceptor 21, and non-image areas of the photoreceptor 21, respectively. The gap forming members 52 contact the non-image areas 55 of the photoreceptor 21 to form a gap between the image forming area 54 and the charging area of the charging roller 51.

The above-mentioned short-range charger has the following advantages:

(1) the charge efficiency is high;

(2) the amount of ozone generated during charging is little;

(3) the image forming apparatus can be minimized in size;

(4) the charger is hardly contaminated by the toner used or the like materials; and (5) the surface of the photoreceptor is hardly abraded.

In addition, it is preferable for the charger to apply a DC voltage overlapped with an AC voltage to avoid uneven charging.

When such contact chargers and short-range chargers are used, dielectric break down of the photoreceptor tends to occur. However, the photoreceptor of the present invention has good resistance to break down. This is because the photoreceptor has the intermediate layer (such as the charge blocking layer and the moiré preventing layer), and in addition the photosensitive layer thereof includes no coarse particles of charge generation materials. Therefore, the contact chargers and short-range chargers can be used without causing any problems such as the uneven charging problem mentioned above and the dielectric breakdown problem.

Thus, the photoreceptor is charged with the charger. In conventional image forming apparatus, the photoreceptors are charged so as to have a relatively low electric field strength (e.g., not higher than 40 V/μm, preferably not higher than 30 V/μm) to avoid the background development problem due to the photoreceptor. Namely, when the electric field strength of a photoreceptor increases, the probability that images produced by the photoreceptor have background development increases. However, when the electric field strength is decreased, the photo-carrier generating efficiency is also decreased, resulting in deterioration of photosensitivity of the photoreceptor. Additionally, in this case the strength of the electric field formed between the surface of the photoreceptor and the electroconductive substrate thereof is decreased, and therefore the photo-carriers generated in the photosensitive layer cannot move straight, and scatter due to coulomb repulsion, resulting in deterioration of resolution of the electrostatic latent images formed on the photoreceptor. When the photoreceptor of the present invention is used, the probability of occurrence of the background development problem can be extremely decreased. Therefore, it is not necessary to decrease the electric field strength more than necessary, and the photoreceptor can be used at an electric field strength of not greater than 40 V/μm. Therefore, photo-decaying of the photoreceptor can be well performed under such conditions, and the resultant electrostatic latent images can be well developed with wide margin. Therefore, the electrostatic latent images can be developed without deteriorating the resolution thereof.

Light sources with high intensity such as light emitting diodes (LEDs), laser diodes (LDs) and electroluminescent lamps (EL) can be used for the imagewise light irradiator 25. Suitable light sources for use in the quenching lamp 22 include fluorescent lamps, tungsten lamps, halogen lamps, mercury lamps, sodium lamps, light emitting diodes (LEDs), laser diodes (LDs), light sources using electroluminescent lamps (EL), and the like. In addition, in order to obtain light having a desired wave length range, filters such as sharp-cut filters, band pass filters, near-infrared cutting filters, dichroic filters, interference filters, color temperature converting filters and the like can be used.

Among these light sources, LEDs, and LDs are preferably used because of emitting a high energy light beam having a wavelength of from 600 nm to 800 nm, to which the titanyl phthalocyanine pigment in the charge generation layer has high sensitivity.

The above-mentioned lamps can be used for not only the processes mentioned above and illustrated in FIG. 4, but also other processes using light irradiation, such as a transfer process including light irradiation, a discharging process, a cleaning process including light irradiation and a pre-exposure process.

Referring to FIG. 4, when the toner image formed on the photoreceptor 21 by the developing device 26 is transferred onto the receiving material 29, all of the toner particles of the toner image are not transferred on the receiving material 29, and some toner particles remain on the surface of the photoreceptor 21. The residual toner particles are removed from the photoreceptor 21 by the fur blush 34 or the cleaning blade 35. The residual toner particles remaining on the photoreceptor 21 can be removed by only a cleaning brush. Suitable cleaning blushes include known cleaning blushes such as fur blushes and mag-fur blushes.

When the photoreceptor 21 which is previously charged positively (or negatively) is exposed to imagewise light, an electrostatic latent image having a positive (or negative) charge is formed on the photoreceptor 21. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 6:
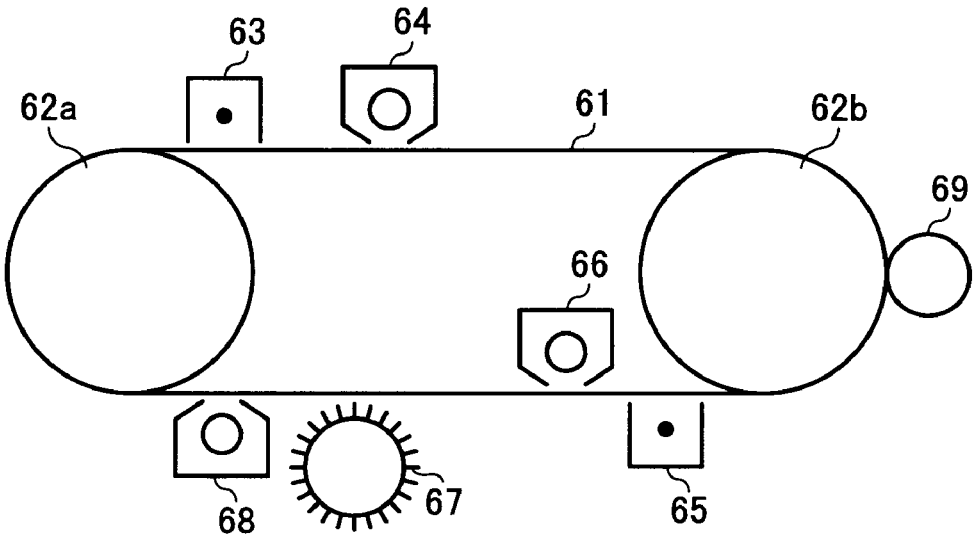
FIG. 6 is a schematic view illustrating another example of the image forming apparatus of the present invention.

FIG. 6 illustrates a main portion of another embodiment of the image forming apparatus of the present invention. Numeral 61 designates a photoreceptor which is the photoreceptor of the mentioned above.

Referring to FIG. 6, the photoreceptor 61 has a belt-form. The photoreceptor 61 is rotated by rollers 62*a* and 62*b*. The photoreceptor 61 is charged with a charger 63, and then exposed to imagewise light emitted by an imagewise light irradiator 64 (serving as a latent image forming device) to form an electrostatic latent image on the photoreceptor 61. The latent image is developed with a developing device 69 to form a toner image on the photoreceptor 61. The toner image is transferred onto a receiving paper (not shown) using a transfer charger 65. After the toner image transferring process, the surface of the photoreceptor 61 is cleaned with a cleaning brush 67 after performing a pre-cleaning light irradiating operation using a pre-cleaning light irradiator 66. The photoreceptor 61 is then discharged by being exposed to light emitted by a discharging light source 68. In the pre-cleaning light irradiating process, light irradiates the photoreceptor 61 from the substrate side (i.e., backside) of the photoreceptor 61. In this case, the substrate has to be light-transmissive.

The image forming apparatus of the present invention is not limited to the image forming apparatus as shown in FIGS. 4 and 6. For example, in FIG. 6, the pre-cleaning light irradiating operation can be performed from the photosensitive layer side of the photoreceptor 61. In addition, the light irradiation in the light image irradiating process and the discharging process may be performed from the substrate side of the photoreceptor 61.

Further, a pre-transfer light irradiation operation, which is performed before the transferring of the toner image, and a preliminary light irradiation operation, which is performed before the imagewise light irradiation, and other light irradiation operations may also be performed.

The above-mentioned image forming portion may be fixedly set in an image forming apparatus such as copiers, facsimiles and printers. However, the image forming portion may be set therein as a process cartridge. The process cartridge means an image forming unit which includes a photoreceptor and at least one device such as chargers, light irradiators, developing devices, transfer devices, cleaners and dischargers.

Figure 7:
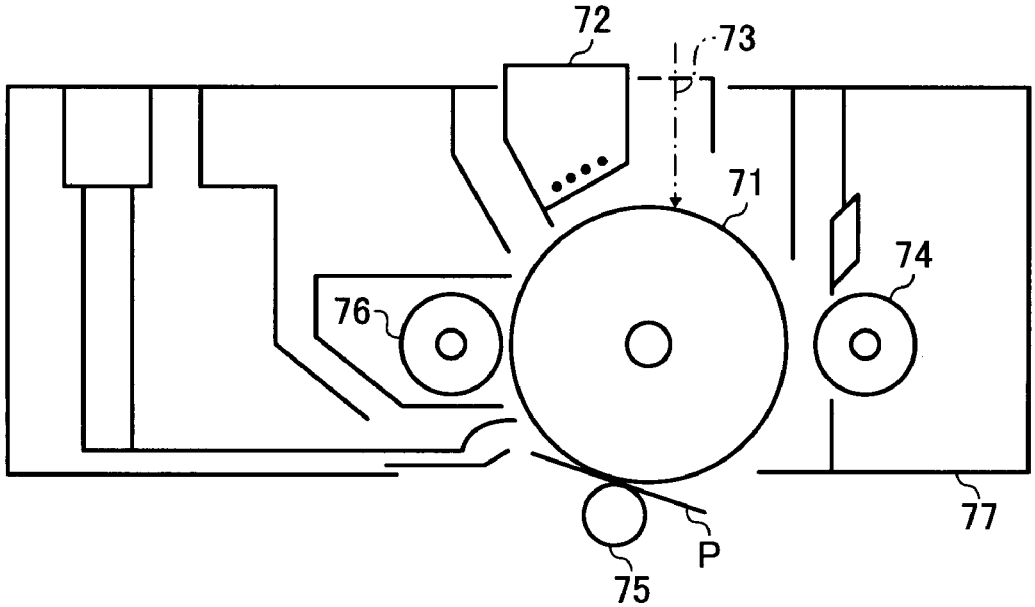
FIG. 7 is a schematic view illustrating an example of the process cartridge of the present invention.

FIG. 7 is a schematic view illustrating an embodiment of the process cartridge of the present invention. In FIG. 7, the process cartridge includes a photoreceptor 71 which is the photoreceptor of the present invention, a charger 72 configured to charge the photoreceptor 71, a developing device (a developing roller) 74 configured to develop a latent image on the photoreceptor 71 with a developer including a toner, a transfer device 75 configured to transfer the toner image onto a receiving paper, a cleaning brush 76 configured to clean the surface of the photoreceptor 71, and a housing 77. Numeral 73 denotes imagewise light emitted by an imagewise light irradiator to form an electrostatic latent image on the photoreceptor 71.

Next, a full color image forming apparatus which is an embodiment of the image forming apparatus of the present invention will be explained by reference to drawing.

Figure 8:
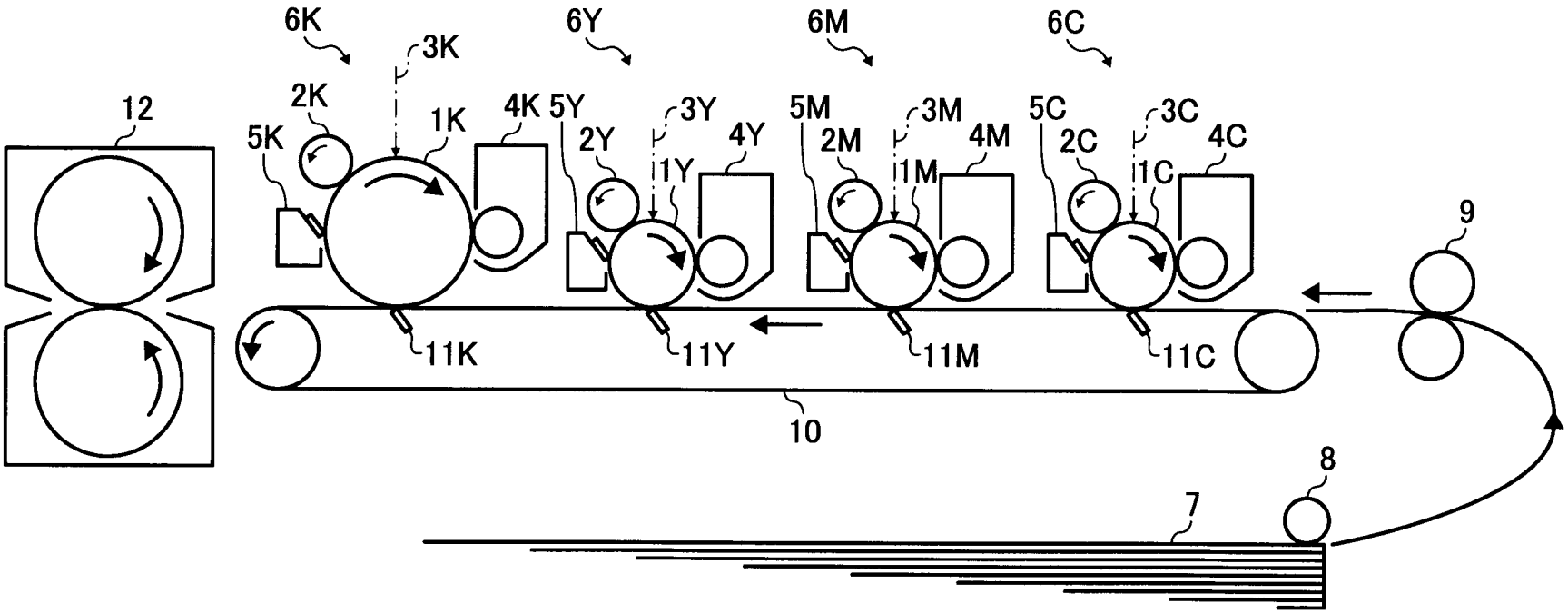
FIG. 8 is a schematic view illustrating another example of the image forming apparatus of the present invention.

FIG. 8 is a schematic view illustrating another embodiment of the image forming apparatus (a tandem type image forming apparatus) of the present invention, which includes plural image forming units. However, the image forming apparatus of the present invention is not limited thereto.

In FIG. 8, the tandem type image forming apparatus has a cyan image forming unit 6C, a magenta image forming unit 6M, a yellow image forming unit 6Y and a black image forming unit 6K. Drum photoreceptors 1C, 1M, 1Y and 1K, each of which is the photoreceptor of the present invention, rotate in the direction indicated by the respective arrows. Around the photoreceptors 1C, 1M, 1Y and 1K, chargers 2C, 2M, 2Y and 2K, developing devices 4C, 4M, 4Y and 4K, and cleaners 5C, 5M, 5Y and 5K are arranged in this order in the clockwise direction. The above-mentioned chargers which can uniformly charge the surface of the photoreceptors are preferably used as the chargers. Imagewise light irradiators 3C, 3M, 3Y and 3K irradiate a surface of the respective photoreceptors located between the chargers and the image developers with laser light to form an electrostatic latent image on the respective photoreceptors. The four image forming units 6C, 6M, 6Y and 6K are arranged along a transfer belt 10. The transfer belt 10 contacts the photoreceptors 1C, 1M, 1Y and 1K at image transfer points located between the respective image developing devices and the respective cleaners to receive color images formed on the photoreceptors. At the backsides of the image transfer points of the transfer belt 10, transfer brushes 11C, 11M, 11Y and 11K are arranged to apply a transfer bias to the transfer belt 10.

The image forming process will be explained referring to FIG. 8.

At first, in each of the image forming units 6C, 6M, 6Y and 6K, the photoreceptor 1C, 1M, 1Y or 1K is charged with the charger 2C, 2M, 2Y or 2K which rotates in the direction indicated by an arrow. Next, a light irradiator serving as a latent image forming device (not shown) irradiates each of the photoreceptors 1C, 1M, 1Y and 1K with laser light 3C, 3M, 3Y or 3K to form an electrostatic latent image on each photoreceptor.

The electrostatic latent image thus formed on each photoreceptor is developed with the developing device 4C, 4M, 4Y or 4K including a color toner C, M, Y or K to form a color toner image on each photoreceptor. The color toner images thus formed on the photoreceptors are transferred onto a receiving material 7 fed from a paper tray.

The receiving material 7 is fed by a feeding roller 8 and stops at a pair of registration rollers 9, and is timely fed to the transfer belt 10 such that the color toner images formed on the photoreceptors are transferred onto proper positions of the receiving material 7. The toner images on the photoreceptors are transferred onto the receiving material 7 at the contact points (i.e., the image transfer points) of the photoreceptor and the receiving material 7.

The toner image on each photoreceptor is transferred onto the receiving material 7 due to an electric field which is formed due to the difference between the transfer bias voltage and the potential of the photoreceptor. After passing through the four transfer points, the receiving material 7 having the color toner images thereon is then transported to a fixer 12 so that the color toner images are fixed onto the receiving material 7. Then the receiving material 7 is discharged from the main body of the image forming apparatus. Toner particles, which remain on the photoreceptors even after the transfer process, are collected by respective cleaners 5C, 5M, 5Y and 5K.

In the image forming apparatus, the image forming units 6C, 6M, 6Y and 6K are arranged in this order in the paper feeding direction, but the order is not limited thereto. In addition, although the color toner images are directly transferred onto a receiving material in this image forming apparatus, the toner images can be transferred to a receiving material via an intermediate transfer medium.

When a black image is formed, the other image forming units 6C, 6M and 6Y may be stopped. In addition, in FIG. 8, the chargers 2C, 2M, 2Y and 2K contact the respective photoreceptors 1C, 1M, 1Y and 1K, but the chargers may be short-range charges in which a proper gap of from 10 to 200 μm is formed between the charging members and the respective photoreceptors. Such short-range chargers have advantages such that the abrasion of the photoreceptors and the chargers can be reduced, and in addition occurrence of a problem in that a toner film is formed on the charging members can be prevented.

The image forming units 6C, 6M and 6Y can be detachably set in the image forming apparatus (such as copiers, facsimiles and printers) as process cartridges. As mentioned above, the process cartridge includes the photoreceptor of the present invention and at least one of a charger, a light irradiator, a developing device, a transfer device, a cleaner and a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Radically Polymerizable Monofunctional Compound Having Charge Transport Structure An example of the method for synthesizing a radically polymerizable monofunctional monomer having a charge transport structure will be explained.

Such a radically polymerizable monofunctional compound having a charge transport structure can be prepared, for example, by the method described in Japanese Patent No. 3,164,426, which is as follows.

(1) Synthesis of Triarylamine Compound Substituted with Hydroxyl Group (i.e., a Compound Having the Below-Mentioned Formula (20))

At first, 113.85 g (0.3 mol) of a triarylamine compound which is substituted with a methoxy group and which has the below-mentioned formula (19), 138 g (0.92 mol) of sodium iodide, and 240 ml of sulforane were mixed and heated at 60°

C. under a nitrogen gas flow. Then, 99 g (0.91 mol) of trimethylchlorosilane was dropped thereto over 1 hour. The mixture was agitated for 4.5 hours at about 60° C. to complete the reaction. Next, about 1.5 liters of toluene was added to the reaction product, followed by cooling to room temperature. Further, the toluene solution of the reaction product was further washed using water, followed by washing using an aqueous solution of sodium carbonate. The washing treatment was repeated several times. Then toluene was removed from the toluene solution of the reaction product, and the reaction product was subjected to column chromatography (absorbent: silica gel, solvent: toluene/ethyl acetate=20/1) to be refined. The thus prepared pale yellow oily material was mixed with cyclohexane to precipitate a crystal. Thus, 88.1 g of a white crystal having the below-mentioned formula (20) and a melting point of from 64.0 to 66.0° C. was prepared. In this reaction, the yield was 80.4%.

The crystal was then subjected to an elementary analysis. The results (i.e., the amounts (%) of the elements (C, H and N) in the crystal) are shown in Table 1.

TABLE 1

| | C | H | N |
|---|---|---|---|
| Actual measurement value | 85.06 | 6.41 | 3.73 |
| Calculated value | 85.44 | 6.34 | 3.83 |

formula (19)

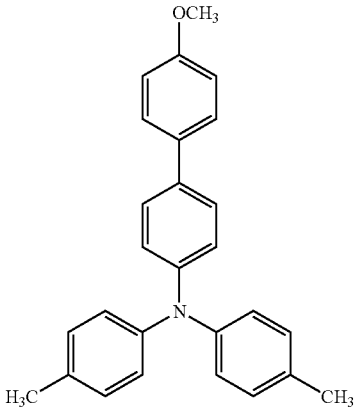

formula (20)

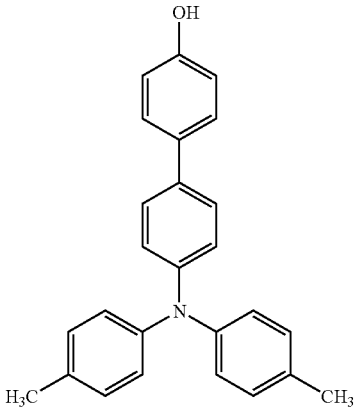

(2) Synthesis of Acrylate Compound Substituted with Triarylamine Group (i.e., Compound No. 54 Listed Before)

At first, 82.9 g (0.227 mol) of the compound having formula (20) was dissolved in 400 ml of tetrahydrofuran. Next, an aqueous solution of sodium hydroxide including 12.4 g of sodium hydroxide and 100 ml of water was dropped into the above-prepared solution. After the mixture was cooled to 5° C., 25.2 g (0.272 mol) of acrylic acid chloride was added thereto over 40 minutes. The mixture was agitated for 3 hours at 5° C. to complete the reaction. The reaction product was then added into water, and then subjected to extraction using toluene. The extraction liquid was subjected to washing using a sodium hydrogen carbonate aqueous solution, followed by washing using water. This washing treatment was performed several times.

After toluene was removed from the toluene solution of the reaction product, the reaction product was subjected to column chromatography (absorbent: silica gel, solvent: toluene) to be refined. The thus prepared colorless oily material was mixed with n-hexane to precipitate a crystal. Thus, 80.73 g of a white crystal which is the compound No. 54 listed before and has a melting point of from 117.5 to 119.0° C. was prepared. In this reaction, the yield was 84.8%.

The crystal was then subjected to an elementary analysis. The results (i.e., the amounts (%) of the elements (C, H and N) in the crystal) are shown in Table 2.

TABLE 2

| | C | H | N |
|---|---|---|---|
| Actual measurement value | 83.13 | 6.01 | 3.16 |
| Calculated value | 83.02 | 6.00 | 3.33 |

(3) Synthesis of Acrylate Compound

Preparation of diethyl 2-hydroxybenzylphosphonate

At first, 38.4 g of 2-hydroxybenzylalcohol from TOKYO KASEI KOGYO Co., Ltd. and 80 ml of o-xylene were put in a reaction vessel having a stirrer, a thermometer and a dropping funnel. Under a nitrogen gas flow, 62.8 g of triethyl phosphite was slowly dropped therein at 80° C., and the reaction was further performed for 1 hour at the same temperature. Next, the produced ethanol, the solvent (o-xylene) and unreacted triethyl phosphite were removed from the reaction by reduced-pressure distillation. Thus, 66 g of 2-diethylhydroxybenzylphosphonate having a boiling point of 120.0° C./1.5 mm Hg was prepared. In this reaction, the yield was 90%.

Preparation of 2-hydroxy-4'-(N,N-bis(4-methylphenyl)amino)stilbene

At first, 14.8 g of potassium tert-butoxide and 50 ml of tetrahydrofuran were put in a reaction vessel having a stirrer, a thermometer and a dropping funnel. Under a nitrogen gas flow, a solution in which 9.90 g of the diethyl 2-hydroxybenzylphosphonate and 5.44 g of 4-(N,N-bis(4-methylphenyl)amino)benzaldehyde were dissolved in tetrahydrofuran was slowly dropped therein at room temperature, and the reaction is further performed for 2 hours at the same temperature. Next, water was added thereto while cooling the reaction product with water, a hydrochloric acid solution with a normal concentration of 2 (i.e., 2N) was added therein to acidize the reaction product, and then tetrahydrofuran was removed by an evaporator. Further, toluene was added thereto to extract a crude product with toluene. The toluene phase was washed with water, a sodium hydrogen carbonate solution and a saturated saline in this order, and magnesium sulfate was then added thereto to dehydrate the toluene phase.

After the product was subjected to filtering, toluene was removed therefrom. Thus, an oily crude product was produced. The oily crude product was further subjected to column-refinement using a silica gel, followed by crystallization in hexane. Thus, 5.09 g of 2-hydroxy-4'-(N,N-bis(4-methylphenyl)amino)stilbene having a boiling point of 136.0 to 138.0° C. was prepared at a yield of 72%.

Preparation of 4'-(N,N-bis(4-methylphenyl)amino) stilbene-2-yl acrylate

At first, 14.9 g of the 2-hydroxy-4'-(N,N-bis(4-methylphenyl)amino)stilbene, 100 ml of tetrahydrofuran and 21.5 g of a 12% sodium hydrogen carbonate solution were put in a reaction vessel having a stirrer, a thermometer and a dropping funnel. Under a nitrogen gas flow, 5.17 g of acrylic acid chloride was dropped therein over 30 min at 5° C., and the reaction was further performed for 3 hours at the same temperature. The reaction liquid was put in water, and the mixture was subjected to extraction with toluene, condensation and column-refinement with a silica gel to prepare a crude product. The crude product was then recrystallized with ethanol. Thus, 13.5 g of a yellow needle-form crystal 4'-(N,N-bis(4-methylphenyl)amino)stilbene-2-yl acrylate (compound No. 105 listed before) having a boiling point of 104.1 to 105.2° C. was prepared at a yield of 79.8%.

The crystal was then subjected to an elementary analysis. The results (i.e., the amounts (%) of the elements (C, H and N) in the crystal) are shown in Table 3.

TABLE 3

| | C | H | N |
|---|---|---|---|
| Found value | 83.46 | 6.06 | 3.18 |
| Calculated value | 83.57 | 6.11 | 3.14 |

As mentioned above, by reacting an ester 2-hydroxybenzylphosphate derivative with various amino-substituted benzaldehyde derivatives, a number of 2-hydroxystilbene derivatives can be synthesized. Further, by subjecting the 2-hydroxystilbene derivatives to acrylation or methacrylation, various acrylic or methacrylic ester compounds can be synthesized.

Example 1

Preparation of Intermediate Layer

The following components were mixed to prepare an intermediate layer coating liquid.

| | |
|---|---|
| Titanium oxide (CR-EL, from Ishihara Sangyo Kaisha K.K.) | 50 parts |
| Alkyd resin (BEKKOLITE M6401-50 from Dainippon Ink And Chemicals, Inc., solid content of 50%) | 15 parts |
| Melamine resin (SUPER BEKKAMINE L-145-60 from Dainippon Ink And Chemicals, Inc., solid content of 60%) | 8 parts |
| 2-Butanone | 120 parts |

The intermediate layer coating liquid was coated on an aluminum drum (specified in JIS1050), which has an outside diameter of 30 mm and a length of 340 mm, by a blade coating method, and the coated liquid was dried for 20 minutes at 130° C. Thus, an intermediate layer having a thickness of about 3.5 μm was prepared.

Preparation of Charge Generation Layer (CGL)

The following components were mixed to prepare a CGL coating liquid.

| | |
|---|---|
| Asymmetric bisazo pigment having the following formula | 2.5 parts |

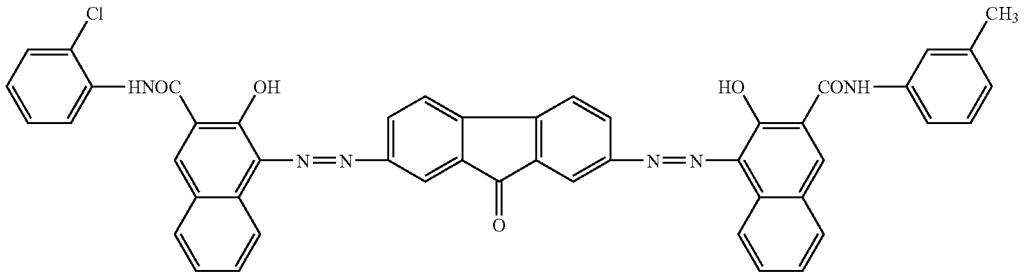

| | |
|---|---|
| Polyvinyl butyral resin (XYHL, manufactured by Union Carbide Corp.) | 0.5 parts |
| Methyl ethyl ketone | 110 parts |
| Cyclohexanone | 260 parts |

The CGL coating liquid was coated on the intermediate layer by a blade coating method, and the coated liquid was dried for 20 minutes at 130° C. to prepare a CGL having a thickness of about 0.2 μm.

Preparation of Charge Transport Layer (CTL)

The following components were mixed to prepare a CTL coating liquid.

| | |
|---|---|
| Z-form polycarbonate (manufactured by Teijin Chemicals Ltd.) | 10 parts |
| CTM having the following formula | 7 parts |

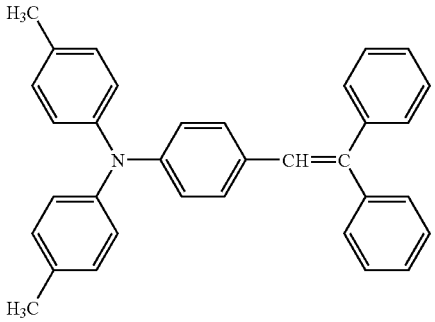

| | |
|---|---|
| Tetrahydrofuran | 80 parts |
| Silicone oil (KF50-100CS from Shin-Etsu Chemical Co., Ltd.) | 0.002 parts |

The CTL coating liquid was coated on the CGL by a blade coating method, and the coated liquid was dried for 20 minutes at 130° C. to prepare a CTL having a thickness of about 20 μm.

Preparation of Crosslinked Protective Layer

The following components were mixed to prepare a protective layer coating liquid.

| | |
|---|---|
| Ttrimethylolpropane triacrylate (KAYARAD TMPTA from Nippon Kayaku Co., Ltd.) | 10 parts |
| Photopolymerization initiator (1-hydroxycyclohexyl phenyl ketone, IRGACURE 184 from Ciba Specialty Chemicals, molecular weight of 204) | 1 part |
| Tetrahydrofuran | 50 parts |

Figure 10:
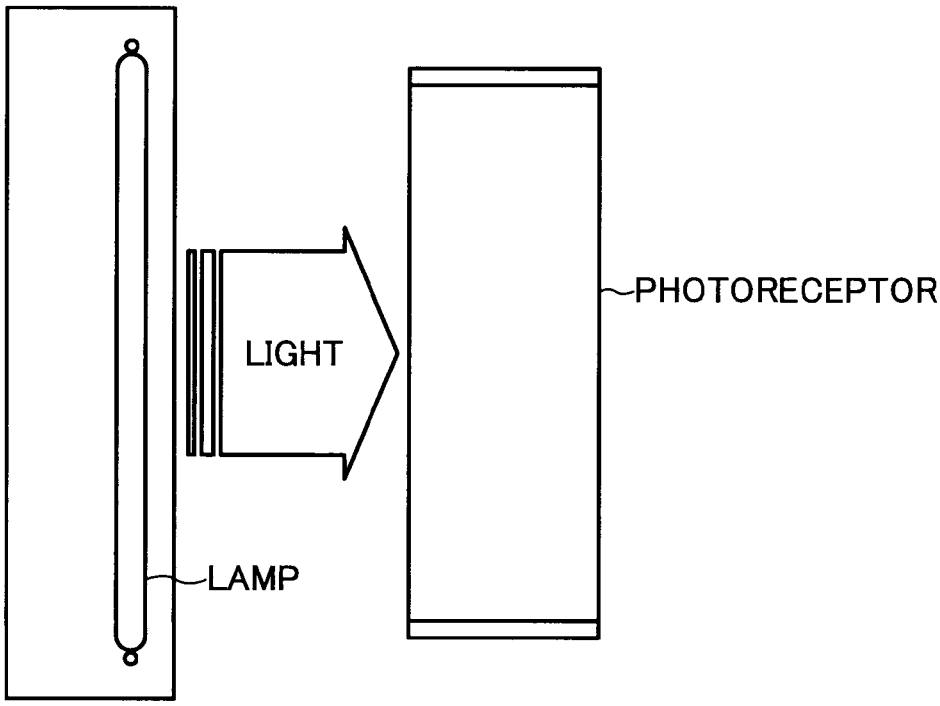
FIG. 10 is a schematic view illustrating the lamp system used for evaluating example photoreceptors and comparative example photoreceptors.

The protective layer coating liquid was coated on the CTL, and the coated liquid was exposed to UV light for 120 seconds, which was emitted by a UV lamp system manufactured by Ushio Inc. and illustrated in FIG. 10, to be crosslinked. Thus, a crosslinked protective layer having a thickness of about 10 μm was prepared.

Treatment Using Supercritical Fluid (i.e., Injection of CTM into Protective Layer)

The thus prepared photoreceptor and 0.5 g of the CTM used for the CTL coating liquid was contained in a 700 ml pressure-resistant container, and carbon dioxide was fed thereinto while circulated to subject the photoreceptor to a supercritical fluid treatment. Carbon dioxide was heated and pressed from room temperature and 0.1 MPa to 40° C. and 7 MPa at a temperature rising speed of 2-3° C./min and a pressure increasing speed of 0.2 MPa/min. Carbon dioxide was further heated and pressed so as to be 80° C. and 30 MPa at a temperature rising speed of 2-3° C./min and a pressure increasing speed of 10 MPa/min while flown at a flow speed of 5.0/min (volume under normal conditions) so that carbon dioxide becomes a supercritical fluid. The photoreceptor was contacted with the supercritical fluid including the CTM for 2 hours while flowing the supercritical fluid (carbon dioxide) at a flow speed of 5.0/min (volume under normal conditions). After the treatment, carbon dioxide was cooled and depressed to room temperature and 0.1 MPa (i.e., 1 atmospheric pressure) at a cooling speed of 2-3° C./min and a pressure decreasing speed of 3-5 MPa/min while flown at a flow speed of from 1.0 to 3.0/min (volume under normal conditions).

Thus, a photoreceptor of Example 1 in which the CTM is injected into the crosslinked protective layer was prepared.

Example 2

The procedure for preparation of the photoreceptor in Example 1 was repeated except that the intermediate layer was replaced with a combination of a charge blocking layer with a thickness of 0.5 μm and a moiré preventing layer with a thickness of 3.5 μm located on the charge blocking layer, and carbon dioxide serving as the supercritical fluid was replaced with a mixture of carbon dioxide with ethanol. The formulation of the coating liquids for the charge blocking layer and moiré preventing layer is as follows.

| (Charge blocking layer coating liquid) | |
|---|---|
| N-methoxymethylated nylon (FR101 from Namariichi Co., Ltd.) | 5 parts |
| Methanol | 70 parts |
| n-Butanol | 30 parts |
| (Moiré preventing layer coating liquid) | |
| Titanium oxide (CR-EL, from Ishihara Sangyo Kaisha K.K.) | 126 parts |
| Alkyd resin (BEKKOLITE M6401-50-S, from Dainippon Ink And Chemicals, Inc.) | 33.6 parts |
| Melamine resin (SUPER BEKKAMINE L-121-60, from Dainippon Ink And Chemicals, Inc.) | 18.7 parts |
| 2-Butanone | 100 parts |
| (Conditions of treatment using supercritical fluid) | |
| Content of ethanol: 5% by weight based on carbon dioxide | |
| Supercritical temperature: 40° C. | |
| Supercritical pressure: 15 MPa | |
| Processing time: 1 hour | |

Thus, a photoreceptor of Example 2 was prepared.

Example 3

The procedure for preparation of the photoreceptor in Example 1 was repeated except that the amount of the CTM mixed with the supercritical fluid was changed from 0.5 g to 0.2 g.

Thus, a photoreceptor of Example 3 was prepared.

Example 4

The procedure for preparation of the photoreceptor in Example 1 was repeated except that the formulation of the protective layer coating liquid was changed as follows and in addition the conditions for the treatment using a supercritical fluid were also changed.

| (Protective layer coating liquid) | |
|---|---|
| Ethoxylated bisphenol A diacrylate (ABE-300, from Shin-Nakamura Chemical Co., Ltd.) | 10 parts |
| 2-Chlorothioxanthone (Tokyo Kasei Kogyo Co., Ltd.) | 1 part |
| Tetrahydrofuran | 50 parts |
| (Conditions of treatment using supercritical fluid) | |

Content of ethanol: 5% by weight based on carbon dioxide
Supercritical temperature: 60° C.
CTM included in supercritical fluid:
Compound having the following formula:

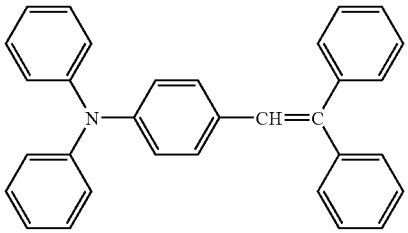

Thus, a photoreceptor of Example 4 was prepared.

Example 5

The procedure for preparation of the photoreceptor in Example 1 was repeated except that the formulation of the protective layer coating liquid was changed as follows and in addition the conditions for the treatment using a supercritical fluid were also changed.

| (Protective layer coating liquid) | |
|---|---|
| Urethane acrylate (U-15HA, from Shin-Nakamura Chemical Co., Ltd.) | 10 parts |
| Dibenzyl (Tokyo Kasei Kogyo Co., Ltd.) | 1 part |
| Tetrahydrofuran | 50 parts |
| Butyl acetate | 20 parts |

(Conditions of treatment using supercritical fluid)
Supercritical temperature: 80° C.
CTM included in supercritical fluid:
Compound having the following formula:

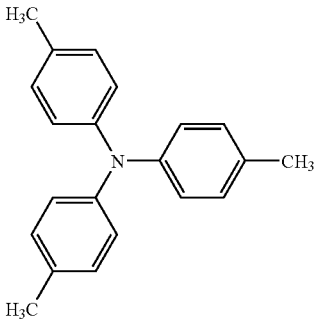

Thus, a photoreceptor of Example 5 was prepared.

Example 6

The procedure for preparation of the photoreceptor in Example 1 was repeated except that the formulation of the protective layer coating liquid was changed as follows and in addition the conditions for the treatment using a supercritical fluid were also changed.

| (Protective layer coating liquid) | |
|---|---|
| Pentaerythritol tetraacrylate (SR-295, from Nippon Kayaku Co., Ltd.) | 10 parts |
| Benzoin isopropyl ether (Tokyo Kasei Kogyo Co., Ltd.) | 1 part |
| Tetrahydrofuran | 50 parts |
| (Conditions of treatment using supercritical fluid) | |

Supercritical temperature: 100° C.
CTM included in supercritical fluid:
Compound having the following formula:

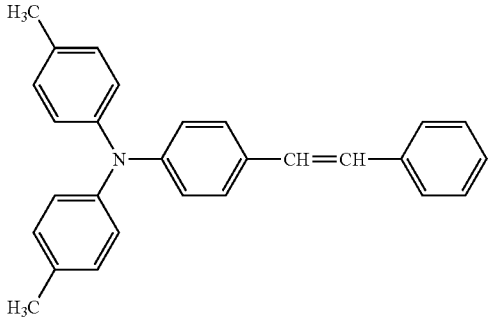

Thus, a photoreceptor of Example 6 was prepared.

Example 7

The procedure for preparation of the photoreceptor in Example 1 was repeated except that the formulation of the protective layer coating liquid was changed as follows and in addition the conditions for the treatment using a supercritical fluid were also changed.

| (Protective layer coating liquid) | |
|---|---|
| Dipentaerythritol hexaacrylate (KAYARAD DPHA, from Nippon Kayaku Co., Ltd.) | 10 parts |
| 2,4-diethylthioxanthone (Tokyo Kasei Kogyo Co., Ltd.) | 1 part |
| Tetrahydrofuran | 50 parts |

-continued

| (Conditions of treatment using supercritical fluid) |
|---|
| Supereritical temperature: 120° C. |
| CTM included in supercritical fluid: |
| Compound having the following formula: |

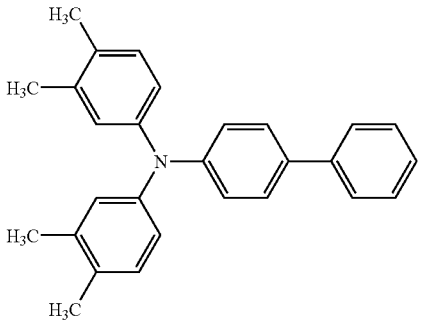

Thus, a photoreceptor of Example 7 was prepared.

Example 8

The procedure for preparation of the photoreceptor in Example 1 was repeated except that the formulation of the protective layer coating liquid was changed as follows and in addition the conditions for the treatment using a supercritical fluid were also changed.

| (Protective layer coating liquid) | |
|---|---|
| Caprolactone-modified dipentaerythritol hexaacrylate (KAYARAD DPCA-120, from Nippon Kayaku Co., Ltd.) | 10 parts |
| Phenylbis(2,4,6-trimethylbenzoyl)phosphineoxide (Tokyo Kasei Kogyo Co., Ltd.) | 1 part |
| Tetrahydrofuran | 50 parts |
| (Conditions of treatment using supercritical fluid) | |
| Supercritical temperature: 140° C. | |
| CTM included in supercritical fluid: | |
| Compound having the following formula: | |

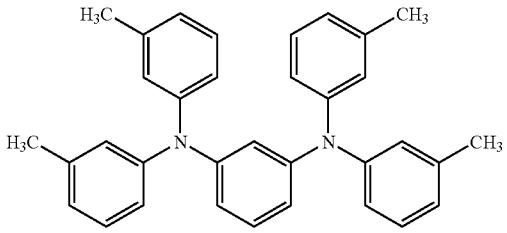

Thus, a photoreceptor of Example 8 was prepared.

Example 9

The procedure for preparation of the photoreceptor in Example 1 was repeated except that the formulation of the protective layer coating liquid was changed as follows.

| (Protective layer coating liquid) | |
|---|---|
| Trimethylolpropane triacrylate (KAYARAD TMPTA, from Nippon Kayaku Co., Ltd.) | 10 parts |
| Photopolymerization initiator (1-hydroxycyclohexyl phenyl ketone, IRGACURE 184 from Ciba Specialty Chemicals, molecular weight of 204) | 1 part |
| Tetrahydrofuran | 50 parts |
| CTM having the following formula | 3 parts |

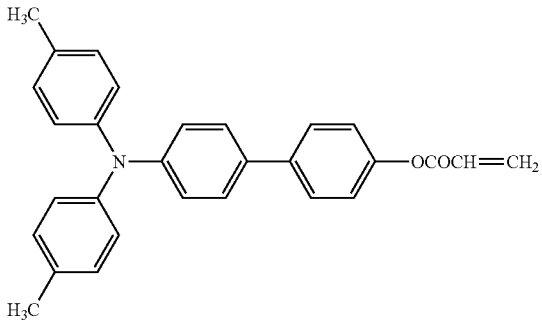

Thus, a photoreceptor of Example 9 was prepared.

Example 10

The procedure for preparation of the photoreceptor in Example 1 was repeated except that the formulation of the protective layer coating liquid was changed as follows.

| (Protective layer coating liquid) | |
|---|---|
| Trimethylolpropane triacrylate (KAYARAD TMPTA, from Nippon Kayaku Co., Ltd.) | 10 parts |
| Photopolymerization initiator (1-hydroxycyclohexyl phenyl ketone, IRGACURE 184 from Ciba Specialty Chemicals, molecular weight of 204) | 1 part |
| Tetrahydrofuran | 50 parts |
| CTM having the following formula | 3 parts |

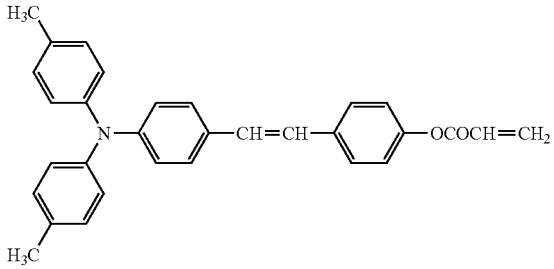

Thus, a photoreceptor of Example 10 was prepared.

Example 11

The procedure for preparation of the photoreceptor in Example 1 was repeated except that the formulation of the protective layer coating liquid was changed as follows.

| (Protective layer coating liquid) | |
|---|---|
| Trimethylolpropane triacrylate (KAYARAD TMPTA, from Nippon Kayaku Co., Ltd.) | 10 parts |
| Photopolymerization initiator (1-hydroxycyclohexyl phenyl ketone, IRGACURE 184 from Ciba Specialty Chemicals, molecular weight of 204) | 1 part |
| Tetrahydrofuran | 50 parts |
| CTM having the following formula | 3 parts |

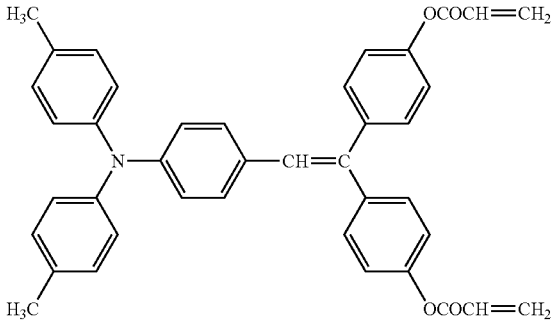

Thus, a photoreceptor of Example 10 was prepared.

Comparative Example 1

The procedure for preparation of the photoreceptor in Example 1 was repeated except that the protective layer was not formed and the thickness of the CTL was changed to 37 μm.

Thus, a photoreceptor of Comparative Example 1 was prepared.

Comparative Example 2

The procedure for preparation of the photoreceptor in Example 1 was repeated except that the photoreceptor was not subjected to the treatment using the supercritical fluid.

Thus, a photoreceptor of Comparative Example 2 was prepared.

Comparative Example 3

The procedure for preparation of the photoreceptor in Example 1 was repeated except that the CTM was not included in the supercritical fluid.

Thus, a photoreceptor of Comparative Example 3 was prepared.

Comparative Example 4

A photoreceptor was prepared by the method described in JP-A 2006-71856.

Preparation of Undercoat Layer

The following components were mixed to prepare an undercoat layer coating liquid.

| | |
|---|---|
| Alkyd resin (BEKKOSOL 1307-60-EL from Dainippon Ink And Chemicals, Inc) | 6 parts |
| Melamine resin (SUPER BEKKAMINE G-821-60 from Dainippon Ink And Chemicals, Inc.) | 4 parts |
| Titanium oxide | 40 parts |
| Methyl ethyl ketone | 50 parts |

The intermediate layer coating liquid was coated on an aluminum cylinder by a dip coating method, and the coated liquid was dried. Thus, an undercoat layer having a thickness of 3.5 μm was prepared.

Preparation of Charge Generation Layer (CGL)

The following components were mixed to prepare a CGL coating liquid.

| | |
|---|---|
| Bisazo pigment having the following formula | 2.5 parts |

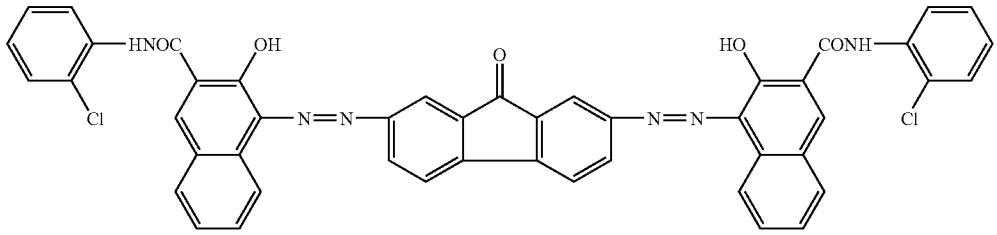

| | |
|---|---|
| Polyvinyl butyral resin (XYHL, manufactured by Union Carbide Corp.) | 0.5 parts |
| Cyclohexanone | 200 parts |
| Methyl ethyl ketone | 80 parts |

The CGL coating liquid was coated on the intermediate layer by a dip coating method, and the coated liquid was dried to prepare a CGL having a thickness of 0.2 μm.

Preparation of Charge Transport Layer (CTL)

The following components were mixed to prepare a CTL coating liquid.

| | |
|---|---|
| Z-form polycarbonate (PANLITE TS-2050 manufactured by Teijin Chemicals Ltd.) | 10 parts |
| CTM having the following formula | 7 parts |

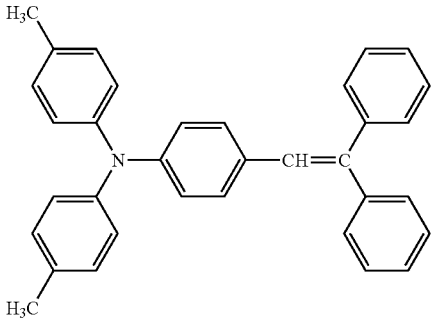

-continued

| | |
|---|---|
| Tetrahydrofuran | 100 parts |
| 1% solution of silicone oil (Silicone oil: KF50-100CS from Shin-Etsu Chemical Co., Ltd.) | 1 part |

The CTL coating liquid was coated on the CGL by a dip coating method, and the coated liquid was dried to prepare a CTL having a thickness of 23 μm.

Preparation of Crosslinked Protective Layer

The following components were mixed to prepare a protective layer coating liquid.

| | |
|---|---|
| Radically-polymerizable monomers having no charge transport structure | (95 parts) |
| (1) Alkyl-modified dipentaerythritol pentaacrylate | 47.5 parts |
| (KAYARAD D-310 from Nippon Kayaku Co., Ltd.) | |

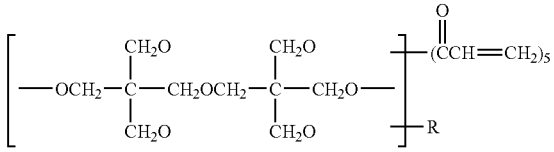

| | |
|---|---|
| (2) Ethoxylated bisphenol A diacrylate | 47.5 parts |
| (ABE-300, from Shin-Nakamura Chemical Co., Ltd.) | |

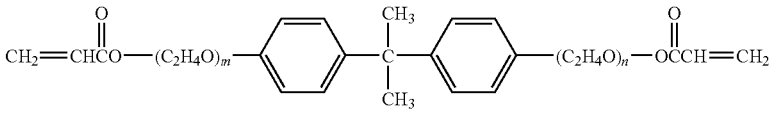

| | |
|---|---|
| Radically-polymerizable monofunctional compound having charge transport structure | 95 parts |
| (Compound No. 54 mentioned above) | |
| Photopolymerization initiator | 10 part |
| (1-hydroxycyclohexyl phenyl ketone, IRGACURE 184 from Ciba Specialty Chemicals, molecular weight of 204) | |
| Tetrahydrofuran | 1200 parts |

The protective layer coating liquid was coated on the CTL by a spray coating method, and the coated liquid was exposed to light to be crosslinked. The light irradiation conditions were as follows.

Lamp used: Metal halide lamp

Illuminance intensity: 500 mW/cm$^2$

Irradiation time: 20 seconds

The protective layer was further heated for 30 minutes at 130° C. Thus, a crosslinked protective layer having a thickness of 4.0 μm was prepared.

Thus, a photoreceptor of Comparative Example 4 was prepared.

The thus prepared photoreceptors of Examples 1-11 and Comparative Examples 1-4 were evaluated as follows.

1. Resistance to NOx Gasses

Each of the above-prepared photoreceptors was set in a process cartridge having configuration as illustrated in FIG. 7, and the process cartridges were set one after the other in a tandem image forming apparatus having configuration as illustrated in FIG. 8 to be evaluated.

The image forming conditions of the image forming apparatus were as follows.

Charger: Charging roller.

Charging conditions: The applied voltage was adjusted such that the photoreceptor has an initial potential of −700V.

Light source for image irradiating device: Laser diode emitting light with a wavelength of 655 nm (writing images using a polygon mirror).

Light irradiation conditions: quantity of light from the light irradiating device was controlled such that the irradiated portion of the photoreceptor has a potential of −100V at the developing device.

Development bias: −500V

Transfer device: Transfer belt.

Discharging device: Light emitting diode (LED) emitting light with a wavelength of 655 nm.

An electrometer was set near the developing device to measure the potential of a non-irradiated portion of the photoreceptor. Before and after the photoreceptor was exposed to NOx gasses, the potentials of the photoreceptor were measured.

Figure 9:
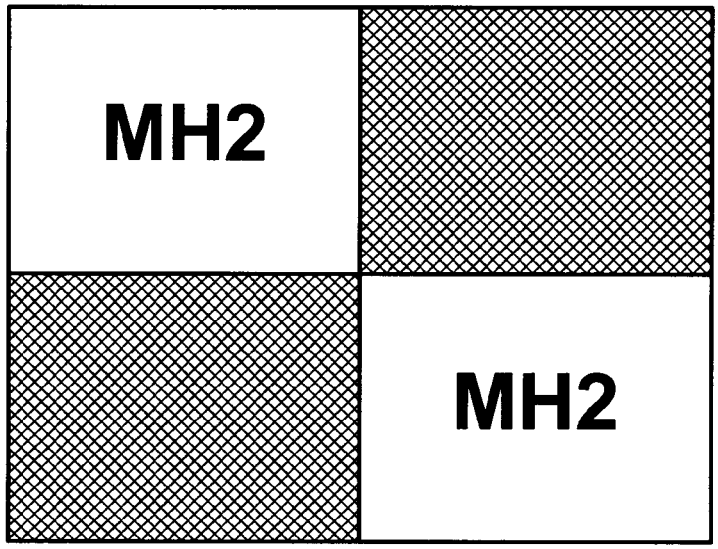
FIG. 9 is a schematic view illustrating the original image used for evaluating the image qualities of example and comparative example photoreceptors.

In addition, copies of an original image illustrated in FIG. 9 were produced before and after the photoreceptor was exposed to NOx gasses to determine whether the images have a ghost image of a character image "MH".

The NOx exposure test was performed using a NOx tester manufactured by Dylec Inc. The NOx exposure test conditions were as follows.

Concentration of NO: 50 ppm

Concentration of $NO_2$: 30 ppm

Temperature: 40° C.

Relative humidity: 55%

Exposure time: 7 days

The image quality of the copied images concerning ghost image was graded as follows.

◎: Excellent (i.e., formation of no ghost image)

○: Good

Δ: Slightly bad

X: Bad (i.e., formation of serious ghost images)

The evaluation results are shown in Table 4.

TABLE 4

| | Ghost image | | Potential of non-irradiated portion (V) | |
|---|---|---|---|---|
| | Initial images | | | |
| | (before NOx exposure) | After NOx exposure | Initial photoreceptor | After NOx exposure |
| Ex. 1 | ◎ | ◎ | 700 | 690 |
| Ex. 2 | ◎ | ◎ | 700 | 690 |
| Ex. 3 | ◎ | ◎ | 700 | 690 |
| Ex. 4 | ◎ | ◎ | 700 | 690 |
| Ex. 5 | ◎ | ◎ | 700 | 690 |
| Ex. 6 | ◎ | ◎ | 700 | 690 |
| Ex. 7 | ◎ | ◎ | 700 | 690 |
| Ex. 8 | ◎ | ◎ | 700 | 690 |
| Ex. 9 | ◎ | ◎ | 700 | 670 |
| Ex. 10 | ◎ | ◎ | 700 | 670 |
| Ex. 11 | ◎ | ◎ | 700 | 670 |
| Comp. Ex. 1 | ◎ | ◎ | 700 | 690 |
| Comp. Ex. 2 | Since the initial potential of the irradiated portion of the photoreceptor was high, the evaluation was not performed. | | | |
| Comp. Ex. 3 | Since the initial potential of the irradiated portion of the photoreceptor was high, the evaluation was not performed. | | | |
| Comp. Ex. 4 | ◎ | X | 700 | 550 |

It is clear from Table 4 that the photoreceptors of the present invention neither produce ghost images nor cause a potential decrease problem in that the potential of a non-irradiated portion decreases, even after the photoreceptors are exposed to NOx. The photoreceptor of Comparative Example 1, which has no protective layer, has good NOx resistance (but has a large abrasion loss as mentioned below). However, the photoreceptors of Comparative Example 2, which was not subjected to the supercritical-fluid treatment, and Comparative Example 3, which was subjected to the supercritical-fluid treatment using a supercritical fluid including no charge transport material, have poor light decay properties (i.e., the initial potential of the irradiated portion is high), and therefore further evaluation was not performed on the photoreceptors. Further, the photoreceptor of Comparative Example 4 prepared by the method described in JP-A 2006-71856 formed serious ghost images after being exposed to NOx, and the potential of the non-irradiated portion greatly decreased after the photoreceptor was exposed to NOx.

2. Accelerated Fatigue Test

Similarly to the above-mentioned NOx test, each photoreceptor was set in the process cartridge and the process cartridges were set one after the other in the tandem image forming apparatus to be evaluated. Before the test, the conditions of the image forming apparatus were controlled so as to be the same as those mentioned above in the NOx test.

Fifty thousands (50,000) copies of an original image including character images at an image area proportion of 6% were continuously produced. In this regard, each of the pressure of the cleaning blade was increased to be twice, and charging (i.e., applied voltage) and light irradiating (quantity of light) were controlled such that the charges flowing the photoreceptor becomes twice that before the test.

At the beginning of the running test and after production of 50,000 images, the potential of a non-irradiated portion and an irradiated portion of each photoreceptor were measured with a potential meter. In addition, before and after the running test, the thickness of the photoreceptor was measured to determine the abrasion loss of the protective layer (i.e., the outermost layer). When the abrasion loss was determined, thicknesses of several points of the photoreceptor were measured at regular intervals of 1 cm in the longitudinal direction thereof, wherein thicknesses of both side portions of the photoreceptor with a width of 5 cm were not measured.

Further, after production of 50,000 images, a white solid image was produced to determine whether the white image is soiled with toner particles (i.e., whether the photoreceptor causes a background development problem). The image quality of the white solid images concerning background development was graded as follows.

◎: Excellent

○: Good

Δ: Slightly bad

X: Bad

Furthermore, after production of 50,000 images, a copy of a portrait original image, ISO/JIS-SCID image N1, was produced to evaluate the color reproducibility of the photoreceptor. The image quality of the produced portrait images concerning color reproducibility was graded as follows.

◎: Excellent

○: Good

Δ: A Slightly bad

X: Bad

The evaluation results are shown in Table 5.

TABLE 5

| | Potential of non-irradiated portion (−V) | | Potential of irradiated portion (−V) | | | | |
|---|---|---|---|---|---|---|---|
| | Initial | After 50,000 images | Initial | After 50,000 images | Background Development | Color reproducibility | Abrasion loss (μm) |
| Ex. 1 | 700 | 690 | 70 | 80 | ○ | ◎ | 1.2 |
| Ex. 2 | 700 | 690 | 80 | 90 | ◎ | ◎ | 1.3 |
| Ex. 3 | 700 | 690 | 100 | 120 | ○ | ◎ | 1.3 |
| Ex. 4 | 700 | 690 | 65 | 70 | ○ | ◎ | 1.4 |
| Ex. 5 | 700 | 690 | 60 | 65 | ○ | ◎ | 1.2 |
| Ex. 6 | 700 | 690 | 60 | 60 | ○ | ◎ | 1.2 |
| Ex. 7 | 700 | 690 | 55 | 60 | ○ | ◎ | 1.2 |
| Ex. 8 | 700 | 690 | 50 | 55 | ○ | ◎ | 1.2 |
| Ex. 9 | 700 | 690 | 80 | 95 | ○ | ◎ | 1.2 |
| Ex. 10 | 700 | 690 | 85 | 100 | ○ | ◎ | 1.1 |
| Ex. 11 | 700 | 690 | 90 | 105 | ○ | ◎ | 1.0 |
| Comp. Ex. 1 | 700 | 580 | 50 | 50 | X | X | 6.0 |
| Comp. Ex. 4 | 700 | 650 | 110 | 180 | ○ | Δ | 1.4 |

It is clear from Table 5 that the photoreceptors of the present invention can maintain good electric properties and can produce color images with good color reproducibility and little background development even after 50,000 images are produced. In addition, the photoreceptors have small abrasion loss.

In contrast, the photoreceptor of Comparative Example 1, which has no protective layer, has large abrasion loss, and thereby the potential of the non-irradiated portion is largely decreased after production of 50,000 images. In addition, the color image formed after production of 50,000 images has background development and poor color reproducibility. The photoreceptor of Comparative Example 4 has drawbacks in that the potential of the non-irradiated portion decreases and the potential of the irradiated portion increases after production of 50,000 images. Therefore, the produced color image produced after production of 50,000 images has slightly poor color reproducibility.

As mentioned above, the photoreceptor of the present invention has a good combination of electric properties and mechanical durability, and therefore has good reliability.

This document claims priority and contains subject matter related to Japanese Patent Application No. 2006-296146, filed on Oct. 31, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for preparing a photoreceptor comprising:

forming a photosensitive layer overlying an electroconductive substrate;

coating a liquid including a radically polymerizable compound to form a protective layer;

irradiating the protective layer with light to crosslink the protective layer; and then contacting the protective layer with a mixture of a fluid, which is selected from the group consisting of supercritical fluids and subcritical fluids and which comprises a charge transport material in an amount of not less than 0.5 g/l, at a pressure of from 15 MPa to 30 MPa to inject the charge transport material into at least the protective layer.

2. The method according to claim 1, wherein the fluid is selected from the group consisting of supercritical fluids of carbon dioxide and subcritical fluids of carbon dioxide.

3. The method according to claim 1, wherein the fluid further comprises a member selected from the group consisting of methanol and ethanol.

4. The method according to claim 1, wherein the fluid has a temperature of from 30 to 140° C.

5. The method according to claim 1, wherein the radically polymerizable compound has no charge transport structure.

6. The method according to claim 1, wherein the radically polymerizable compound has three or more radically polymerizable functional groups.

7. The method according to claim 1, wherein the charge transport material has no radically polymerizable functional group.

8. The method according to claim 1, wherein the charge transport material comprises a member selected from the group consisting of triarylamine derivatives, hydrazone derivatives and pyrazoline derivatives, and carbazole derivatives.

9. The method according to claim 8, wherein the charge transport material comprises a triarylamine derivative.

10. A photoreceptor comprising:

an electroconductive substrate;

a photosensitive layer overlying the electroconductive substrate;

a crosslinked protective layer overlying the photosensitive layer, wherein the crosslinked protective layer comprises a charge transport material, wherein the photoreceptor is prepared by the method according to claim 1.

11. The photoreceptor according to claim 10, wherein the fluid is selected from the group consisting of supercritical fluids of carbon dioxide and subcritical fluids of carbon dioxide.

12. The photoreceptor according to claim 10, wherein the photosensitive layer comprises a charge generation layer and a charge transport layer overlying the charge generation layer, and wherein the protective layer forming step of the method comprises:

forming a charge transport layer; and forming a charge transport layer overlying the charge generation layer.

13. An image forming method comprising:

charging the photoreceptor according to claim 10;

irradiating a surface of the photoreceptor with light to form an electrostatic latent image thereon;

developing the electrostatic latent image with a developer including a toner to form a toner image thereon;

transferring the toner image onto a receiving material; and cleaning a surface of the photoreceptor after the toner image is transferred.

14. An image forming apparatus comprising:

the photoreceptor according to claim 10;

a charging device configured to charge the photoreceptor;

a latent image forming device configured to form an electrostatic latent image on a surface of the photoreceptor;

a developing device configured to develop the electrostatic latent image with a developer including a toner to form a toner image thereon;

a transferring device configured to transfer the toner image onto a receiving material; and a cleaning device configured to clean a surface of the photoreceptor after the toner image is transferred.

15. A process cartridge comprising:

the photoreceptor according to claim 10; and at least one of a charging device configured to charge the photoreceptor; a latent image forming device configured to form an electrostatic latent image on a surface of the photoreceptor; a developing device configured to develop the electrostatic latent image with a developer including a toner to form a toner image thereon; a transferring device configured to transfer the toner image onto a receiving material; and a cleaning device configured to clean a surface of the photoreceptor after the toner image is transferred, wherein the process cartridge is detachably attachable to an image forming apparatus as a unit.

16. The method according to claim 1, wherein the protective layer is contacted with the mixture for at least one hour.

* * * * *